US006936394B2

(12) United States Patent
Okado et al.

(10) Patent No.: US 6,936,394 B2
(45) Date of Patent: Aug. 30, 2005

(54) REPLENISHING DEVELOPER AND DEVELOPING METHOD

(75) Inventors: Kenji Okado, Ushiku (JP); Yushi Mikuriya, Numazu (JP); Kazumi Yoshizaki, Toride (JP); Naotaka Ikeda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/081,844

(22) Filed: Feb. 25, 2002

(65) Prior Publication Data

US 2003/0091922 A1 May 15, 2003

(30) Foreign Application Priority Data

Feb. 28, 2001 (JP) ..... 2001-054232
Feb. 28, 2001 (JP) ..... 2001-054233

(51) Int. Cl.[7] ..... G03G 9/107; G03G 9/113

(52) U.S. Cl. ..... 430/111.33; 430/111.31; 430/111.3; 430/111.1; 430/111.35; 430/108.1; 430/108.8; 399/255; 399/259

(58) Field of Search ..... 430/111.35, 111.3, 430/111.1, 108.8, 108.1, 111.31, 111.33; 399/255, 259

(56) References Cited

U.S. PATENT DOCUMENTS 4,284,702 A 8/1981 Tabuchi et al. ..... 430/122
4,578,338 A * 3/1986 Gruber et al. ..... 430/120
4,614,165 A * 9/1986 Folkins et al. ..... 399/257
5,885,740 A * 3/1999 Tokunaga et al. ..... 430/111.31
6,010,811 A * 1/2000 Baba et al. ..... 430/110.4
6,017,667 A * 1/2000 Hakata ..... 430/111.35
6,096,466 A * 8/2000 Imai et al. ..... 430/111.4
6,124,067 A * 9/2000 Mikuriya et al. ..... 430/111.3
6,316,156 B1 11/2001 Takiguchi et al. ..... 430/109.4
6,353,722 B1 * 3/2002 Klimley et al. ..... 399/257
6,372,400 B1 * 4/2002 Yoshizaki et al. ..... 430/111.32
6,418,291 B1 * 7/2002 Sakemi ..... 399/257
6,542,708 B1 * 4/2003 Budny ..... 399/259

FOREIGN PATENT DOCUMENTS

EP 0999478 10/2000
JP 3610231 A * 7/1961
JP 54-66134 5/1979
JP 56-13945 4/1981
JP 56159654 A * 12/1981 ..... G03G/13/09
JP 58-21750 2/1983
JP 59-53856 3/1984
JP 59-61842 4/1984
JP 61-9659 1/1986
JP 3-145678 6/1991
JP 5-21591 3/1993
JP 8-234550 9/1996
JP 11-223960 8/1999

OTHER PUBLICATIONS

Diamond, Arthur S. (editor) Handbook of Imaging Materials. New York: Marcel–Dekker, Inc. (1991) pp. 162–171, 178, 179, 198–203.*

* cited by examiner

*Primary Examiner*—Christopher Rodee
(74) *Attorney, Agent, or Firm*—Fitzpatrick, Cella, Harper & Scinto

(57) ABSTRACT

An electrostatic latent image on an image-bearing member is developed with a two-component developer comprising a toner and a carrier stored in a developer vessel while supplying as required a replenishing developer to the developer vessel. The replenishing developer comprises 1 wt. part of a carrier and 2–50 wt. parts of a toner, wherein the carrier is a magnetic fine particle-dispersed resin carrier comprising at least inorganic compound particles and a carrier binder resin, and the toner has a weight-average particle size of 3 to 10 $\mu$m and contains 1 to 40 wt. % of solid wax.

43 Claims, 5 Drawing Sheets

REPLENISHING DEVELOPER AND DEVELOPING METHOD

FIELD OF THE INVENTION AND RELATED ART

The present invention relates to a developer for replenishment used in electrophotography, electrostatic recording, etc., and a developing method using the developer.

In the developing method practiced at present using a two component-type developer comprising a toner and a carrier, the toner is consumed during the development, and the carrier is not consumed but is caused to remain in a developer vessel. As a result, the carrier is liable to be soiled with toner components transferred to the carrier or to receive a stress in the developer vessel, so that the resin coating layer thereof is peeled off to affect the developer performances, such as the chargeability, thus resulting in a change in image density or occurrence of fog.

In order to solve the problem, Japanese Examined Patent Publication (JP-B) 5-21591 has disclosed a developing apparatus (a so-called "trickle developing apparatus") wherein a carrier is supplied together with a toner compensating for the toner consumed in development, thereby replacing the carrier in the developer vessel little by little to prevent the change in chargeability and stabilize the image density. However, the carrier used therein is an iron powder carrier having a large saturation magnetization, so that the carrier in the developer vessel receives a large stress and is liable to be deteriorated on repetition of image forming cycles. As a result, the image deterioration is liable to be accelerated unless the replenishing carrier amount is increased.

On the other hand, Japanese Laid-Open Patent Application (JP-A) 3-145678 has disclosed a toner containing a carrier having a higher resistivity than the carrier contained in advance in the developer vessel so as to retain the chargeability and suppress the image quality lowering. Further, JP=A 11-223960 has disclosed a toner containing a carrier imparting a higher charge to the toner so as to retain the chargeability and suppress the image quality lowering. However, according to these methods, the amount of exchanged carrier varies depending on the change in toner consumption amount, so that the resistivity or chargeability of the developer in the developer vessel is changed, thus being liable to cause a change in image density.

Further, JP-A 8-234550 has disclosed a method of providing plural types of replenishing toners containing carriers having properties different from that of the carrier contained in advance in the developer vessel and sequentially replenishing the respective toners. As an actual measure, however, it is very difficult to sequentially replenish plural types of toners containing carriers of different properties to a single developer vessel so as to to be free from mutual mixing because of a remarkable difference in specific gravity between the carrier and the toner. Moreover, as a carrier is blended with a larger amount of toner, the carrier is liable to be deteriorated, so that it is difficult to obtain stable images for a long period.

Further, a carrier in a two component-type developer is required of various performances, such as a chargeability (in a sense of charge-imparting ability), a withstanding voltage against the applied voltage, an impact resistance, an anti-spent characteristic and a developing performance, so that study on the carrier per se is being conducted.

Generally, if a carrier having a larger true specific gravity is used, a larger load is applied onto the developer at the time of forming a developer layer in a prescribed thickness by means of a developer layer thickness-regulating member or at the time of stirring the developer in the developer vessel. Accordingly, in the case of using a developer containing a carrier having a large true specific gravity for a long period, there are liable to be encountered difficulties of (a) toner filming, (b) carrier breakage and (c) toner deterioration, thus resulting in developer deterioration and accompanying image quality deterioration of developed images.

The above difficulties (a)–(c) are also liable to be caused in the case of a large carrier particle size also exerting a large load on the developer, whereby the developer is liable to be deteriorated. In this case, the developer is liable to have (d) an inferior thin-line reproducibility.

On the other hand, if the carrier particle size is decreased, (e) carrier attachment onto an electrostatic image-bearing member is liable to occur. Further, in case where the toner particle size is retained at constant and the carrier particle size alone is decreased, (f) the toner is liable to have a broader charge distribution, so that an excessively charged portion of toner is liable to be attached even at non-image part on the image-bearing member to result in "fog" of images particularly in a low-humidity environment.

As a carrier for obviating the above difficulties, a magnetic fine particle-dispersed resin carrier has been proposed. This carrier is free from morphological distortion and can be readily formed in a spherical shape exhibiting a high particle strength and excellent flowability. Further, the particle size can be arbitrarily controlled over a broad range, so that the carrier is suitable for use in a high-speed copying machine or a high-speed laser beam printer, wherein the developing sleeve or the magnet in the sleeve is rotated at a high speed.

Such a magnetic fine particle-dispersed resin carrier is disclosed in JP-A 54-66134 an JP-A 61-9659. Unless a large amount of magnetic material is contained, however, the magnetic fine particle-dispersed resin carrier is liable to have (g) a low saturation magnetization relative to its particle size, so that the carrier attachment onto the electrostatic image-bearing member is liable to occur.

Further, a magnetic fine particle dispersion-type resin carrier containing a large amount of magnetic material is liable to have a weaker impact resistance due to an increased amount of magnetic material relative to the binder resin, the carrier is liable to cause drop-off or isolation of the magnetic material therefrom at the time of forming a developer layer in a prescribed thickness on the developing sleeve by means of a developer layer thickness regulating member, so that the developer is liable to be deteriorated.

Particularly, a magnetic fine particle-dispersed resin carrier containing a large amount of magnetite having, low resistivity, is liable to have a low resistivity, so that (h) image failure is liable to occur due to leakage of a developing bias voltage, and difficulties, such as developer conveyance failure or insufficient mixing with the toner is liable to occur due to a high residual magnetization.

On the other hand, JP-A 58-21750 has disclosed a technique of coating carrier core particles with a resin. Such a resin-coated carrier can be provided with improved anti-spent characteristic, impact resistance, and withstanding voltage against the applied voltage. Further, the toner charging ability can be controlled depending on the chargeability of the coating resin, so that a desired level of charge can be imparted to the toner by selecting a coating resin.

However, the resin-coated carrier is liable to cause an excessive charge (so-called charge-up) of the toner in the case of a high carrier resistivity due to an increase in coating resin amount. Further, in the case of a small coating resin amount, the carrier is caused to have too low a resistivity, thus being liable to result in image failure due to leakage of developing bias voltage. Further, depending on a certain coating resin, even when exhibiting a measured resistivity value which is generally regarded as an appropriate value, such a resin-coated carrier is liable to cause image failure due to leakage of developing bias voltage or excessive charge of the toner in a low-humidity environment.

SUMMARY OF THE INVENTION

A generic object of the present invention is to provide a solution to the above-mentioned problems encountered in a two component-type developer.

A more specific object of the present invention is to provide a replenishing developer allowing stable image formation over a life of a developing apparatus or an image forming apparatus including the developing apparatus.

A further object of the present invention is to provide a replenishing developer containing a wax-containing toner liable to cause carrier deterioration but still allowing stable image formation over a long period.

A still further object of the present invention is to provide a developing method using such a replenishing developer.

As a result of our study for obtaining a replenishing developer capable of exhibiting good performances over an entire life of a developing apparatus or an image forming apparatus, it has been found effective for achieving the above object to use a magnetic fine particle-dispersed resin carrier comprising at least inorganic compound particles and a binder resin in combination with a toner having a weight-average particle size of 3–10 μm and 1–40 wt. % of solid wax.

Thus, according to the present invention, there is provided a replenishing developer, comprising: 1 wt. part of a carrier and 2–50 wt. parts of a toner, wherein the carrier is a magnetic fine particle-dispersed resin carrier comprising at least inorganic compound particles and a carrier binder resin, and the toner has a weight-average particle size of 3 to 10 μm and contains 1 to 40 wt. % of solid wax.

The present invention further provides a developing method, comprising: developing an electrostatic latent image on an image-bearing member with a two-component developer comprising a toner and a carrier stored in a developer vessel, while supplying as required the above-mentioned replenishing developer to the developer vessel.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
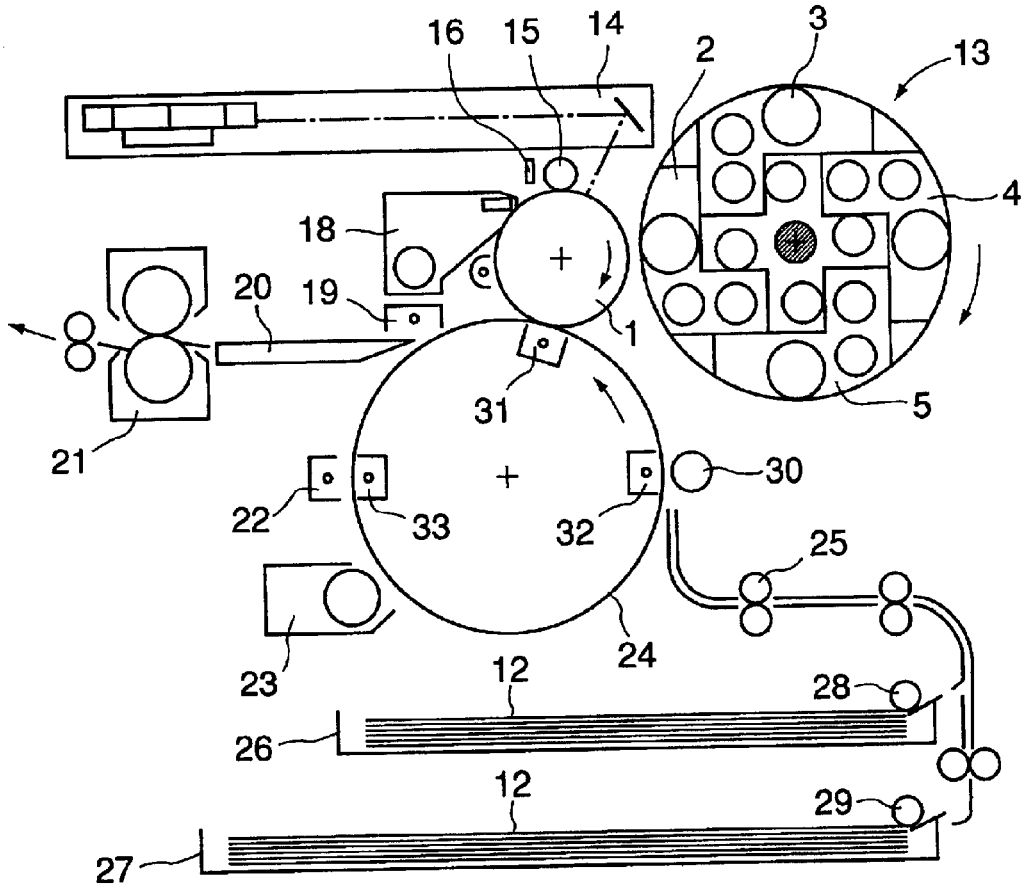
FIG. 1 illustrates an embodiment of image forming apparatus including a rotary developing apparatus wherein a replenishing developer according to the invention is used.

The replenishing developer according to the present invention comprises 1 wt. part of a carrier and 2–50 wt. parts of a toner.

The carrier may preferably have a volume-average particle size (d) of 15–6 μm, more preferably 25–50 μm. Below 15 μm, the carrier is liable to have an inferior flowability, and fine powder thereof is liable to accumulate so that the uniform recovery of the carrier may be difficult in some cases. Above 60 μm, the formation of tight and dense magnetic brush becomes difficult, thus being liable to result in image irregularity.

The volume-average particle size values of carriers described herein are based on values measured by using a laser diffraction-type particle size distribution meter (made by Horiba Seisakusho K.K.).

The carrier may preferably have a volume resistivity (Rv) of $1\times10^{8}$–$1\times10^{16}$ ohm·cm, more preferably $1\times10^{9}$–$1\times10^{15}$ ohm·cm.

Below $1\times10^{8}$ ohm·cm, the carrier and the toner in the replenishing developer are liable to be separated from each other, thus making difficult the replenishment at an accurate rate.

Above $1\times10^{16}$ ohm·cm, the resultant images are liable to have too large an edge contrast, and the carrier surface charge is difficult to be leaked, so that the resultant images are liable to have a lower image density due to an excessive charge of toner and be accompanied with fog and scattering due to non-uniform triboelectrification between the carrier and toner newly supplied. Further, the carrier is liable to be excessively charged by friction with other members, such as an inner wall of a replenishing developer container, so that the triboelectrification of the toner is liable to be non-uniform. Further, images defects are liable to be caused also due to electrostatic attachment of external additives.

The carrier volume resistivities described herein are based on values measured by using an insulating resistance meter for powder (made by Shinku Riko K.K.). For the measurement, a sample carrier was left to stand for at least 24 hours in an environment of 23° C./60% RH and placed in a cylindrical measurement cell having a diameter of 20 mm (0.283 $cm^2$) and sandwiched in a thickness of 2 mm between electrodes under a load of 11.8 kPa (120 $g/cm^2$) and an application voltage of 500 volts.

The carrier may have a true specific gravity ($SG_t$) of 2.5–4.5, preferably 2.8–4.2. Above 4.5, a stable carrier recovery becomes difficult due to an increased specific gravity difference with the toner, thus requiring a complicated apparatus. Further, particularly in a replenishing developer, a large stress is applied to the carrier, so that the carrier is liable to be deteriorated to result in image deterioration unless the carrier concentration is increased. Below 2.5, the carrier attachment is liable to occur while it also depends on the magnetic properties of the carrier.

Further, the developer bulk volume is liable to vary remarkably, and in the case of a developer replenishing system, a stable recovery becomes difficult; and a balance between the replenished carrier and the recovered carrier is liable to be impaired to result in a remarkable image density charge in the case of repetitive formation of different image areas.

The carrier specific gravity values described herein are based on values measured by using a multi-volume densitometer (made by Micromeritics Co.).

As for the magnetic properties, the carrier may preferably have a low magnetic susceptibility as represented by a magnetization as measured at a magnetic field of 1000/4π kA/m (=1000 oersted) of 15–65 $Am^2/kg$, more preferably 25–45 $Am^2/kg$. Above 65 $Am^2/kg$, a large stress is applied to the carrier in the developer vessel to accelerate the carrier deterioration while depending on the carrier particle size, thus being liable to result in developer deterioration particularly in continuous copying or printing on a large number of sheets, unless the carrier concentration in the replenishing developer is increased.

The carrier may preferably have a residual magnetization ($\sigma_r$) of 0.1–20 $Am^2/kg$, more preferably 2.9–6.9 $Am^2/kg$. Above 20 $Am^2/kg$, the carrier is caused to have a lower flowability due to magnetic agglomeration, thus causing inferior mixability with the toner and being liable to cause image defects, such a fog.

Further, if the magnetization is below 15 $Am^2/kg$, or the residual magnetization is below 0.1 $Am^2/kg$, carrier attachment is liable to occur because of a lower carrier magnetic force even if a fine powder fraction is removed, and the toner-conveying performance is lowered unless the replenishing carrier amount is increased.

It is further preferred that the carrier has a residual magnetization ($\sigma_r$) and a volume-average particle size (d) satisfying a relationship of $1.0 \leqq d/\sigma_r < 30.0$ (in the unit of $\mu m \cdot kg/Am^2$), more preferably $1.5 \leqq d/\sigma_r < 20.0$, further preferably $1.5 \leqq d/\sigma_r < 15.0$, partocilarly preferably $5.1 \leqq d/\sigma_r \leqq 12.3$. If the ratio $d/\sigma_r$ is 30 or higher, the two-component developer is liable to have an excessive flowability and be separated into the toner and the carrier during a long term of standing, thus causing fog and scattering. On the other hand, if the ratio $d/\sigma_r$ is below 1.0, the two-component developer is liable to have a lower flowability to result in an inferior chargeability of the toner.

The magnetic properties of a carrier may be measured by using an oscillating magnetic field-type magnetic property auto-recording apparatus ("BHV-35", made by Riken Denshi K.K.), an oscillating sample-type magnetometer ("VSM-3S-15", made by Toei Kogyo K.K.), etc. In Examples described hereinafter, the measurement was performed by using the former apparatus ("BHV-35"). For the measurement, a sample carrier powder was sufficiently tightly packed in a cylindrical plastic vessel so as not to be moved and placed in an external magnetic field of 1000/4π (kA/m) to measure a magnetic moment, which was divided by the sample weight to obtain a magnetization ($Am^2/kg$).

Magnetic particles used as inorganic compound particles for providing a carrier (core) in the present invention, may comprise magnetite or ferrite having magnetism as represented by the following formula (1) or (2):

$$MO.Fe_2O_3 \quad (1)$$

$$M.Fe_2O_4 \quad (2),$$

wherein M represents a trivalent, divalent or monovalent metal ion.

Examples of M may include: Mg, Al, Si, Ca, Sc, Ti, V, Cr, Mn, Fe, Co, Ni, Cu, Zn, Sr, Y, Zr, Nb, Mo, Cd, Sn, Ba, Pb and Li. These may be used singly or in combination of plural species.

Specific examples of magnetic inorganic compounds may include: iron-containing oxides, such as magnetite, Zn—Fe ferrite, Mn—Zn—Fe ferrite, Ni—Zn—Fe ferrite, Mn—Mg—Fe ferrite, Ca—Mn—Fe ferrite, Ca—Mg—Fe ferrite, Li—Fe ferrite and Cu—Zn—Fe ferrite.

The inorganic compound particles constituting the carrier (core) of the present invention can also be a mixture of the above-mentioned magnetic particles and particles of a non-magnetic metal compound as shown below.

Thus, examples of such a non-magnetic metal compound may include: $Al_2O_3$, $SiO_2$, CaO, $TiO_2$, $V_2O_5$, CrO, $MnO_2$, $\alpha$-$Fe_2O_3$, CoO, NiO, CuO, ZnO, SrO, $Y_2O_3$ and $ZrO_2$. Two or more species of the non-magnetic metal compound can be used in combination.

In the case of using a magnetic metal compound and a (non-)magnetic metal compound in combination, it is preferred to use two or more species of particles having similar specific gravities and similar particle shapes in order to have a good adhesion with the binder resin and enhance the strength of carrier (core) particles.

Specific examples of the preferred combination may include: magnetite and hematite, magnetite and $\gamma$-$Fe_2O_3$, magnetite and $SiO_2$, magnetite and $Al_2O_3$, magnetite and Ca—Mn—Fe ferrite, and magnetite and Ca—Mg—Fe ferrite. Among these, the combination of magnetite and hematite is particularly preferred.

As the inorganic compound particles having magnetism (i.e., magnetic particles), it is preferred to use magnetic particles containing one or more additive elements selected from magnesium, silicon, manganese and phosphorus inside thereof. By controlling the amount of such additive elements, it becomes possible to provide a carrier having good balance in various properties, such as residual magnetization and flowability without lowering the electrical resistivity and saturation magnetization.

It is particularly preferred to use magnetite particles containing at least one species of magnesium, silicon, manganese and phosphorus in a total amount of 0.03–5.0 wt. % as the element(s).

Below 0.03 wt. %, the carrier is liable to have a large residual magnetization, thus causing inferior flowability due to magnetic agglomeration in some cases. Above 5 wt. %, sufficient improvement in electrical resistivity, residual magnetization and flowability can be attained, whereas the carrier is liable to have inferior environmental characteristics, particularly high moisture absorptivity, and have inferior filterability in production thereof, thus being undesirable from a viewpoint of commercial production.

These additive elements of magnesium, silicon, manganese and phosphorus may preferably be present both at the surface and inside the magnetite particles.

In case where the additive element is not exposed to the surface even though it is contained inside the magnetite particles, the magnetite particles are liable to have a lower electrical resistivity and inferior flowability. Further, in case where the additive element is present only at the surface, the magnetite particles are liable to have inferior residual magnetization.

It is further preferred to contain at least two of magnesium, silicon, manganese and phosphorus in order to synergistically improve various properties inclusive of residual magnetization and flowability in good balance without lowering the electrical resistivity and saturation magnetic flux density, than in the case of containing only one species of such additive element. In the case of containing at least two of magnesium, silicon, manganese and phosphorus, it is particularly preferred to contain at least magnesium in order to improve the properties in good balance.

Magnesium, and the other of silicon, manganese and/or phosphorus in total, may preferably be contained in a proportion of 1:9 to 9:1, so as to synergistically improve various properties in good balance, while the addition outside the above range can still improve the properties.

It is further preferred that the additive elements of magnesium, silicon, manganese and phosphorum are added prior to the formation of magnetite crystal. Magnetite particles containing such an additive element may have a residual magnetization which is lower by 10–50% than a residual magnetization exceeding 7.5 $Am^2/kg$ of magnetite particles containing none of such additive elements. The reason for this has not been clarified as yet, but we consider that such an additive element suppress the agglomeration or cohesion of magnetite particles and exerts some effect on the crystal growth of magnetite particles.

It is further preferred that the magnetic particles contain at least one species of metal element selected from zinc (Zn), copper (Cu), nickel (Ni), cobalt (Co), aluminum (Al), tin (Sn), titanium (Ti) and zirconium (Zr) in a total amount of 0.01–3.0 wt. % based on Fe; and the metal element and the additive element of magnesium (Mg), silicon (Si), manganese (Mn) and/or phosphorus (P) are surface-exposed in a total amount of 0.01–1.5 wt. %, more preferably 0.01–0.5 wt. %, as elements. It is also preferred that the metal element of Zn, Cu, Ni, Co, Al, Sn, Ti and Zr is present at a concentration which is higher at the outer shell portion (including the surface) than the inner core portion. These features are preferred so as to synergistically improve various properties in good balance without lowering the electrical resistivity and saturation magnetization. Particularly, the addition of such a metal element remarkably improves the flowability of magnetite particles and make easier the uniform dispersion of magnetite in carrier (core) particles, thereby reducing a fluctuation in electrical resistivity, saturation magnetization, residual magnetization, etc. among the individual carrier particles, so that the carrier attachment onto the latent image-bearing member is suppressed and the toner shape distribution becomes sharp, to provide high-density and high-definition images for a long period. The addition of such a metal element is, however, not essential in the present invention.

In case where the above-mentioned metal element and the additive element are not present at the surface including an outer shell portion even if they are present at the inner core portion of the magnetite particles, i.e., in case where the surface-exposed content is below 0.01 wt. %, the effects of improving the electrical resistivity, residual magnetization and flowability are liable to be small. On the other hand, if the surface-exposed content exceeds 1.5 wt. %, good properties can be attained but the exposed elements cannot be fully carried by the magnetite particle surface, thus being liable to result in localization or isolation of the respective associate compounds.

The surface-exposed element content referred to herein is based on values measured in the following manner. Sample magnetite particles are weighed in 0.900 g, and 25 ml of 1 mol/l-NaOH is added thereto. The metal and additive elements are dissolved from the surface of the particles at an elevated temperature of 45° C. under stirring. The insoluble matter is filtered out and the filtrate liquid is diluted with pure water up to a total amount of 125 ml. The concentration (g/l) of each element (metal or additive) in the liquid is measured by ICP (inductively coupled plasma) emission spectroscopy, and the surface-exposed content of each element is calculated according to the following formula:

$$\text{surface-exposed content (wt. \%)} = \{(\text{concentration of each element in the liquid (g/ml)} \times 125(\text{ml})/1000(\text{ml}))/0.900(\text{g})\} \times 100$$

The total of the thus-determined surface-exposed contents of the respective elements provides the above-mentioned surface-exposed element content of the metal and additive elements.

Incidentally, the total content of each of the metal and additive elements in the magnetite particles can be measured by dissolving sample magnetic particles in a hydrochloric-hydrofluoric mixture acid solution and subjecting the resultant solution to the ICP emission spectroscopy.

The preferential presence of the metal element at the surface and outer shell portion may be achieved as a continuous change or a stepwise change or by controlling the pH in known manners and need not be specifically limited.

By having the additive element and metal element in appropriate amounts, it becomes possible to obtain a good balance of various properties inclusive of residual magnetization and flowability. By controlling the above elements, it is preferred to provide a flowability A in a magnetized state and a flowability B in a demagnetized state satisfying $B/A \leqq 1.5$, more preferably $B/A \leqq 1.2$, further preferably $B/A \leqq 1.1$.

If $B/A > 1.5$, the resultant two-component developer is liable to cause insufficient flowability in the developer vessel or on the developing sleeve due to magnetic agglomeration of the carrier, so that the uniform developer layer formation on the developing sleeve becomes difficult to result in poor image quality or a broad toner charge distribution leading to fog or toner scattering. As a result, it becomes difficult to obtain high-quality images for a long period.

Herein, the flowability A of a carrier refers to a flowability of the carrier after magnetization under a magnetic field of $1000/4\pi$ kA/m (1000 oersted), and the flowability B refers to a flowability of the carrier after demagnetization by packing the carrier so as not to move in a 15 ml-sample bottle and subjecting the carrier to AC-demagnetization by a magnetic eraser ("SR-L2520D", made by Nippon Denji Sokki K.K.).

The flowability values (A or B) of (magnetized or demagnetized) carriers described herein are based on values measured according to the following method.

(Carrier Flowability)

An objective carrier (already magnetized or demagnetized in an environment of 23° C./60% RH) in an amount of 200 g is placed in a thermostat vessel for moisture conditioning for 24 hours in 23° C./60% RH. The thus moisture-conditioned carrier is divided into three portions, from each of which 50±0.1 g of sample carrier is weighed and placed on a funnel having an orifice (outlet diameter=4 mm) at its bottom after plugging the bottom. Then, the bottom plug is removed while starting a stopwatch, and the watch is then stopped when the final portion of the sample carrier leaves the orifice. The flowing time is measured at an increment of 0.2 sec, and an reciprocal of the measured flowing time is taken as a flowability. The measurement is repeated once for each of the three divisions of the objective carrier, and an average of three measured flowability values is taken as a flowability A or B.

In case of a carrier in a given two-component developer, the developer is subjected to recovery of the carrier in the following manner, and the recovered carrier is subjected to measurement of flowabilities A and B after magnetization and demagnetization in the above-mentioned manner.

A two-component developer is charged in water containing a surfactant in a vessel. Then, a magnet is attached to an outer wall of the vessel for attracting the carrier via the wall, and the toner is removed together with water by decantation while continually attracting the carrier. The recovered carrier is washed several times with water and then dried and subjected to moisture conditioning for 24 hours in a thermostat vessel in an environment of 23° C./60%.

Magnetite particles containing the additive element (Mg, Si, Mn or P) may be produced through a process as. described below.

Into a solution containing a ferrous salt as a principal component, a source compound of an additive element (Mg, Si, Mn or P) is added. As the ferrous salt, ferrous surface is preferred. As for the additive element-source compound, the Mg-source compound may preferably be a water-soluble magnesium compound, such as magnesium sulfate, magnesium chloride, or magnesium nitrate. The Si-source may preferably be an aqueous solution containing siliceous colloid prepared from water glass, sodium silicate or potassium silicate. The Mg-source compound may preferably be a water-soluble manganese compound, such as manganese sulfate, manganese chloride or manganese nitrate. The P-source compound may preferably be a phosphoric acid salt, such as sodium hexametaphosphate or ammonium primary phosphate, ortho-phosphoric acid, or phosphorus acid.

Further, an alkali in an amount of 1.0–1.1 equivalent to the iron in the solution is added to the solution.

Into the mixture liquid, an oxygen-containing gas, preferably air, is blown to effect oxidation at a temperature of 60–100° C., preferably 80–90° C., thereby forming seed crystals. The degree of the oxidation reaction is controlled by analyzing the yet-unreacted ferrous hydroxide and adjusting the introduction rate of the oxygen-containing gas during the reaction. It is important to maintain the pH during the oxidation at 7–10, preferably 7–9.

In the course of the oxidation, at a point when the seed crystal produced has reached an amount corresponding to 1–30%, preferably 5–25%, of the total iron oxide, an iron source compound in an amount of 0.9–1.2 equivalent, preferably 1.05–1.15 equivalent, of the originally added alkali, is added. The iron source compound is preferably a ferrous salt, such as ferrous sulfate, and may be added in a form of an aqueous solution.

Further, the oxidation reaction is continued under similar conditions while maintaining the pH at 6 10, preferably 6–9, to produce particles, which are then subjected to ordinary post-treatments of washing, filtration, drying and pulverization, to recover magnetite particles.

As described above, it is preferred to adjust the pH to 6–10 during the oxidation. This is because at a higher pH than the neutrality region during the oxidation, the additive element (Mg, Si, Mn, P) is liable to be taken at the core portion of the magnetite particles, and at a pH lower than the neutrality region, the additive element is preferentially precipitated at the surface without being readily incorporated inside the particles. Thus, by controlling the pH in the above-mentioned range, the state of presence of the additive element can be controlled.

As a result of our observation of particle shapes during the oxidation, seed crystals formed in the first reaction are indefinitely shaped but are formed in a narrow particle size distribution. Then, in a later reaction at a neutral or weakly alkaline region (pH 6–10), the particles are gradually grown into a pseudo-spherical shape.

Further, in the case of incorporating at least one metal element (selected from Zn, Cu, Ni, Co, Al, Sn, Ti, Zr) into magnetite, the oxidation reaction is continued under similar conditions as above, and in the course of particle growth, i.e., in a period of from a later addition of an iron-source compound until the completion of the reaction, an aqueous liquid containing the metal element-source compound is added to the reaction system. The metal-source compound may be dissolved or in the form of a hydroxide in the liquid. In the case of two or more metal-source compounds, the compounds can be added separately or simultaneously.

In the case of using magnetic particles alone or in mixture with the non-magnetic metal compound particles, the magnetic particles may preferably have a number-average particle size of 0.02–2 μm, more preferably 0.05–1 μm, while it can vary depending on the average particle size of the carrier (core) particles.

Below 0.02 μm, it is difficult to incorporate a large amount of magnetic particles, thus being liable to fail in providing desirable magnetic properties. Above 2 μm, the dispersion of the magnetic particles is liable to be non-uniform, thus failing to provide a carrier having a desirable particle size showing a high mechanical strength.

In the case of using the magnetic particles and the non-magnetic particles in mixture, the non-magnetic particles may preferably have a number-average particle size of 0.05–5 μm, more preferably 0.1–3 μm, which is larger than that of the magnetic particles so as to provide a carrier having a desirable resistivity.

The number-average particle sizes of inorganic compound particles (magnetic or nonmagnetic) described herein are based on values measured as follows. Sample particles are photographed through a transmission electron microscope ("H-800", made by Hitachi Seisakusho K.K.) to obtain enlarged pictures at a magnification of 5,000–20,000 (a magnification of 20,000 in Examples described hereinafter). On the pictures, at least 300 particles having particle sizes of at least 0.01 μm are selected at random, and horizontal direction-FERE diameters of the particles were measured and averaged by an image processing analyzer ("Luzex 3", made by Nireco K.K.) to obtain a number-average particle size.

The carrier (core) of the present invention may preferably contain the inorganic compound particles in a proportion of 80–99 wt. %.

Below 80 wt. %, the charging performance of the carrier is liable to be unstable. Particularly, in a low-temperature/low-humidity environment, the carrier is charged and the charge is liable to remain, so that the fine powdery toner fraction and external additives are liable to be attached to the carrier particles. Also, the carrier can fail to have an appropriate specific gravity. If the inorganic compound particle content exceeds 99 wt. % of the carrier (core), the carrier is liable to have a lower strength and cause a problem, such as breakage during a continual use.

In the preferred embodiment of using both the magnetic and non-magnetic particles, the magnetic particles may preferably occupy 50–95 wt. %, more preferably 60–95 wt. % of the total inorganic compound particles.

The binder resin of the carrier (core) particles used in the present invention may preferably comprise a thermosetting resin which has been partially or wholly crosslinked. As a result, the inorganic compound particles are securely bound to provide a high carrier (core) strength, whereby the inorganic compound particles become less liable to be liberated therefrom and can be provided with a better resin coating layer thereon, when desired.

The magnetic fine particle-dispersed resin carrier (core) may preferably be obtained through the following method, while it is not necessary. More specifically, it is preferred to adopt a process wherein the carrier (core) particles are produced from a mixture of a monomer and a solvent or dispersion medium together with inorganic compound particles dispersed therein through polymerization of the monomer. It is particularly preferred to lipophilize the inorganic compound particles in advance of inclusion into the mixture so as to provide a magnetic fine particle-dispersed resin carrier (core) having a narrow particle size distribution and containing little fine powder.

Examples of the monomer for providing the binder resin of the carrier (core) particles may comprise a monomer capable of radical polymerization. Examples thereof may include: styrene; styrene derivatives, such as o-methylstyrene, m-methylstyrene, p-methoxystyrene, p-ethylstyrene, and p-t-butylstyrene; acrylic acid, and acrylate esters, such as methyl acrylate, ethyl acrylate, n-butyl acrylate, n-propyl acrylate, isobutyl acrylate, octyl acrylate, dodecyl acrylate, 2-ethyhexyl acrylate, stearyl acrylate, 2-chloroethyl acrylate and phenylacrylate; methacrylic acid, and methacrylate esters, such as methyl methacrylate, ethyl methacrylate, n-propyl methacrylate, n-butyl methacrylate isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminoethyl methacrylate and benzyl methacrylate; 2-hydroxyethyl acrylate, 2-hydroxyethyl methacrylate; acrylonitrile methacrylo-nitril, acrylamide; vinyl ethers, such as methyl vinyl ether, ethyl vinyl ether, propyl vinyl ether, n-butyl ether, isobutyl ether, β-chloroethyl vinyl ether, phenyl vinyl ether, p-methylphenyl vinyl ether, p-chlorophenyl vinyl ether, p-bromophenyl vinyl ether, p-nitrophenyl vinyl ether and p-methoxyphenyl vinyl ether; and diene compounds, such as butadiene. These monomers may be used singly or in mixture so as to select a polymer composition providing preferable properties.

The most preferred species of binder resin may comprise phenolic resin. Starting materials therefor may include: phenol compounds, such as phenol, m-cresol, 3,5-xylenol, p-alkylphenol, resorcin, and p-tert-butylphenol; and aldehyde compounds, such as formalin, paraform-aldehyde, and furfural. A combination of phenol and formalin is particularly preferred.

In producing such a phenolic resin, it is possible to use a basic catalyst as a hardening catalyst. Various basic catalysts generally used for resol resins may be used. Specific examples thereof may include: ammonia water, and amines, such as hexamethylenetetramine, diethyltriamine and polyethyleneimine.

In the present invention, the (magnetic or non-magnetic) inorganic compound particles contained in the carrier (core) may preferably have been subjected to a lipophilizing treatment so as to provide carrier particles having a narrow particle size distribution and prevent the liberation of the inorganic compound particles. In the case of forming carrier (core) particles containing lipophilized inorganic compound particles, the carrier (core) particles are generated by insolubilization from a liquid mixture of monomer and solvent or dispersion medium with the inorganic compound particles as the polymerization proceeds. The lipophilization is believed to promote the taking-in uniformly and at a high density of the inorganic compound particles in the carrier (core) particles and prevent the agglomeration of the carrier (core) particles to provide a narrow particle size distribution. Further, in the case of using lipophilized inorganic compound particles, it becomes unnecessary to use a suspension stabilizer, so that it is possible to obviate the difficulties arising from the use of a suspension stabilizer, such as charging obstruction due to the remaining of a suspension stabilizer on the carrier surface, non-uniformity of coating resin at the time of coating thereon, and reaction inhibition in the case of coating with a reactive resin, such as silicone resin. Further, even when such a suspension stabilizer is used, the lipophilization functions to reduce the amount of the suspension stabilizer remaining at the surface and difficulties caused thereby.

The lipophilization of the inorganic compound particles may preferably be performed by treatment with a lipophilizing agent comprising an organic compound having at least one functional group selected from epoxy group, amino group and mercapto group, and a mixture of one or more species of such organic compounds. In order to provide a carrier showing stable charge-imparting ability, it is preferred to use an organic compound having an epoxy group.

It is preferred that 100 wt. parts of the inorganic compound particles have been treated with 0.1–10 wt. parts, more preferably 0.2–6 wt. parts of a lipophilizing agent in order to provide enhanced lipophilicity and hydrophobicity.

Examples of the lipophilizing agent having an epoxy group may include: γ-glycidoxypropylmethyldiethoxysilane, γ-glycidoxypropyltrimethoxysilane, π-(3,4-epoxycyclohexyl)trimethoxysilane, epichlorohydrin, glycidol and styrene-glycidyl (meth)acrylate copolymer.

Examples of the amino group-containing lipophilizing agent may include: γ-aminopropyltrimethoxysilane, γ-aminopropylmethoxydiethoxysilane, γ-aminopropyltriethoxyslane, N-β(aminoethyl)-γ-aminopropyltrimethoxysilane, N-β(aminoethyl)-γ-aminopropylmethyldimethoxysilane, N-phenyl-γ-aminopropyltrimethoxysilane, ethylenediamine, ethylenetriamine, styrene-dimethylaminoethyl (meth) acrylate copolymer, and isopropyltri(N-aminoethyl)titanate.

Examples of the mercapto group-containing lipophilizing agent may include: mercaptoethanol, mercaptopropionic acid, and γ-mercaptopropyltrimethoxysilane.

The carrier core-coating resin need not be particularly restricted. Specific examples thereof may include: polystyrene, acrylic resin such as styrene-acrylic copolymer, vinyl chloride resin, vinyl acetate resin, vinylidene fluoride resin, fluorocarbon resin, perfluorocarbon resin, solvent-soluble fluorocarbon resin, polyvinyl alcohol, polyvinyl acetal, polyvinylpyrrolidone, petroleum resin, cellulose, cellulose derivatives, novolak resin, low molecular weight polyethylene, saturated alkylpolyester resin, aromatic polyester resin, polyamide resin, polyacetal resin, polycarbonate resin, polyether-sulfone resin, polysulfone resin, polyphenylene sulfide resin, polyetherketone resin, phenolic resin, modified phenolic resin, maleic acid resin, alkyl resin, epoxy resin, acrylic resin, unsaturated polyester formed by polycondensation of maleic anhydride, terephthalic acid and polyhydric alcohol, urea resin, meramine resin, urea-melamine resin, xylene resin, toluene resin, guanamine resin, melamine-guanamine resin, aceto-guanamine resin, glyptal resin, furan resin, silicone resin, polyimide resin, polyamideimide resin, polyetherimide resin, and polyurethane resin.

Among the above, it is preferred to use a fluorine-containing resin, such as polyvinylidene fluoride resin, fluorocarbon resin, perfluorocarbon resin or solvent-soluble perfluorocarbon resin, or silicone resin, in view of a high releasability.

In the present invention, silicone resin is particularly preferably used in view of good adhesion with the core, prevention of spent toner accumulation, and film strength. Silicone resin can be used singly but may preferably be used in combination with a coupling agent. Such a coupling agent may preferably be applied onto the carrier core in advance of resin coating, i.e., as a primer, whereby the resin coating layer can be formed at a better adhesion state accompanied with a covalent bond.

As the coupling agent, it is preferred to use an aminosilane. As a result, an amino group exhibiting a positive chargeability can be introduced to the carrier surface, thereby providing a negative chargeability to the toner. Further, the presence of an amino group activates both the lipophilizing agent preferably used to treat the inorganic compound particles and the silicone resin, thereby enhancing the adhesion of the silicone resin onto the carrier core and also promoting the curing of the resin to provide a tougher coating layer.

The carrier core-coating resin may preferably be used in an amount of 0.1–3.0 wt. parts, more preferably 0.1–2.0 wt. parts, per 100 wt. parts of the carrier core so as to exhibit the above-mentioned properties.

The carrier may be formed into a shape selected suitable for a desired image forming system.

It is however preferred that the carrier particles are formed to have a sphericity (or shape factor) SF-1 of 100–130, more preferably 100–120. Above 130, the flowability of the carrier in the developer becomes inferior to result in a lower toner triboelectrification effect and a difficulty in providing high-quality images because of non-uniform magnetic brush at the developing pole.

The carrier sphericity values described herein are based on values measured by using a field emission scanning electron microscope ("S-800", made by Hitachi Seisakusho K.K.) for taking pictures of at least 300 carrier particles selected at random, and image-analyzing the particles by an image processing analyzer ("Luzex 3", made by Nireco K.K.) to obtain an average of sphericity values defined according to the following formula:

$$\text{Sphericity } SF\text{-}1=[(MXLNG)^2/(AREA)]\times(\pi/4)\times 100,$$

wherein MXLNG denotes a maximum diameter of each carrier particle, and AREA denotes a projection area of the carrier particles.

A sphericity close to 100 represents a shape close to a sphere.

The replenishing developer of the present invention is characterized as a mixture of 1 wt. part of the above-mentioned carrier and 2–50 wt. parts of a toner as described hereinafter. If the toner is above 50 wt. parts, the developer is liable to cause fog or toner scattering in a continuous image formation even if the magnetic fine particle-dispersed resin carrier of the present invention is used, thus requiring an exchange of developer by a professional service engineer not a regular developer replenishment. On the other hand, below 2 wt. parts, the developer life is increased but the developer weight is increased due to a larger proportion of the carrier, so that the dischargeability of the developer from a replenishing developer vessel to the developer vessel of the developing apparatus becomes difficult, and the means for recovering the deteriorated developer after use becomes complicated. Further, as the effective amount of toner in the replenishing developer vessel is reduced to increase the frequency of the developer replenishment, the load on the user is increased including an increase in running cost.

The toner constituting the replenishing developer of the present invention in combination with the above-mentioned carrier, comprises a toner binder resin and a colorant, and may preferably have a weight-average particle size of 3–10 $\mu$m, more preferably 3–8 $\mu$m., Below 3 $\mu$m, the toner is liable to be excessively charged in a low humidity environment, thus failing to sufficiently achieve the effects associated with the use of the carrier of the present invention. The powder processability of the toner per se is lowered. Above 10 $\mu$m, the toner is liable to cause scattering and fog, particularly in a high temperature/high humidity environment, thus failing to sufficiently achieve the effects of using the carrier of the present invention. Further, as an individual toner particle size is increased, it becomes difficult to obtain dense images having a high resolution. Further, toner scattering is liable to occur in electrostatic transfer.

The average particle size and particle size distribution of toners described herein are based on values measured in the following manner.

Into 100–150 ml of electrolyte solution, 0.1 to 5 ml of a surfactant (e.g., an alkylbenzenesulfonic acid salt) is added, and 2–20 mg of a sample toner is further added thereto. The resultant toner dispersion liquid is subjected to measurement of particle size distribution on a number basis and a volume-basis in a particle size range of 0.3–40 $\mu$m by using a Coulter counter ("Coulter Multisizer", made by Coulter Electronics, Inc.) equipped with a 100 $\mu$m-aperture. From the particle size distributions, a number-average particle size (D1) and a weight-average particle size (D4) may be calculated by computer processing. Further, it is possible to obtain a proportion of particles having particle sizes of at most a half of the number-average particle size from the number-basis particle size distribution, and also a proportion of particles having particle sizes of at least twice the weight-average particle size from the volume-basis distribution.

It is further preferred that the toner has an average circularity (Ca) of at least 0.960.

A toner having an average circularity below 0.960 is liable to cause a large change in developer flowability. As a result, not only the carrier recovery is liable to become unstable but also the chargeability change is liable to occur during a long-term continuous image formation. A toner having an average circularity within the range exhibits a high efficiency of transfer onto paper, and can provide an identical image density at a smaller amount of toner on the image-bearing member, thus being advantageous in running cost. Further, as the toner can easily rotate in contact with the carrier and stably provide a high packing density of developer, so that it exhibits a high opportunity of contact with the carrier and can always retain a stable charge. Further, as the developer density change is minimized, the carrier recovery can also be performed stably.

The average circularity is used herein as a quantitative measure for evaluating particle shapes and based on values measured by using a flow-type particle image analyzer ("FPIA-1000", mfd. by Toa Iyou Denshi K.K.). A circularity (Ci) of each individual particle (having a circle equivalent diameter ($D_{CE}$) of at least 3 $\mu$m) is determined according to an equation (3) below, and the circularity values (Ci) are totaled and divided by the number of total particles (m) to determine an average circularity (Ca) as shown in an equation (4) below:

$$\text{Circularity } Ci=L_0/L, \tag{3}$$

wherein L denotes a circumferential length of a particle projection image, and $L_0$ denotes a circumferential length of a circle having an area identical to that of the particle projection image.

$$\text{Average circularity } (Ca) = \sum_{i=1}^{m} Ci/m \tag{4}$$

Incidentally, for actual calculation of an average circularity (Ca), the measured circularity values (Ci) of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (Ca) is substantially identical to an average circularity value obtained (according to Equation (4) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (Ca) and mode circularity (Cm) with respect to particles having $D_{CE} \geqq 3.0$ $\mu$m.

The average circularity (Ca) used herein is a measure of roundness, a circularity of 1.00 means that the magnetic toner particles have a shape of a perfect sphere, and a lower circularity represents a complex particle shape of the magnetic toner.

The binder resin for the toner used in the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-$\alpha$-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins. A crosslinked styrene resin is also a preferable binder resin.

A styrene copolymer may be formed through copolymerization of styrene monomer and a comonomer. Examples of the copolymer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; decarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The toner used in the present invention may preferably contain a THF-soluble portion of the binder resin exhibiting a number-average molecular weight (Mn) of $3\times10^3$–$10^6$, more preferably $6\times10^3$–$2\times10^5$.

The above-mentioned values of number-average molecular weight of THF-soluble content of a toner is based on values measured in the following manner.

A sample toner is subjected to 20 hours of extraction with solvent toluene by using a Soxhlet's extractor, and the solvent toluene is distilled off from the resultant extract liquid to recover an extract resin, which is then dissolved in THF to form a THF-solution. The solution is then filtrated through a solvent-resistant membrane filter, and the filtrate liquid is supplied to a gel permeation chromatograph ("150C", made by Waters Co.) equipped with a series of columns, A-801, 802, 83, 804, 805, 806 and 807 (all available from Showa Denko K.K.) to obtain a molecular weight distribution (GPC chromatogram) based on a calibration curve prepared in advance by using standard polystyrene samples. From the obtained GPC chromatogram, a number-average molecular weight (Mn) or a weight-average molecular weight (Mw) can be calculated.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

Such a crosslinking agent may preferably be added in 0.001–10 wt. parts per 100 wt. parts of the polymerizate monomer.

The toner can contain a charge control agent.

As a negative charge control agent, an organic metal compound or chelate compound may effectively be used for example. Preferred examples may include: monoazo metal compounds, acetylacetone metal compounds, and metal compounds of aromatic hydroxycarboxylic acids and aromatic dicarboxylic acids. Other examples may include: aromatic hydroxycarboxylic acids, aromatic mono- and polycarboxylic acids, and metal salts, esters, and phenol derivatives with bisphenols, etc., of these acids; urea derivatives, meta-containing salicylic acid compounds; metal-containing naphthoic acid compounds; boron compound; quaternary ammonium salts: calixarenes; silicon compounds; styrene-acrylic acid copolymer; styrene-methacrylic acid copolymer; styrene-acryl-sulfonic acid copolymer; and non-metal carboxylic acid compounds.

On the other hand, examples of the positive charge control agents may include: nigrosine compounds inclusive of nigrosine and modified products thereof; guanidine compounds, imidazole compounds; onium salts inclusive of quaternary ammonium salts, such as tributylbenzylammonium 1-hydroxy-4-naphtholsulfonate and tetrabutylammonium tetrafluoroborate, and their homologues inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate. These may be used singly or in mixture of two or more species. Among the above, it is preferred to use a nigrosine compound or a quaternary ammonium salt.

Such a charge control agent may be used in 0.01–20 wt. parts, preferably 0.1–10 wt. parts, more preferably 0.2–4 wt. parts, per 100 wt. parts of the toner binder resin.

The colorant used in the present invention may include a black colorant, yellow colorant, a magenta colorant and a cyan colorant. As a black colorant, it is possible to use a magnetic material.

Examples of non-magnetic black colorant may include: carbon black, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180. It is also possible to use a dye, such as C.I. Solvent Yellow 93 or 162, in combination therewith.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, transparency of the resultant OHP film, and a dispersibility in toner particles. The above colorants may preferably be used in a preparation of 1–20 wt. parts per 100 wt. parts of the binder resin.

It is suitable for the toner particles to contain 1–40 wt. %, preferably 2–30 wt. %, of solid wax. If the wax content is below 1 wt. %, the offset-suppression effect is insufficient. Above 40 wt. %, the wax is locally exposed up to the toner particle surface, and the carrier is liable to be soiled therewith, so that the carrier amount has to be increased in order to obviate an image density change. Further, the carrier flowability is changed to cause a large density change of the developer and the carrier recovery is liable to be unstable.

A preferable class of wax may have a ratio (Mw/Mn) between weight-average molecular weight (Mw) and number-average molecular weight (Mn) of at most 1.45 and a solubility parameter of 8.4–10.5, so as to provide a toner showing an excellent fluidity capable of providing uniform fixed images free of gloss irregularity and less liable to soil the fixing member of the fixing apparatus or cause lowering in storage stability. Further, the toner thus obtained can exhibit good fixability to provide fixed images showing good light transmittance. When the toner is melted to form full-color images, the wax can partially or wholly coat the heating member to suppress the toner offsetting, thereby providing a satisfactory full-color OHP film. The toner also can show a good low-temperature fixability and allow the long life of the pressing member.

The wax contained in the toner may further preferably have an Mw/Mn ratio of at most 1.30 so as to provide uniform fixed images and good transferability of the toner, and suppress the soiling of a contact charging means for contact-charging the photosensitive member.

The values of Mw/Mn of waxes described herein are based on molecular weight distributions measured by GPC under the following conditions.

(GPC Measurement Conditions)

Apparatus: "GPC-150C" (available from Waters Co.)

Column: Double columns of "GMH-HT" 30 cm in series (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The wax used in the present invention may preferably have a melting point of 40–150° C., more preferably 50–120° C. If the melting point of the wax is below 40° C., the resultant toner is liable to have lower anti-blocking property and exhibit lower effects of suppressing the soiling of the developing sleeve and photosensitive member during continuous image formation on a large number of sheets. If the wax melting point exceeds 150° C., an excessively large energy is required in the case of toner production through the pulverization process, and in the case of toner production through the polymerization process, the uniform dispersion of the wax in the binder resin requires a larger apparatus because of an increased viscosity, and the inclusion of a large amount of wax becomes difficult.

The wax melting point described herein refers to a peak-top temperature of a main peak on a heat-absorption curve measured according to ASTM D3418-8. The measurement according to ASTM D3418-8 may be performed by using a differential scanning calorimeter (e.g., "DSC-7", mfd. by Perkin-Elmer Corp.). The detector temperature correction may be performed based on the melting points of indium and zinc, and the calorie correction may be performed based on a heat of fusion of indium. A sample is placed on an aluminum pan and is set in combination with a blank pan for control. The measurement is performed in a temperature range of 20–200° C. at a temperature-raising rate of 10° C./min.

The wax used in the present invention may preferably have a melt-viscosity at 100° C. of 1–50 mPa·sec, more preferably 3–30 mPa.sec.

If the wax melt-viscosity is below 1 mPa·sec, the resultant toner is liable to be damage by a shearing force acting between the toner and the carrier in the two-component developer system, and the embedding of the external additive at the toner particle surface and the toner breakage are liable to occur. If the wax melt-viscosity exceeds 50 mPa/sec, the disperse phase during toner production through the polymerization process is caused to have a high viscosity, so that it becomes difficult to obtain a small particle size toner of uniform particle sizes, thus being liable to result in a toner having a broad particle size distribution.

The wax melt-viscosity measurement may be performed by using a rotary viscometer (e.g., "TV-500" equipped with a conical plate-shaped rotor ("PK-1", available from HAAKE Co.)).

It is also preferred that the wax used in the present invention has such a molecular weight distribution as measured by GPC providing a chromatogram showing at least two peaks or a combination of at least one peak and at least one shoulder and exhibiting a weight-average molecular weight (Mw) of 200–2000, and a number-average molecular weight of 150–2000. The above-mentioned molecular weight distribution may be provided by a single wax species or a plurality of wax species. Anyway, by such a molecular weight distribution, the crystallinity of the wax is inhibited to provide a toner with a better transparency. Two or more wax species may be blended may be performed according to any methods, e.g., melt-blending at a temperature above the melting points by means of a media disperser, such as a ball mill, a sand mill, an attritor, an apex mill, a coball mill, or a handy mill; or dissolving such waxes in a polymerizable monomer, followed by blending by means of a media disperser. At this time, it is possible to add additives, such as a pigment, a charge control agent, and a polymerization initiator.

To supplement the wax molecular weight distribution, Mw is preferably 200–1500, more preferably 300–1000, and Mn is preferably 200–1500, more preferably 250–1000. If wax Mw is below 200 or Mn is below 150, the toner is liable to have a lower anti-blocking property. If wax Mw or Mn exceeds 2000, the wax is liable to be crystalline, thus being liable to result in toner images of a lower transparency.

Examples of the wax in the toner usable in the present invention may include: paraffin waxes, polyolefin waxes, and modified products of these (e.g., by oxidation or grafting), higher aliphatic acids and metal salts, amide waxes and ester waxes. Among these, ester waxes are particularly preferred as high-quality full-color OHP images can be obtained by use thereof.

As mentioned above, it is preferred to use a a toner (toner particles) having an average circularity (Ca) of at least 0.960. A preferred process for producing such toner particles is described. The toner particles can be produced through a pulverization process or a polymerization process, but the polymerization process is preferred.

Further to say, for production of spherical toner particles, it is possible to adopt a process of spraying a molten mixture into air by using a disk or a melt-fluid nozzle as disclosed in JP-B 56-13945, etc.; a process for directly producing toner particles according to suspension polymerization as disclosed in JP-B 36-10231, JP-A 59-53856, and JP-A 59-61842; a dispersion polymerization process for directly producing toner particles in an aqueous organic solvent in which the monomer is soluble but the resultant polymer is insoluble; a process for producing toner particles according to emulsion polymerization as represented by soap-free polymerization wherein toner particles are directly formed by polymerization in the presence of a water-soluble polymerization initiator and a hetero-aggregation process wherein primary polar emulsion polymerizate particles and then polar particles of the opposite polarity and added to cause aggregation.

The dispersion polymerization process provides toner particles having an extremely sharp particle size distribution but allows only a narrow latitude for selection of usable materials, and the use of an organic solvent requires a complicated production apparatus and troublesome operations accompanying the disposal of a waste solvent and inflammability of the solvent. Accordingly, it is preferred to adopt a process wherein a composition comprising at least a polymerizable monomer, a colorant and a wax is polymerized in an aqueous medium to directly produced toner particles. The emulsion polymerization process as represented by the soap-free polymerization is effective for providing toner particles having a relatively narrow particle size distribution, but the used emulsifier and polymerization initiator terminal are liable to be present at the toner particle surfaces, thus resulting in an inferior environmental characteristic.

For the purpose of the present invention, it is particularly preferred to adopt the suspension polymerization process, under the normal or elevated pressure, capable of relatively easily providing toner particles having a sharp particle size distribution. It is also possible to adopt a seed polymerization process wherein a monomer is further adsorbed onto once-obtained polymerizate particles and polymerized by using a polymerization initiator.

The toner particles used in the present invention may preferably have a microtexture comprising a wax enclosed within an outer shell resin as confirmed by a sectional view observed through a transmission electron microscope (TEM). In order to incorporate a large amount of wax for improving the fixation characteristic, it is preferred to provide such an outer shell/wax enclosure structure so as to retain good storage stability and flowability of the toner. In case of a toner not having such an enclosure structure, the wax cannot be dispersed uniformly to result in a toner having a broad particle size distribution and liable to cause melt-sticking onto the apparatus members.

As a specific method for providing such a wax enclosure structure, a composition containing a wax having a smaller polarity than a principal monomer constituting the composition may be dispersed in an aqueous medium, and a small amount of a resin or monomer having a larger polarity is also included in the composition to form an outer shell, thus providing toner particles having a so-called core/shell structure. It is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with troismium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the wax and the outer resin by utilizing a difference in crystallinity therebetween.

The toner particle production through a direct polymerization process may be performed in the following manner. Into a monomer, a wax, a colorant, a charge control agent, a polymerization initiator, and other optional additives may be added, and the mixture is uniformly dissolved or dispersed by a homogenizer, an ultrasonic disperser, etc., to form a polymerizable monomer composition, which is then dispersed in an aqueous medium containing a dispersion stabilizer by means of an ordinary stirrer, a homomixer, a homogenizer, a clear mixer, etc. The stirring speed and time may be adjusted so that the monomer composition will form droplets or particles having sizes identical to the objective toner particle sizes. Thereafter, the stirring is continued in such a degree that the formed particle state is retained and the sedimentation of the particles is prevented. The polymerization temperature may be set to 40° C. or higher, generally 50–90° C. The temperature may be increased at a later stage of the polymerization. It is also possible to distill off a portion of the aqueous medium at a later stage of or after the polymerization, in order to remove the unreacted portion of the monomer or by-products which are liable to provide odor. After the reaction, the produced toner particles (polymerizate particles) are washed, recovered by filtration and dried. In the suspension polymerization process, it is ordinarily preferred to use 300 to 3000 wt. parts of water as a dispersion medium per 100 wt. parts of the monomer composition.

Examples of polymerizable monomers constituting a polymerizable monomer composition for directly providing toner particles by the polymerization process may include: styrene monomers, such as styrene, o-, m- or p-methylstyrene, and m- or p-ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, methylaminoethyl (meth)acrylate, and diethylaminoethyl (meth)acrylate butadiene, isoprene, cyclohexene, (meth)acrylonitrile, and acrylamide.

Examples of the polar resin included in the polymerizable monomer composition may include: polymers of nitrogen-containing monomers, such as dimethylaminoethyl methacrylate and diethylaminoethyl methacrylate, and copolymers of such nitrogen-containing monomers with styrene and/or unsaturated carboxylic acid esters; polymers or copolymers with styrene monomers of nitrile monomers such as acrylonitrile, halogen-containing monomers such as vinyl chloride, unsaturated carboxylic acids such as acrylic acid and methacrylic acid unsaturated dibasic acids and anhydrides thereof, and nitro monomers; polyesters; and epoxy resins. Preferred examples may include: styrene-(meth)acrylic acid copolymer, maleic acid copolymer, saturated polyester resins, and epoxy resins.

In the toner production by direct polymerization, examples of the polymerization initiator may include: azo- or diazo-type polymerization initiators, such as 2,2'-azobis (2,4-dimethylvaleronitrile), 2,2'-adobisisobutylonitrile, 1,1'-azobis(cyclohexane-2-carbonitrile), 2,2'-azobis-4-methoxy-2,4-dimethylvaleronitrile, azobis-isobutyronitrile; and peroxide-type polymerization initiators such as benzoyl peroxide, methyl ethyl ketone peroxide, diisopropyl peroxycarbonate, cumene hydroperoxide, t-butyl hydroperoxide, dicumyl peroxide, 2,4-dichlorobenzoyl peroxide, lauroyl peroxide, 2,2-bis(4,4-t-butylperoxycyclohexyl)propane, and tris(t-butylperoxy) triazine; polymeric initiators having a peroxide group in their side chains; persulfates, such as potassium persulfate and ammonium persulfate. These initiators may be used or in combination of two or more species. The polymerization initiator may preferably be used in the range of about 0.5–20 wt. parts per 100 wt. parts of the polymerizable monomer.

In order to control the molecular weight of the resultant binder resin, it is also possible to add a crosslinking agent, a chain transfer agent, etc., in an amount of 0.001–15 wt. parts per 100 wt. parts of the polymerizable monomer.

In production of toner particles by the emulsion polymerization, dispersion polymerization, suspension polymerization, seed polymerization or hetero-aggregation using a dispersion medium, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt, starch, polyacrylamide, polyethylene oxide, poly (hydroxystearic acid-g-methyl methacrylate-eu-methacrylate acid) copolymer, and nonionic and ionic surfactants.

In the emulsion polymerization process or hetero-aggregation process, anionic surfactants, cationic surfactants, ampoteric surfactants or nonionic surfactants may be used.

These dispersion stabilizers may preferably be used in the aqueous dispersion medium in an amount of 0.2–30 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

In order to use a colorant in a polymerizable monomer composition for directly providing toner particles by the polymerization process, it is necessary to pay attention to the polymerization-inhibiting function and transferability to the aqueous phase of the colorant, so that it is preferred to subject the colorant to surface modification, e.g., hydrophobization free from polymerization inhibition. Particularly, dyes and carbon black can have polymerization dyes and carbon black can have polymerization inhibition function in many cases. As a preferred surface treatment of dyes a polymerizable monomer may be polymerized in advance in the presence of such a dye, and the resultant colored polymer may be added to the monomer composition. Further, carbon black may also be treated in the above-described manner for the dyes or may also be treated with a substance reactive with a surface functional group of the carbon black, such as polyorganosiloxane.

It is further preferred that the wax in the toner has a melting point which is higher than the glass transition temperature of the toner binder resin by at most 100° C., preferably at most 75° C., further preferably at most 50° C.

If the temperature difference exceeds 100° C., the low-temperature fixability of the resultant toner may be impaired. If the temperature difference is too small, a good combination of toner storability and anti-high-temperature offset property can be provided for only a narrow range, so that the temperature difference may preferably be at least 2° C. The glass transition temperature of the binder resin may preferably be 40–90° C., more preferably 50–85° C.

If the glass transition temperature is below 40° C., the resultant toner is provided with only a low storage stability and inferior flowability, thus failing to provide good images.

If the glass transition temperature of the binder resin exceeds 90° C., the resultant toner is liable to have inferior low-temperature fixability and provide a full-color transparency with poor optical transparency, as represented by projection images with somber halftone images and poor saturation.

The values of glass transition temperatures described herein are based on values determined on a heat-absorption curve measured according to ASTM D3418-8. The measurement according to ASTM D3418-8 may be performed by using a differential scanning calorimeter (e.g., "DSC-7", mfd. by Perkin-Elmer Corp.). The detector temperature correction may be performed based on the melting points of indium and zinc, and the calorie correction may be performed based on a heat of fusion of indium. A sample is placed on an aluminum pan and is set in combination with a blank pan for control. The measurement is performed in a temperature range of 20–200° C. at a temperature-raising rage of 10° C./min.

Next, external additives added to the toner particles to provide the toner used in the present invention will be described.

The toner used in the present invention may suitably include, as external additives; fine particles of inorganic substances, such as silica, alumina and titanium oxide; and fine particles of organic substances, such as polytetrafluoroethylene, polyvinylidene fluoride, polymethyl methacrylate, polystyrene and silicone resins. By adding such fine particles as an external additive to the toner, such fine particles are caused to be present between the toner and the carrier, and between the toner particles, to provide the developer with an improved flowability and an improved life. The fine particles may preferably have an average particle size of at most 0.2 $\mu$m. If the average particle size exceeds 0.2 $\mu$m, the flowability-improving effect is reduced, whereby the image quality can be lowered due to inadequate developing or transfer performance in some cases. The method for measuring the average particle size of these fine particles will be described later.

These external additive fine particles may preferably have a specific surface area as measured by nitrogen adsorption according to the BET method ($_{SBET}$) of at least 30 $m^2/g$, particularly 50–400 $m^2/g$, and may suitably be added in 0.1–20 wt. parts per 100 wt. parts of the toner particles.

In the present invention, it is preferred that the toner is a negatively chargeable one.

In order to provide such a negatively chargeable toner, it is preferred to use at least hydrophobized silica as a species of external additive. This is because silica has a higher negative chargeability than other flowability-improving agents, such as alumina and titanium oxide, so that it exhibits a higher attachment force onto the toner particles, thus leaving less isolated external additive particles. Accordingly, it can better suppress the filming on the electrostatic image-bearing member and the soiling on the charging member. If the negative chargeability is enhanced, a portion of the external additive isolated from the toner particles is liable to be transferred onto the carrier. Even in such a case, however, the fluorine-containing resin coated carrier of the present invention can better suppress the attachment of the flowability-improving agent because of its low surface energy.

It is preferred that the silica is hydrophobized in order to have a high chargeability in a high humidity environment.

A preferred class of hydrophobization agents may comprise a silane coupling agent. Such a silane coupling agent may be used in 1–40 wt. parts, preferably 2–35 wt. parts per 10 wt. parts of the inorganic fine powder to be treated therewith, so as provide improved moisture-resistance while preventing the occurrence of the agglomerate.

A suitable class of silane coupling agents used in the present invention may include those represented the following formula (5):

$$R_mSiY_n \quad (5),$$

wherein R denotes alkoxy or chlorine, m is an integer of 1–3; Y denotes a hydrocarbon group, such as alkyl vinyl, glycidoxy or methacryl; and n is an integer of 1–3.

Specific examples of such silane coupling agents may include: dimethyldichlorosilane, trimethylchlorosilane, allyldimethylchlorosilane, hexamethyldisilazane, allylphenylchlorosilane, benzyldimethylchlorosilane, vinyltriethoxysilane, γ-methacryloxypropyltrimethoxysilane, vinyltriacetoxysilane, divinylclorosilane, and dimethylvinylchlorosilane.

The treatment of inorganic fine powder with a silane coupling agent may be performed in known manners, e.g., a dry treatment process wherein a vaporized silane coupling agent is caused to react onto inorganic fine powder in a cloud state under stirring, or a silane coupling agent is added dropwise into a dispersion of inorganic fine powder in a solvent. These treatment processes may be combined as desired.

Another preferred class of hydrophobization agents may comprise silicone oil.

A preferred class of silicone oil may have a viscosity at 25° C. of 5–2000 $mm^2/sec$. Silicone oil having a lower viscosity because of too low a molecular weight can generate a volatile matter during a heat treatment. On the other hand, silicone oil having a higher viscosity because of too high a molecular weight makes difficult a surface treatment therewith. Preferred examples of silicone oil may include: methylsilicone oil, dimethylsilicone oil, phenylmethylsilicone oil, chlorophenylmethylsilicone oil, alkyl-modified silicone oil, aliphatic acid-modified silicone oil, and polyoxyalkyl-modified silicone oil.

The silicone oil may preferably be negatively chargeable similarly as the toner particles so as to provide a toner with an enhanced chargeability.

Inorganic fine powder may be treated with silicone oil in a known manner.

For example, inorganic fine powder and silicone oil may be blended directly in a blender, such as a Henschel mixer; or silicone oil may be sprayed onto inorganic fine powder. It is also possible to dissolve or disperse silicone oil in an appropriate solvent and mixing inorganic fine powder therein, followed by removing the solvent.

Silicone oil may suitably be used in 1.5–60 wt. parts, preferably 3.5–40 wt. parts, per 100 wt. parts of the inorganic fine powder to be treated therewith. Within the range of 1.5–60 wt. parts, the surface treatment with the silicone oil can be performed uniformly to well prevent the filming and hollow image dropout, prevent the lowering in toner chargeability due to moisture absorption in a high humidity environment and prevent the lowering in image density during continuous image formation.

Various additives added into or added as external additives to toner particles may preferably have an average particle size of 0.005–0.2 $\mu$m in view of continuous image forming performance of the resultant toner. The average particle sizes of the additives referred to herein are based on values determined on electron microscopic photographs thereof (e.g., in a state of being mixed with toner particles in the case of external additives). Examples of such additives for improving toner performances may include the following.

In addition to the above-mentioned flowability improvers comprising inorganic and/or organic fine particles, it is also possible to use other flowability improvers, such as carbon black; and fluorinated carbon. These may preferably be hydrophobized before use.

Abrasives, inclusive of: strontium titanate, cerium oxide, aluminum oxide magnesium oxide, and chromium oxide; nitrides, such as silicon nitride; carbides, such as silicon nitride; carbides, such as silicon carbide; and metal salts, such as calcium sulfate, barium sulfate and calcium carbonate.

Lubricants, inclusive of: power of fluorine-containing resins, such as polyvinylidene fluoride and polytetrafluoroethylene; and fatty acid metal salts, such as zinc stearate and calcium stearate.

Charge-controlling particles or electroconductivity-imparting particles: inclusive of particles of metal oxides, such as tin oxide, titanium oxide, zinc oxide, silicon oxide and aluminum oxide and carbon black.

These additives may preferably be added in 0.1–1 wt. parts, more preferably 0.1–5 wt. parts, per 100 wt. parts of toner particles. These additives may be used singly or in combination of plural species.

A starting developer to be initially incorporated in the developer vessel of the developing apparatus according to the present invention may preferably be formed by blending the above-mentioned magnetic fine particle-dispersed resin carrier and the above-mentioned toner so as to provide a toner concentration in the developer of 2–15 wt. %, more preferably 4–13 wt. % so as to obtain good results. If the toner concentration is below 2 wt. %, the image density is liable to be lowered. Above 15 wt. %, the toner is liable to result in foggy images and cause toner scattering in the image forming apparatus. Further, the developer life is liable to be shortened.

Next, a description will be made on an image forming apparatus equipped with a developing apparatus using the above-mentioned replenishing developer according to the present invention.

FIG. 1 illustrates an embodiment of image forming apparatus including a rotary developing apparatus according to the present invention.

Referring to FIG. 1, an electrostatic latent image-bearing member 1 is uniformly surface-charged to a negative polarity by a charging device 15, and then exposed to image light corresponding to an image of first color, e.g., yellow, to form thereon an electrostatic latent image corresponding to the yellow image, which is then subjected to development by a developing apparatus 13.

The developing apparatus 13 is of a rotary movement type, and a yellow developing device therein is disposed opposite to the image-bearing member 1 before the leading edge of the electrostatic latent image corresponding to the yellow image reaches the developing position. Then, a magnetic brush of yellow developer of the yellow developing device is caused to rub the electrostatic latent image, thereby forming a yellow toner image thereon.

Figure 2:
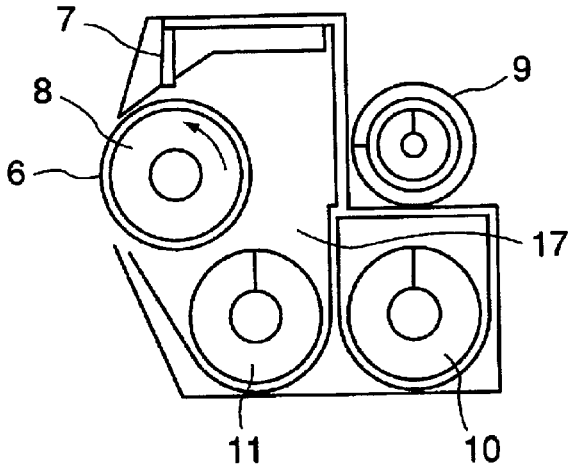
FIG. 2 illustrates a developing unit in the developing apparatus shown in FIG. 1.

The developing apparatus 13 includes four color developing devices, each including a developer-carrying member (developing sleeve), a supply roller, a magnet roll, a regulating member, a scraper, etc. FIG. 2 illustrates an organization of developing devices 2, 3, 4 and 5 in FIG. A developer flow in a developing device is described with reference to FIG. 2.

A developing sleeve 6 in each developing device enclose a fixed magnet roller 8 and is disposed with a prescribed developing gap from the peripheral surface of the image-bearing member 1 at its developing position and is rotatively driven. Alternatively, the developing sleeve 6 can contact the image-bearing member 1 in some cases. A regulating member 7 may assume various forms, inclusive of one which is rigid, magnetic and pressed against the developing sleeve 6 at a prescribed force in the absence of the developer, and another one which is disposed with a prescribed gap from the developing sleeve. A pair of developer-stirring and conveying members 10 and 11 are provided with a screw structure and convey and circulate the developer in mutually opposite directions, thereby sufficiently stirring and supplying the toner and the carrier as the developer to the developing sleeve. The magnet roll 8 may be one comprising four magnetic poles of equal magnetic forces including N poles and S poles disposed alternately, or one comprising 5 poles lacking one pole so as to form a repulsive magnetic field for facilitating the developer peeling at a position in contact with a scraper, so as to be enclosed in a fixed state within the developing sleeve 6.

The above-mentioned two developer stirring and conveying members 10 and 11 also function as stirring members rotating in mutually opposite directions, whereby a replenishing developer supplied from a replenishing developer vessel 9 is conveyed under a thrust exerted by the stirring screws and the toner and the magnetic carrier are mixed and subjected to triboelectrification to provide a uniform two-component developer, which is supplied and attached in a layer onto a peripheral surface of the developing sleeve 6. The developer formed on the surface of the developing sleeve may be formed in a uniform layer by means of a regulating member 7 having a double structure comprising a non-magnetic material and a magnetic material and disposed opposite to a magnetic pole of the magnet roll 8. The uniform developer layer on the developing sleeve 6 develops the latent image on the electrostatic latent image-bearing member 1 to form a toner image thereon.

Referring again to FIG. 1, a transfer(-receiving) material 12 comprising a paper sheet or a transparent sheet conveyed from a paper tray 26 or 27 by means of a feed roller 28 or 29 and supplied onto a transfer drum 24 at a prescribed time via registration rollers 25. The supplied transfer material 12 is electrostatically held on the transfer drum 24 by an adsorption device 32 and an opposite roller 30 and conveyed to a transfer region where the transfer drum 24 and the image-bearing member are opposite to each other. There, the transfer material 12 is caused to intimately contact the yellow toner image on the image-bearing member 1, and the yellow toner image is transferred onto the transfer material 12 under the action of a transfer device 31. The transfer drum 24 carrying the transferred yellow toner image waits for a subsequent step.

The image-bearing member 1 after the yellow toner image transfer is then subjected to a cleaning pre-treatment, such as charge removal by a corotron, and then surface scraping or removal of the residual yellow toner, followed by surface charge removal by a charge remover 16.

Then, for the formation of a subsequent image of second color, e.g., magenta, the image-bearing member 1 is again uniformly surface-charged to a negative polarity by the charger 15, and exposed to image light corresponding to the magenta image to form thereon an electrostatic latent image corresponding to the magenta image. On the other hand, the developing apparatus 13 after the yellow development is switched so that a magenta developing device is disposed opposite to the image-bearing member 1, whereby the electrostatic latent image corresponding to the magenta image on the image-bearing member 1 is developed with a magnetic brush of magenta developer of the magenta developing device to form a magenta toner image on the image-bearing member 1, which is then transferred onto the transfer material 12 held on the transfer member 24 and conveyed to the transfer position in superposition with the yellow toner image already carried on the transfer material 12.

The image-bearing member 1 after the magenta toner image transfer is subjected to cleaning of the residual toner and residual charge removal similarly as in the previous yellow image forming step. On the other hand, the transfer material 12 having received the transferred magenta toner image superposed with the yellow toner image waits for a subsequent image forming step while being held on the transfer drum 24.

Thereafter, a third color (e.g., cyan) image forming step, and a fourth color (e.g., black) image forming step, are successively performed, respectively in a similar manner as the preceding magenta image forming step. Unlike after receiving the first to third color toner images, the transfer material 12 after receiving the fourth color (e.g., black) toner image is separated from the transfer drum 24 by means of peeling fingers or separation claws (not shown) provided at a front end of a conveying guide member 20 in cooperation with a separation charge remover 19 and sent to a fixing device 21, whereby the superposed toner images are fixed simultaneously onto the transfer material to be discharged as an image product (a copy or a print) out of the image forming apparatus.

The transfer drum 24 after separation of the transfer material is then subjected to surface charge removal by charge removers 22 and 33 and surface cleaning by a cleaning device 23, for waiting for a supply of a subsequent transfer material 12.

By repetition of the above-mentioned image forming cycles, the toner in the developer contained in a developer vessel 17 in the developing device shown in FIG. 2 is gradually consumed to lower the proportion of the toner relative to the carrier, i.e., lower the toner concentration in the developer. The toner concentration change is detected by a toner concentration detection means (or a toner concentration sensor, not shown) provided to the developer vessel 17, and the toner concentration is controlled within an appropriate range for development by controlling a feed rate of replenishing developer from a replenishing developer container 9 via a replenishing port thereof to the developer vessel 17.

On the other hand, the carrier in the developer within the developer vessel 17 is not substantially consumed but gradually surface-soiled or deteriorated due to stirring with the toner in the developer vessel 17, the action of the magnet roll, the contact with the image-bearing member 1, etc. As a result of such carrier deterioration, the carrier is liable to fail in imparting a prescribed amount of charge to the toner and cause a lowering in resultant toner images. Accordingly, the deteriorated carrier in the developer vessel 17 has to be replaced with a fresh carrier. For this purpose, in the developing device shown in FIG. 2 of the developing apparatus according to the present invention, the replenishing developer container 9 is caused to contain a replenishing developer of the present invention comprising a replenishing toner and a fresh carrier so as to supply the replenishing developer of a desired color to the developer vessel 17 of an associated developing device 2, 3, 4 or 5 of a corresponding color through a replenishing port of the container 9. An excessive amount of developer as a result of the supply of the replenishing developer is discharged through a developer discharge port of the developing device. The thus-discharged developer contains not only the deteriorated carrier, but as a result of repetition of repetition of replenishment and discharge, the deteriorated carrier is gradually discharged out of each developing device.

Figure 3:
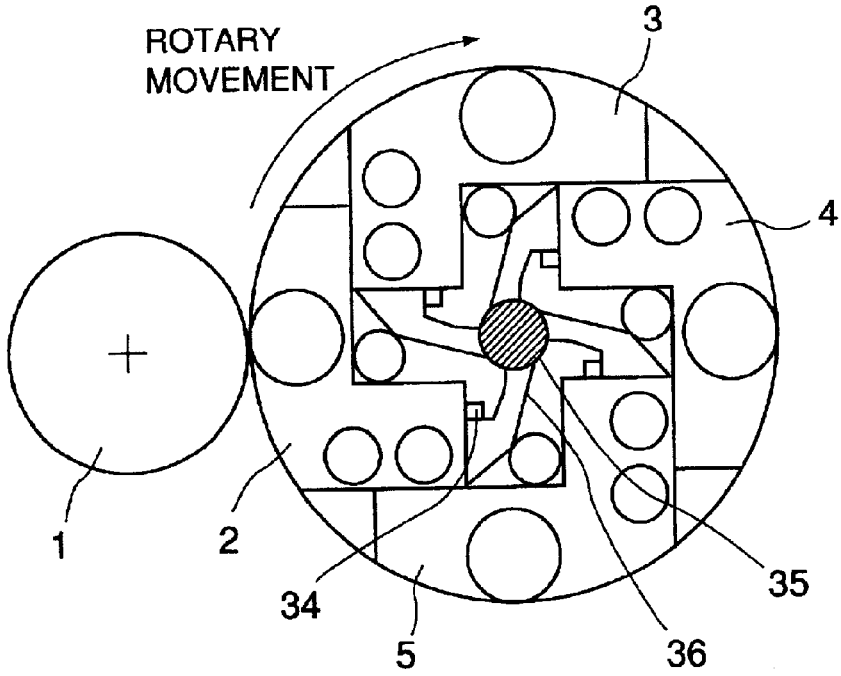
FIG. 3 is a partial enlarged view for illustrating an operation of the developing apparatus.
Figure 4:
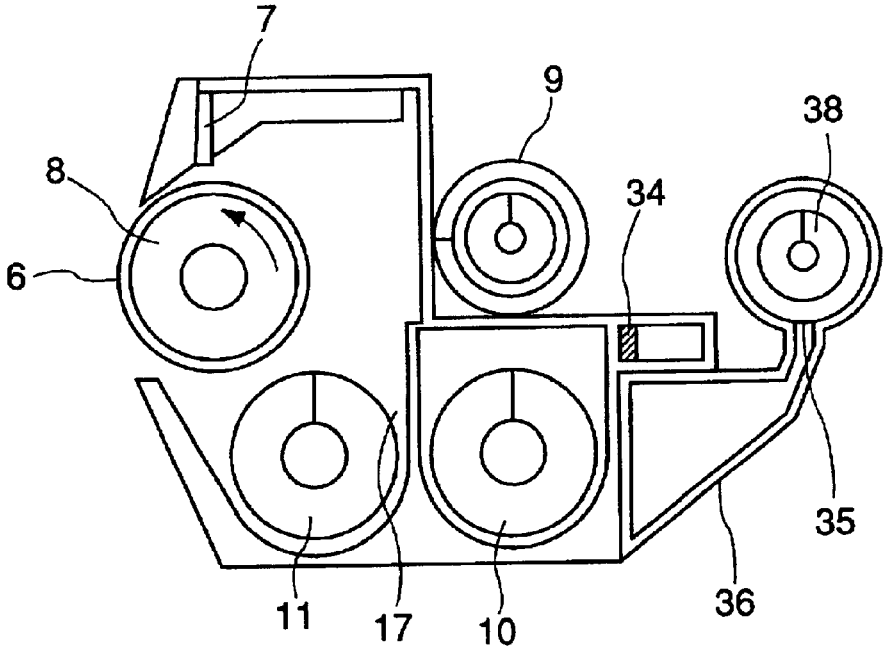
FIG. 4 illustrates another embodiment of developing unit in the developing apparatus shown in FIG. 1.

Now, a developer exchanging operation utilizing a rotary movement of the developing apparatus 13 shown in FIG. 1 is described with reference to FIGS. 3 and 4. In the developing apparatus 1 causing a rotary movement in the full-color image forming apparatus, the developing devices 2–5 are moved in revolution inside the developing apparatus 13, and each developing device is disposed in a developing position opposite to the image-bearing member 1 to effect its developing operation onto the image-bearing member 1 and is moved to a position not confronting the image-bearing member 1 at a time not used for the development.

At a position where the developing device 2 is disposed opposite to the image-bearing member 1 for effecting its developing operation, the developer overflown out of a developer discharge port 34 provided to the developing device 2 is moved through a conduit pipe 35 along with the rotary or revolutionary movement of the developing device 2 about a rotation axis of the developing apparatus 13 (i.e., the developing device exchanging revolution axis) to be discharged out of a developer recovery port 35 disposed at the rotation axis.

As a specific developing method of using the magnetic carrier according to the present invention, it is preferred that a developer-carrying member is supplied with an alternating voltage to form an alternating electric field in a developing region, when a magnetic brush is caused to contact the image-bearing member (photosensitive member) 1 for effecting development. It is preferred that the gap between the developer-carrying member 6 and the image-bearing member 1 is set to be in a range of 100–1000 $\mu$m in view of the prevention of carrier attachment and improved dot reproducibility. Below 100 $\mu$m, the developer supply is liable to be insufficient to result in a lower image density. Above 1000 $\mu$m, the magnetic brush density is liable to be lowered due to spreading of magnetic lines of force from the developing magnetic pole, thus being liable to result in an inferior dot reproducibility and carrier attachment due to weakening of carrier constraint force.

The alternating electric field may preferably have a peak-to-peak voltage of 300–3000 volts, and a frequency of 500–10000 Hz, more preferably 1000–7000 Hz, as suitably determined depending on the process. The alternating electric field may have an appropriate waveform, selected from various waveforms, such as triangular wave, rectangular wave, sinusoidal wave, waveforms obtained by modifying the duty ratio and intermittent alternating superposed electric field. If the application voltage is below 300 volts it may be difficult to obtain a sufficient image density and fog toner on a non-image region cannot be satisfactorily recovered in some cases. Above 3000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 150 volts. It is preferred to use a contrast potential of 100–400 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) of the magnetic brush on the developing sleeve with the photosensitive drum at 3–8 mm in order to effect a development providing a sufficient image density and excellent dot reproducibility without causing carrier attachment. If the developing nip is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip may be appropriate adjusted by changing a distance between a developer regulating member and the developing sleeve and/or changing the gap between the developing sleeve and the photosensitive drum.

The electrostatic image-bearing member may have an organization similar to that of a photosensitive member ordinary adopted in electrophotographic image forming apparatus, e.g., a photosensitive member comprising an electroconductive substrate of, e.g., aluminum or stainless steel (SUS), and an electroconductive layer, a primer layer, a charge generation layer and a charge transport layer, successively formed thereon, and further optionally a charge injection layer. The electroconductive layer, the primer layer, the charge generation layer and the charge transport layer may be similar to those ordinarily adopted in a photosensitive member.

The photosensitive member can also have a charge injection layer or a protective layer as the surfacemost layer.

In addition to the formation of high-quality images in the initial stage, the replenishing developer of the present invention allows a lower shearing force applied to the developer in the developing apparatus, suppresses the accumulation of spent toner or external additive on the carrier and results in little image quality lowering even at a small rate of carrier replenishment.

Another embodiment of the image forming method according to the present invention will be described with reference to the drawings.

Figure 5:
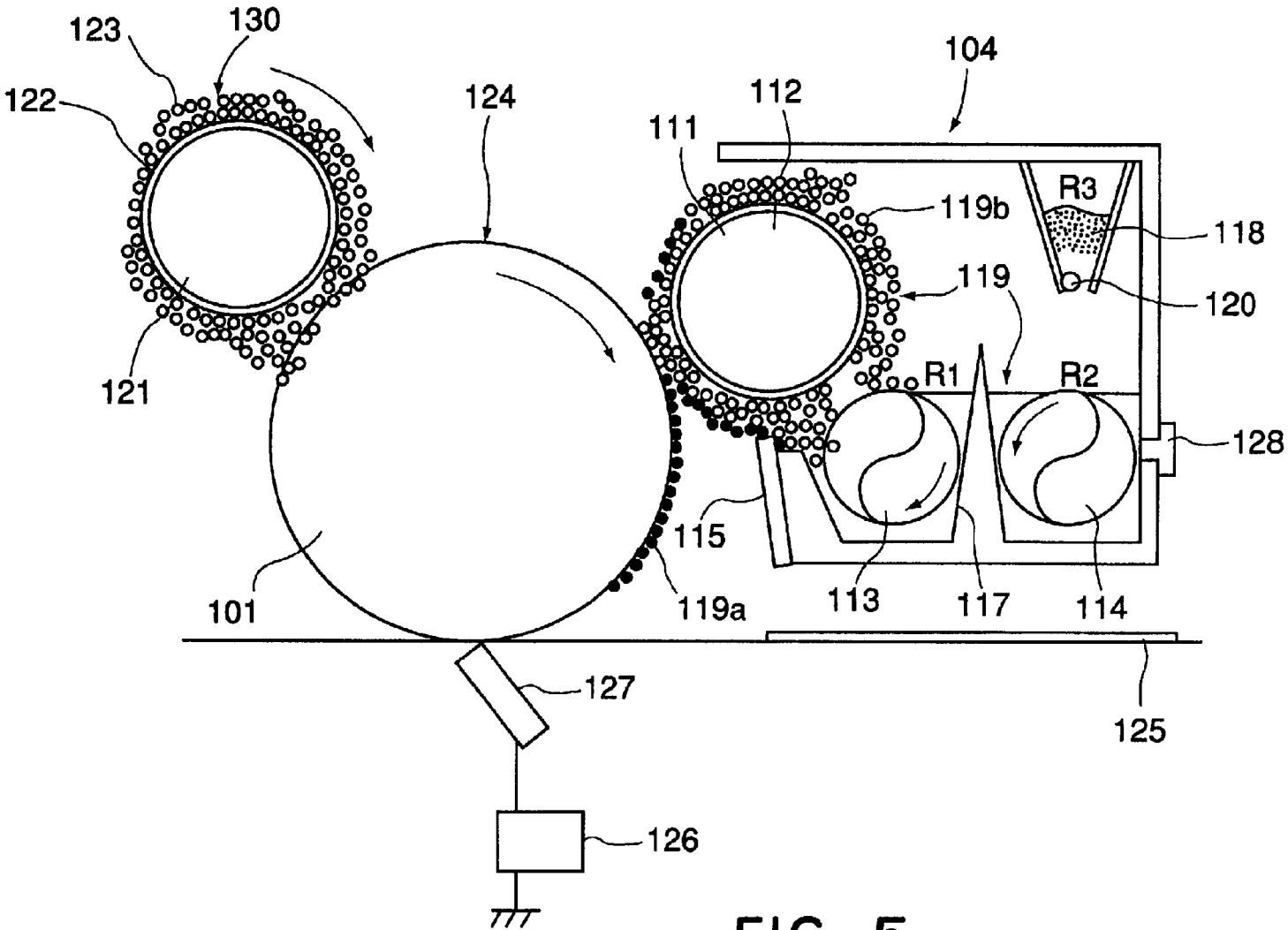
FIG. 5 illustrates a cleaner-less image forming apparatus including a developing apparatus according to the invention.

Referring to FIG. 5, a magnetic brush charger 130 composed of magnetic particles 123 is formed on the surface of a conveyer sleeve 122 and is caused to contact the surface of an electrostatic image-bearing member (photosensitive drum) 101 to charge the photosensitive drum 10 The conveyer sleeve 122 is supplied with a charging bias voltage from a bias voltage application means (not shown). The charged photosensitive drum 101 is illuminated with laser light 124 from an exposure means (not shown) to form a digital electrostatic image thereon, which is then developed with a toner 119*a* contained in a two-component developer 119 according to the present invention carried on a developing sleeve 111 enclosing a magnet roller 112 therein and supplied with a developing bias voltage from a bias voltage source (not shown).

A developing device 104 supplying the developer 119 is divided into a developer chamber $R_1$ and a stirring chamber $R_2$ by a partitioning wall 117, in which developer conveyer screws 113 and 114 are installed respectively. Above the stirring chamber $R_2$ is provided a developer storage chamber $R_3$ containing a replenishing developer 118, and at the bottom of the developer storage chamber $R_3$ is provided a developer replenishing port 20.

In the developer chamber $R_1$, the screw 113 is rotated to stir and convey the developer in the chamber $R_1$ in one direction along the length of the developing sleeve 111. The partitioning wall 117 is provided with openings (not shown) at a near side and a farther side as viewed in the drawing. The developer conveyed to one side of the developer chamber $R_1$ by the screw 113 is fed through the opening at the one side into the stirring chamber $R_2$ and now driven by the developer conveyer screw 114. The screw 114 is rotated in a direction reverse to that of the screw 113 to stir and mix the developer in the stirring chamber $R_2$, the developer conveyed from the developer chamber $R_1$ and a fresh toner replenished from the developer stage chamber $R_3$, and convey the mixture in a direction reverse to that by the screw 113 to supply the mixture into the developer chamber $R_1$ through the other opening of the partitioning wall 117.

For developing an electrostatic image formed on the photosensitive drum 101, the developer 119 in the developer chamber $R_1$ is drawn up by a magnetic force exerted by the magnet roller 112 to be carried on the surface of the developing sleeve 111. The developer carried on the developer sleeve 111 is conveyed to a regulating blade 115 along with the rotation of the developing sleeve 111 to be regulated into a thin developer layer having an appropriate layer thickness and reach a developing region where the developing sleeve 111 and the photosensitive drum 101 are disposed opposite to each other. At a part of the magnet roller 112 corresponding to the developing region is disposed a magnet pole (developing pole) $N_1$. The developing pole $N_1$ forms a developing magnetic field in the developing region, and ears of the developer are formed by the developing magnetic field to provide a magnetic brush of the developer in the developing region. The magnetic brush is caused to contact the photosensitive drum 101, whereby the toner in the magnetic brush and the toner on the developing sleeve 111 are transferred onto a region of electrostatic image on the photosensitive drum 101 to develop the electrostatic image, thereby providing a toner image 119*a* on the photosensitive drum 101.

A portion of the developer having passed the developing region is returned into the developing device 104 wherein the developer is peeled off the developing sleeve 111 by the screw 113, to fall into the developer chamber $R_1$ and the stirring chamber $R_2$ to be recovered.

If the developer 119 in the developing device 104 has caused a lowering in T/C ratio (toner/carrier mixing ratio, i.e., a toner concentration in the developer) due to continuation of the above-described operation, replenishing developer 118 in the developer storage chamber $R_3$ is replenished into the stirring chamber $R_2$ at a rate corresponding to the amount consumed during the development, so that the T/C ratio in the developer 119 is kept constant. The T/C ratio of the developer 119 in the device 104 may be detected by using a toner concentration detection sensor 128 equipped with a coil (not shown) therein having an inductance for measuring a chamber in magnetic permeability of the developer to detect the toner concentration.

The regulating blade 115 disposed below the developing sleeve 111 to regulate the layer thickness of the developer 119 on the developing sleeve 111 is a non-magnetic blade formed of a non-magnetic material, such as aluminum or SUS 316. The edge thereof may be disposed with a gap of 150–800 $\mu$m, preferably 250–700 $\mu$m. If the gap is below 150 $\mu$m, the gap may be plugged with the magnetic carrier to result in an irregularity in the developer layer and a difficulty in applying an amount of toner required for performing good development, thus being liable to result in images with a low density and much irregularity. In order to prevent an irregular coating (so-called "blade-plugging")

due to contaminant particles in the developer, the gap may preferably be at least 150 μm. Above 800 μm, however, the amount of developer applied onto the developing sleeve 111 is increased so that it becomes difficult to effect a prescribed developer layer thickness regulation, whereby the amount of magnetic carrier attachment onto the photosensitive drum 101 is increased and the circulation of the developer and the regulation of the developer by the regulating blade 115 are weakened to provide the toner with a lower triboelectric charge, leading to foggy images.

The magnetic carrier particle layer moves corresponding to the rotation of the developing sleeve in an indicated arrow direction but the speed of the movement becomes slower as the distance from the developing sleeve surface is increased depending on a balance between a constraint force based on magnetic force and gravity and the conveying force in the direction of movement of the developing sleeve. Some developer can even fall due to the gravity.

The thus-developed toner image 119*a* on the photosensitive drum 101 is transferred onto a transfer material (recording material) 125 conveyed to the transfer position by a transfer blade 127, as a transfer means, supplied with a transfer bias electric field supplied from a bias voltage application means 126. Then, the toner image is fixed onto the transfer material 125 by means of a fixing device (not shown). Transfer residual toner remaining on the photosensitive drum 101 without being transferred onto the transfer material in the transfer step is charge-adjusted in the charging step and removed during the developing step.

Figure 6:
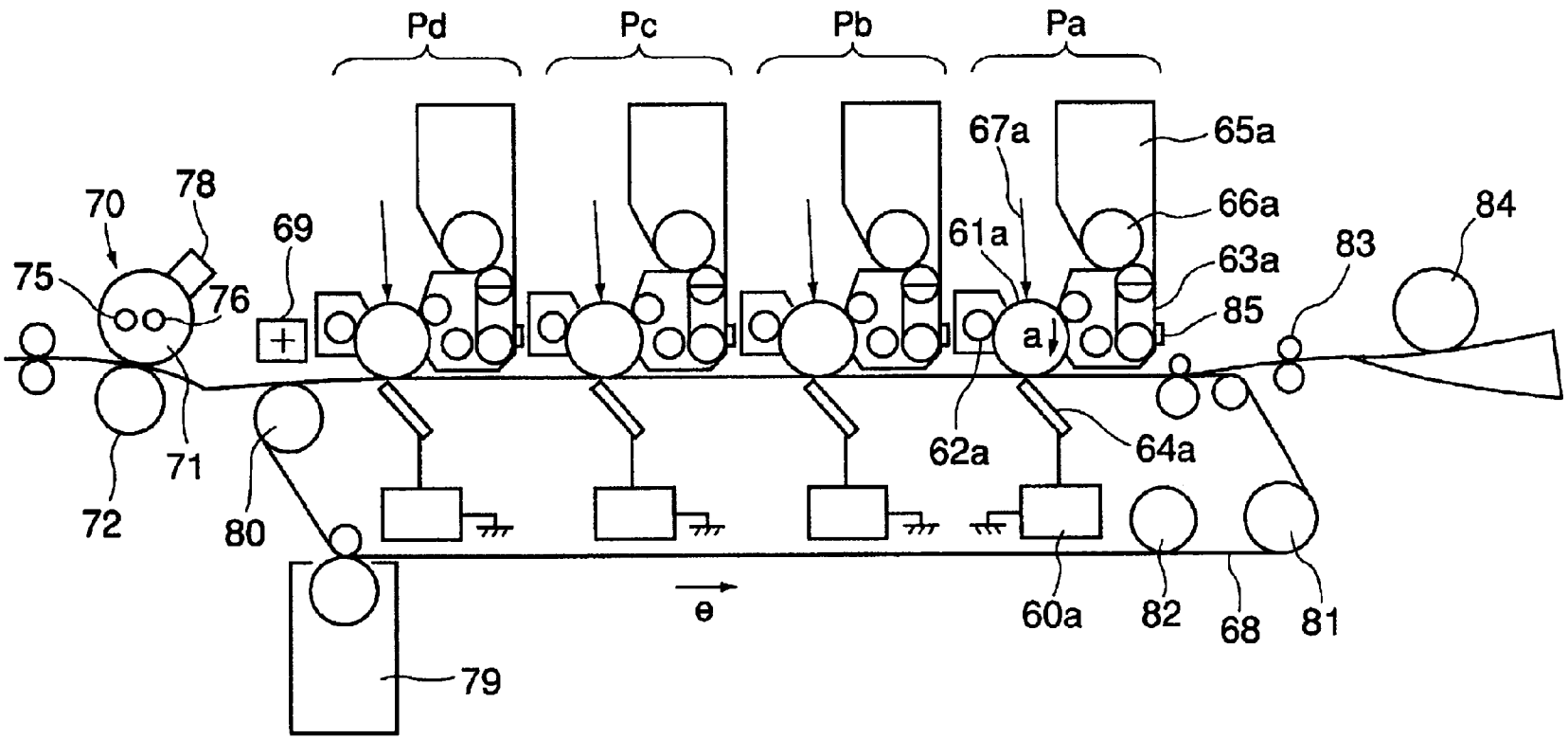
FIG. 6 illustrates a full-color image forming apparatus.

FIG. 6 illustrates a full-color image forming system suitable for practicing another embodiment of the image forming method according to the present invention, which system does not include a separate cleaning means for recovering and storing transfer residual toner remaining on the image-bearing member but includes a developing means also functioning as a cleaning means for recovering transfer residual toner remaining on the image-bearing member after transfer of a toner image onto a transfer material, similarly as in the image forming apparatus of FIG. 5.

In the developing means (developing apparatus), the carrier increased in amount by a carrier contained in the replenishing developer is overflown to be recovered by a developer recovery auger and then conveyed to a recovery vessel.

Referring to FIG. 6, a full-color image forming apparatus main body includes a first image forming unit Pa, a second image forming unit Pb, a third image forming unit Pc and a fourth image forming unit Pd disposed in juxtaposition for forming respectively images of different colors each formed through a process including electrostatic image formation, development and transfer steps on a transfer material.

The organization of the image forming units juxtaposed in the image forming apparatus will now be described with reference to the first image forming unit Pa, for example.

The first image forming unit Pa includes an electrophotographic photosensitive drum 61*a* of 30 mm in diameter as an electrostatic image-bearing member, which rotates in an indicated arrow a direction. A primary charger 62*a* as a charging means includes a 16 mm-dia. sleeve on which a magnetic brush is formed so as to contact the surface of the photosensitive drum 61*a*. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 63*a* to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

When the toner is consumed on continuation of the development to lower the T/C ratio, the lowering is detected by a toner concentration detection sensor 85 including an inductance coil (not shown) for detecting a change in permeability of the developer, whereby an amount of replenishing toner 65*a* is supplied corresponding to the amount of consumed toner.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner, a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing device 70 includes, e.g., a pair of a 40 mm-dia. fixing roller 71 and a 30 mm-dia. pressure roller 72. The fixing roller 71 includes internal heating means 75 and 76. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 6, the transfer material-carrying member 68 is an endless belt member and is moved in the direction of an indicated arrow e direction by a drive roller 80 and a follower roller 8 During the movement, the transfer belt 68 is subjected to operation of a transfer belt cleaning device 79 and a belt discharger. In synchronism with the movement of the transfer belt 68, transfer materials are sent out by a supply roller 84 and moved under the control of a pair of registration roller 83.

As transfer means, such a transfer blade abutted against the back side of a transfer material-carrying member can be replaced by other contact transfer means capable of directly supplying a transfer bias voltage while being in contact with the transfer material-carrying member.

Further, instead of the above-mentioned contact transfer means, it is also possible to use a non-contact transfer means, such as a generally used corona charger for applying a transfer bias voltage to the back side of a transfer material-carrying member.

However, in view of the suppressed occurrence of ozone accompanying the transfer bias voltage application, it is preferred to use a contact transfer means.

EXAMPLES

Hereinbelow, the present invention will be described more specifically based on Examples, which however should not be construed to restrict the scope of the present invention.

<1> Production of Toners

<Toner A-1>

Into 710 wt. parts of deionized water, 450 wt. parts of 0.1 mol/l-$Na_3PO_4$ aqueous solution was added, and after being heated to 60° C., the system was stirred at 13000 rpm by a high-speed stirrer ("TK-Homomixer", made by Tokushu Kika Kogyo K.K.). Then, 68 wt. parts of 1ml/1-$CaCl_2$ aqueous solution was gradually added thereto to form an aqueous medium of pH 6 containing calcium phosphate.

On the other hand, the following ingredients:

| | |
|---|---|
| Styrene | 166 wt. parts |
| n-Butyl acrylate | 34 wt. parts |
| Copper phthalocyanine pigment | 10 wt. parts |
| Di-t-butylsalicylic acid Al compound | 1.5 wt. parts |
| Amorphous polyester | 10 wt. parts |
| Monoester wax | 20 wt. parts |
| (Mw = 500, Mn = 400, Mw/Mn = 1.25) | |

were sufficiently dispersed by means of a media dispersing machine at room temperature. After being separated from the dispersion media, the mixture was heated to 60° C. and stirred by means of a high-speed stirrer ("TK-Homomixer") at 13000 rpm for dissolution and dispersion, followed by addition and dissolution of 10 wt. parts of 2,2'-azobis(2,4-dimethylvaleronitrile) to obtain a polymerizable monomer composition.

The thus-prepared monomer composition was charged into the above-prepared aqueous medium under stirring at 11000 rpm by a high-speed stirrer ("CLEAR MIXER" made by Mtechnique K.K.) for 6 min. at 60° C. in an $N_2$-atmosphere to disperse droplets of the monomer composition in the aqueous medium. Thereafter, under stirring of the aqueous medium by a paddle stirrer, the system was heated to 80° C. to effect 5 hours of polymerization while maintaining the pH at 6.2

After completion of the polymerization, the system was cooled, and hydrochloric acid was added thereto to lower the pH to 2, thereby dissolving the calcium phosphate. Thereafter, the polymerizate was filtered out, washed with water, dried and classified to recover polymerizate particles (toner particles).

To 100 wt. parts of the toner particles, the following two types of additives were added, and the resultant mixture was sieved through a 300-mesh screen (opening: 53 μm) to remove coarse particles, thereby obtaining Toner A-1 (a negatively chargeable cyan toner) having a weight-average particle size (D4) of 7.5 μm, and an average circularity (Ca) of 0.98 and a content of 2.0 μm or smaller toner particles (N %(≦2 μm)) of 8.3% by number.

First External Additive:

0.6 wt. part of hydrophobic silica fine powder having a BET specific surface area ($S_{BET}$) of 40 $m^2/g$ and a number-average particle size (D1) of 30 nm, obtained by hydrophobizing 100 wt. parts of silica fine powder in gaseous phase with 10 wt. parts of hexamethyldisilazane.

Second External Additive:

0.7 wt. part of hydrophobic titanium oxide fine powder having $S_{BET}$=95 m /g and D1=35 nm obtained by hydrophobizing 100 wt. parts of titanium oxide fine powder with 100 wt. part of n-octyltrimethoxysilane.

<Toner A-2>

Toner A-2 (a negatively chargeable cyan toner) was prepared in the same manner as Toner A-1 except for using an emulsifier in addition to the calcium phosphate. Toner A-2 exhibited D4=2.8 μm and Ca=0.982 and contained 38.6% by number of toner particles of 2.0 μm or smaller.

<Toner A-3>

Toner A-3 (a negatively chargeable cyan toner) was prepared in the same manner as Toner A-1 except for decreasing the amount of the calcium phosphate to ⅔. Toner A-3 exhibited D4=10.5 μm and Ca=0.968 and contained 7.5% by number of toner particles of 2.0 μm or smaller.

<Toner A-4>

Toner A-4 (a negatively chargeable cyan toner) was prepared in the same manner as Toner A-1 except for omitting the monoester wax from the polymerizable monomer composition. Toner A-4 exhibited D4=7.1 μm and Ca=0.975 and contained 7.9% by number of toner particles of 2.0 μm or smaller.

<Toner A-5>

Toner A-5 (a negatively chargeable cyan toner) was prepared in the same manner as Toner A-1 except for increasing the monoester wax to 85 wt. parts in the polymerizable monomer composition. Toner A-5 exhibited D4=8.1 μm and Ca=0.962 and contained 15.4% by number of toner particles of 2.0 μm or smaller.

<Toner A-6>

Polyester resin formed by polycondensation of terephthalic acid/fumaric acid/trimellitic anhydride/propylene oxide-added bisphenol

| | |
|---|---|
| A derivative | 100 wt. parts |
| Copper phthalocyanine pigment | 5 wt. parts |
| Di-t-butylsalicylic acid Al compound | 2 wt. parts |
| Paraffin wax | 3 " |

The above ingredients were sufficiently preliminarily blended by means of a Henschel mixer and melt-kneaded by a twin-screw extrusion kneader. After being cooled, the melt-kneaded product was coarsely crushed by a hammer mill to ca. 1–2 mm and then finely pulverized by an air jet pulverizer to obtain toner particles having D4=5.8 μm.

The toner particles were blended with the two types of external additives similarly as Toner A-1 to obtain Toner A-6 (a negatively chargeable cyan toner) exhibiting D4=5.8 μm and Ca=0.954 and containing 26.8% by number of toner particles of 2.0 μm or smaller.

<Toner A-7>

Toner A-7 (a negatively chargeable magenta toner) was prepared in the same manner as Toner A-1 except for using 10 wt. parts of quinacridone pigment instead of the copper phthalocyanine. Toner A-7 exhibited D4=7.6 μm and Ca=0.973 and contained 8.8% by number of toner particles of 2.0 μm or smaller.

<Toner A-8>

Toner A-8 (a negatively chargeable yellow toner) was prepared in the same manner as Toner A-1 except for using 10 wt. parts of C.I. Pigment Yellow 17 instead of the copper phthalocyanine. Toner A-8 exhibited D4=7.7 μm and Ca=0.973 and contained 10.1% by number of toner particles of 2.0 μm or smaller.

<Toner A-9>

Toner A-7 (a negatively chargeable black toner) was prepared in the same manner as Toner A-1 except for using 12 wt. parts of carbon black instead of the copper phthalocyanine. Toner A-9 exhibited D4=7.2 μm and Ca=0.977 and contained 7.9% by number of toner particles of 2.0 μm or smaller.

<2> Production of Magnetic Carriers

<Magnetic Carrier A-1>

| | |
|---|---|
| Phenol (= hydroxybenzene) | 50 wt. parts |
| 37 wt. %-Aqueous formalin solution | 80 wt. parts |
| Water | 50 wt. parts |
| Magnetite particles hydrophobized with a silane coupling agent (number-average particle size (D1) = 0.25 μm, Rv (volume-resistivity) = $3 \times 10^5$ ohm · cm) | 320 wt. parts |
| $\alpha$-$Fe_2O_3$ particles hydrophobized with a silane coupling agent (D1 = 0.35 μm, Rv = $6 \times 10^9$ ohm · cm) | 80 wt. parts |
| 15 wt. %-Ammonia water | 15 " |

The above ingredients were placed in a four-necked flask and heated to 85° C. within 50 min. under stirring and reacted for curing for 120 min. at that temperature. Thereafter, the reaction product was cooled to 30° C., and 500 wt. parts of water was added thereto, and after removing the supernatant liquid, the precipitate was washed with water, dried in air and dried at 160° C. under a reduced pressure of 665 Pa (=5 mmHg) for 24 hours to obtain Magnetic carrier core (A) comprising phenolic resin as the binder resin.

Magnetic carrier core (A) was then surface-coated by application of a 3 wt. %-methanol solution of γ-aminopropyltrimethoxysilane represented by formula (6) shown below while vaporizing the methanol under continuous application of a shearing force to the carrier core:

$$NH_2—CH_2CH_2CH_2—Si(OCH_3)_3 \quad (6).$$

The treated Magnetic carrier core (A) was found to be surface-coated with 0.12 wt. %-γ-aminopropyltrimethoxysilane and the presence of

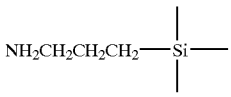

group at the surface was confirmed.

Magnetic carrier core (A) surface-treated with the silane coupling agent still held in the treating machine was continually stirred at 50° C., and a 20 wt. % (solid matter)-conc. solution in toluene of a silicon resin ("SR2410", made by Toray Dow Corning K.K.) was applied thereto under a reduced pressure to form a 5 wt. % of resin coating.

Thereafter, the treated powdery product was stirred for 2 hours in a nitrogen gas atmosphere to evaporate the toluene and subjected to 2 hours of heat treatment at 140° C. After disintegrating the agglomerates, coarse particles of 200 mesh-on (having an opening of 75 μm) was removed to recover Magnetic carrier A-1.

The thus-obtained Magnetic carrier A-1 exhibited a volume-average particle size (Dv)=35 μm, Rv=$8\times10^{13}$ ohm·cm, a saturation magnetization (σs) at 79.6 kA/m (=1000 oersted) of 44 $Am^2/kg$, a residual magnetization ($\sigma_r$) of 5.1 $Am^2/kg$, a true specific gravity ($SG_t$) of 3.70 and a bulk density ($d_v$) of 1.86 $g/cm^3$.

<Magnetic Carrier A-2>

Magnetic carrier A-2 was prepared in the same manner as Magnetic carrier A-1 except for using a ferrite core of Bi—Ni—Zn—Fe instead of Magnetic carrier core (A). Magnetic carrier A-2 exhibited Dv=38 μm, Rv=$5\times10^{11}$ ohm·cm, σs=66 $Am^2/kg$, $\sigma_r$=2.5 $Am^2/kg$, $SG_t$=4.71 and $d_v$=2.35 $g/cm^3$.

<Magnetic Carrier A-3>

| | |
|---|---|
| Polyester resin formed by poly-condensation of terephthalic acid/trimellitic anhydride/propylene oxide-added bisphenol A derivative | 100 wt. parts |
| Magnetite particles (the same as used for production of Magnetic carrier A-1) | 500 wt. parts |
| Quaternary ammonium salt compound | 5 " |

The above ingredients were sufficiently preliminarily blended by a Henschel mixer and melt-kneaded by a twin-screw extrusion kneader. After being cooled, the melt-kneaded product was coarsely crushed to ca. 1–2 mm and finely pulverized by an air jet pulverizer. The pulverizate was classified, and the classified particles in 100 wt. parts were subjected to dry-coating with 0.8 wt. part of styrene/methyl methacrylate copolymer particles of 0.02 μm by means of a Hybridizer (trade name, made by Nara Kikai Seisakusho K.K.) to obtain Magnetic carrier A-3, which exhibited Dv=43 μm, Rv=$4\times10^9$ ohm·cm, σs=52 $Am^2/kg$, $\sigma_r$=4.5 $Am^2/kg$, $SG_t$=4.05 and $d_v$=1.66 $g/cm^3$.

<Magnetic Carrier A-4>

Magnetic carrier core (A) prepared in the production of Magnetic carrier A-1 was subjected to dry-coating with styrene/methyl methacrylate copolymer particles of 0.02 μm by means of a Hybridizer (trade name) similarly as in the production of Magnetic carrier A-3 to prepare Magnetic carrier A-4, which exhibited Dv=38 μm, Rv=$9\times10^{12}$ ohm·cm, σs=41 $Am^2/kg$, $\sigma_r$=5.2 $Am^2/kg$, $SG_t$=3.71 and $d_v$=1.83 $g/cm^3$.

<Magnetic Carrier A-5>

Magnetic carrier A-5 was prepared in the same manner as Magnetic carrier A-3 except for changing the pulverization and classification conditions. Magnetic carrier A-5 exhibited Dv=23 μm, Rv=$1\times10^9$ ohm·cm, σs=50 $Am^2/kg$, $\sigma_r$=4.6 $Am^2/kg$, $SG_t$=4.02 and $d_v$=1.52 $g/cm^3$.

<Magnetic Carrier A-6>

Magnetic carrier A-6 was prepared in the same manner as Magnetic carrier A-3 except for hanging the pulverization and classification conditions. Magnetic carrier A-6 exhibited Dv=53 μm, Rv=$3\times10^9$ ohm·cm, σs=51 $Am^2/kg$, $\sigma_r$=4.7 $Am^2/kg$, $SG_t$=4.02 and $d_v$=1.65 $g/cm^3$.

<3> Production of Photosensitive Members

<Photosensitive Member A-1>

Photosensitive member A-1 (a negatively chargeable photosensitive member using an organic photoconductor) was prepared by coating a 30 mm-dia. aluminum cylinder with 5 functional layers as follows.

First layer was an electroconductive layer, a ca. 20 μm-thick conductor particle-dispersed resin layer for smoothening defects, etc., on the aluminum drum and for preventing the occurrence of moire due to reflection of exposure laser beam.

Second layer was a positive charge injection-preventing layer (primer layer) for preventing a positive charge injected from the Al substrate from dissipating the negative charge imparted by charging the photosensitive member surface and was formed as a ca. 1 μm-thick medium resistivity layer of ca. $10^6$ ohm·cm formed of 6-66-610-12 nylon and methoxymethylated nylon.

Third layer was a charge generation layer, a ca. 0.3 μm-thick resinous layer containing a disazo pigment dispersed in resin, for generating positive and negative charge pairs on receiving exposure laser light.

Fourth layer was a ca. 20 μm-thick charge transport layer formed by dispersing a hydrazone compound in a polycarbonate resin. This is a p-type semiconductor layer, so that the negative charge imparted to the surface of the photosensitive member cannot be moved through the layer but only the positive charge generated in the charge generation layer is transported to the photosensitive member surface.

Fifth layer was a charge injection layer containing electroconductive tin oxide ultrafine powder and ca. 0.25 μm-dia. tetrafluoroethylene resin particles dispersed in a photocurable acrylic resin. More specifically, a liquid composition containing low-resistivity particles of tin oxide in an oxygen-deficient form of ca. 0.3 μm in diameter in 120 wt. parts, tetrafluoroethylene resin particles in 20 wt. parts and a dispersing agent in 1.0 wt. part, respectively per 100 wt. parts of the resin dispersed in the resin, was applied by spray coating, followed by drying and photocuring, to form a ca. 2.5 μm-thick charge injection layer.

The surfacemost layer of the thus-prepared photosensitive member exhibited a lowered volume resistivity of $8\times10^{11}$ ohm·cm compared with $5\times10^{15}$ ohm·cm of the charge transport layer alone.

<4> Production of Charger Magnetic Particles

<Charger Magnetic Particles a>

10 wt. parts of MgO, 10 wt. parts of MnO and 80 wt. parts of $Fe_2O_3$ were respectively formulated into fine particles, and water was added thereto and mixed therewith. The mixture was formed into particles, calcined at 1300° C. and adjusted with respect to particle size to provide ferrite core particles ($\sigma s$=63 $Am^2$/kg) having an average particle size of 22 μm.

The ferrite core particles were surface treated with 0.1 wt. % of isoropoxytriisostearoyl titanate (supplied in a form of ten times dilution with a toluene/water (99/1 by weight) mixture to provide Charger magnetic particles a showing Dv=25.5 μm and Rv=$7\times10^7$ ohm·cm.

Example A-1

The above-prepared Magnetic carrier A-1 in 92 wt. parts and Cyan toner A-1 in 8 wt. parts were blended in a V-shaped blender to prepare Starting Cyan developer A-1.

On the other hand, Magnetic carrier A-1 and Cyan toner A-1 were blended in a weight ratio of 1:19 to provide Replenishing Cyan developer A-1.

A commercially available copying machine ("GP55", made by Canon K.K.) was re-modeled as follows to provide a test copying machine. More specifically, the developing apparatus was re-modeled into a form described with reference to FIGS. 3 and 4 including a developing sleeve having a surface roughness Rz=12.1 μm formed by sand-blasting a 16 mm-dia. SUS sleeve.

Figure 7:
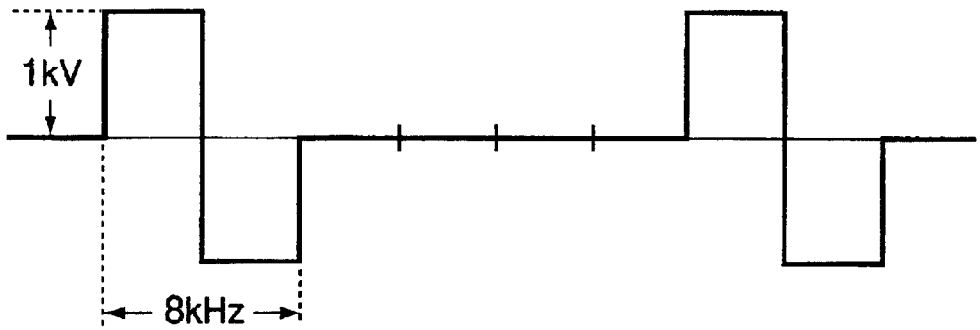
FIG. 7 illustrates an intermittent AC developing bias voltage used in the image forming apparatus of FIG. 5.

The charging member was re-modeled into a magnetic brush charger (130) as illustrated in FIG. 5 comprising Charger magnetic particles a (123) prepared above so that the magnetic brush charge was rotated at a speed of 100% relative to that of and in a direction opposite to the photosensitive member at an abutting position against the photosensitive member. The photosensitive member was charged by applying a superposed voltage of $D_{DC}$ of −700 volts and $V_{AC}$ of 1.5 kHz and 1.2 kVpp. Further, the cleaning unit was removed, and a developing bias voltage having an intermittent waveform as shown in FIG. 7 was applied to the developing sleeve so as to provide a developing contrast of 250 volts and a fog-removal voltage contrast of −180 volts. The fixing device was changed to one comprising a heating roller and a pressure roller respectively surfaced with a 1.2 μm-coating layer of PFA (tetrafluoroethylene-perfluoroalkyl vinyl ether copolymer), and the oil application mechanism was removed therefrom.

For image forming performance evaluation, an original having an image areal percentage of 35% was reproduced on plain paper ("CLC80g", available from Canon Hambai K.K.) at an image-forming speed of 120 mm in environments of 23° C./60% RH (N/N), 23° C./5% RH (N/L) and 32° C./90% RH (H/H), respectively.

Image-forming performances were evaluated with respect to the following items and evaluation results are inclusively shown in Table 1 appearing hereinafter together with those of Examples and Comparative Examples described hereinafter.

[Evaluation Methods and Standards]

(1) Image Density (I.D.)

An original image (5 mm-square solid images having an image density of 1.5) was reproduced on plain paper and the reproduced image was subjected to measurement of image density by using a densitometer ("RD918", made by Macbeth Co.) equipped with an SPI filter. An average of 5 measured values at 4 corners and the center of the image was recorded as an image density.

(2) Halftone Reproducibility (Halftone)

An original image (having an image density of 0.3) was reproduced, and the reproduced image density was measured in the following manner and evaluated according to the following standard.

A: 0.30–0.40

B: 0.25 to below 0.3, or above 0.40 to below 0.45

C: 0.20 to below 0.25, or 0.45 to below 0.50

D: below 0.20, or 0.50 or above (3) Fog

An average reflectance Dr (%) of fresh plain paper was measured by using a reflectometer ("REFLECTOMETER MODEL TC-6DS", made by Tokyo Denshoku K.K.), and an average reflectance Ds (%) of a solid white image formed on the plain paper was also measured to calculate Fog (%) according to the following formula:

$$\text{Fog}(\%)=Dr(\%)-Ds(\%).$$

Based on the measured Fog (%), the evaluation was performed according to the following standard.

A: below 0.4%

B: 0.4% to below 0.8%

C: 0.8% to below 1.2%

D: 1.2% or higher (4) Solid Image Uniformity

Similarly as (1) above, an image density having an image density of 1.5 was reproduced, and a maximum density difference was determined as a difference between a highest image density and a lowest image density among the 5 points of measurements. Based on the measured maximum image density difference. The evaluation was performed according to the following standard.

A: 0.00 to below 0.05

B: 0.05 to below 0.15

C: 0.15 to below 0.25

D: 0.25 or higher

Comparative Example A-1

The preparation of developers and evaluation were performed in the same manner as in Example 1 except for using Cyan toner A-2 instead of Cyan toner A-1.

As shown in Table 1, the image density was 20 lowered and noticeable fog occurred in the respective environments. This may be attributable to inferior toner charge uniformity due to a smaller particle size (D4=2.8 μm).

Comparative Example A-2

The preparation of developers and evaluation were performed in the same manner as in Example 1 except for using Cyan toner A-3 instead of Cyan toner A-1.

As shown in Table 1, the halftone reproducibility was lowered and noticeable fog was observed in the H/H environment. This may be attributable to a lower toner chargeability due to a larger particle size (D4=10.5 μm), thus causing a difficulty in faithful development of latent images.

Comparative Example A-3

The preparation of developers and evaluation were performed in the same manner as in Example 1 except for using Cyan toner A-3 instead of Cyan toner A-1.

The image formation was interrupted after evaluation at the initial stage due to paper winding about the fixing roller. This may be attributable to offsetting due to the absence of wax in the toner. The initially formed images were inferior in halftone reproducibility and solid image uniformity.

Comparative Example A-4

The preparation of developers and evaluation were performed in the same manner as in Example 1 except for using Cyan toner A-5 instead of Cyan toner A-1.

As shown in Table 1, the halftone producibility was lowered, and fog and solid image uniformity became inferior, particularly in the H/H environment. This may be attributable to attachment of toner component (especially, wax) onto the carrier, thus causing charging non-uniformity.

Example A-2

The preparation of developers and evaluation were performed in the same manner as in Example 1 except for using Cyan toner A-6 instead of Cyan toner A-1.

As shown in Table 1, image forming performances were somewhat lowered with a practically acceptable degree in the H/H environment. This may be attributable to a lowering in transferability due to somewhat lower sphericity of the toner.

Comparative Example A-5

The preparation of developers and evaluation were performed in the same manner as in Example 1 except for using Replenishing Cyan developer A-2 prepared by blending Magnetic carrier A-1 and Cyan toner A-1 in a weight ratio of 1:1.

As shown in Table 1, the image density and solid image uniformity became inferior at the time of 500 sheets so that the image formation was interrupted thereafter.

Comparative Example A-6

The preparation of developers and evaluation were performed in the same manner as in Example 1 except for using Replenishing Cyan developer A-3 prepared by blending Magnetic carrier A-1 and Cyan toner A-1 in a weight ratio of 1:60 instead of Replenishing Cyan developer A-1.

As shown in Table 1, fog became noticeable in the respective environments. This may be attributable to insufficient carrier exchange due to a smaller carrier amount in the replenishing developer.

Comparative Example A-7

The preparation of developers and evaluation were performed in the same manner as in Example 1 except for using Magnetic carrier A-2 instead of Magnetic carrier A-1.

As shown in Table 1, noticeable fog occurred in the respective environments. This may be attributable an increased soiling of the carrier with spent toner resulting in non-uniform toner charge due to a larger stress on the developer caused by a larger specific gravity ($SG_t$=4.71).

Example A-3

The preparation of developers and evaluation were performed in the same manner as in Example A-1 except for using Magnetic carrier A-3 instead of Magnetic carrier A-1.

As shown in Table 1, image forming performances were generally good while somewhat inferior in the N/L environment, presumably due to a lower sphericity of the carrier resulting in somewhat lower circularity and lower charge-imparting ability in the developing device.

Example A-4

The preparation of developers and evaluation were performed in the same manner as in Example A-1 except for using Magnetic carrier A-4 instead of Magnetic carrier A-1.

As shown in Table 1, image forming performances were generally good while causing somewhat lower fog suppression, halftone reproducibility and solid image uniformity, presumably due to somewhat lower toner soiling resistance caused by the use of a thermoplastic styrene resin as a coating resin.

Example A-5

The preparation of developers and evaluation were performed in the same manner as in Example A-1 except for using Magnetic carrier A-5 instead of Magnetic carrier A-1.

As shown in Table 1, image forming performances were generally good while somewhat lower in the respective environments presumably due to a smaller carrier particle size causing somewhat inferior circulation in the developer vessel and somewhat irregular developer coating on the developing sleeve.

Example A-6

The preparation of developers and evaluation were performed in the same manner as in Example A-1 except for using Magnetic carrier A-6 instead of Magnetic carrier A-1.

As shown in Table 1, image forming performances were generally good while somewhat lower in the respective environments, presumably due to a larger carrier-particle size causing somewhat lower toner charge imparting ability resulting in liability of non-uniform toner charges.

Example A-7

Full color image formation was performed by using Magenta Toner A-7, Yellow Toner A-8, Cyan Toner A-1 and Black Toner A-9 in an image forming apparatus having an organization described with reference to FIG. 6 formed by remodeling a commercially available full-color image forming apparatus ("CLC1000", made by Canon K.K.) whereby good results were obtained similarly as in Example 1.

(Agglomeratability (Dagg))

400 g of Hydrophobic iron oxide sample powder was placed in a 1 liter-plastic bottle and stored for 5 days in a normal temperature/normal humidity (N/N) environment. The thus-stored sample powder was subjected to measurement by a powder tester (made by Hosokawa Micron K.K.) equipped with a digital vibro-meter ("Digivibro Model 1332"). After vibration for 60 sec, the measured results were substituted in a prescribed formula to calculate an agglomeratability, whereby an agglomeratability below 30% was represented by "L" (indicating a better flowability) and an agglomeratability of 30% or higher is represented by "H" (indicating a worse flowability).

TABLE 1

| Example | Toner | Carrier | Replenishing developer Toner/ Carrier | Image density (D1.5) (initial/after 20000 sheets) N/N | N/L | H/H | Halftone (initial/after 20000 sheets) N/N | N/L | H/H | Fog (initial/after 20000 sheets) N/N | N/L | H/H | Solid image uniformity (initial/after 20000 sheets) N/N | N/L | H/H |
|---|---|---|---|---|---|---|---|---|---|---|---|---|---|---|---|
| A-1 | A-1 | A-1 | 1/19 | 1.51/1.50 | 1.48/1.46 | 1.53/1.55 | A/A | A/A | A/A | A/A | A/A | A/A | A/A | A/A | A/A |
| Comp. A-1 | A-2 | A-1 | 1/19 | 1.32/1.23 | 1.25/1.10 | 1.35/1.40 | A/B | B/B | B/C | B/C | C/D | B/D | B/C | B/D | B/C |
| Comp. A-2 | A-3 | A-1 | 1/19 | 1.50/1.55 | 1.52/1.43 | 1.52/1.57 | B/C | B/C | C/D | A/A | A/A | B/C | B/B | A/A | B/C |
| Comp. A-3* | A-4 | A-1 | 1/19 | 1.43/- | 1.41/- | 1.48/- | D/- | D/- | D/- | A/- | A/- | A/- | D/- | D/- | D/- |
| Comp. A-4 | A-5 | A-1 | 1/19 | 1.50/1.43 | 1.47/1.40 | 1.51/1.62 | B/C | B/B | B/C | B/C | B/C | C/D | B/C | B/B | C/D |
| Comp. A-5* | A-1 | A-1 | 1/1 | 1.51/- | 1.48/- | 1.53/- | A/- | A/- | A/- | A/- | A/- | A/- | A/- | A/- | A/- |
| Comp. A-6 | A-1 | A-1 | 1/60 | 1.51/1.57 | 1.48/1.53 | 1.53/1.61 | A/B | A/B | A/B | B/C | B/D | A/C | B/C | A/C | A/C |
| Comp. A-7 | A-1 | A-2 | 1/19 | 1.45/1.38 | 1.43/1.35 | 1.50/1.42 | B/C | A/C | B/C | B/C | B/D | B/D | B/C | B/C | B/C |
| A-2 | A-6 | A-1 | 1/19 | 1.52/1.55 | 1.45/1.41 | 1.55/1.59 | A/B | A/B | B/C | B/B | B/B | B/C | B/B | B/C | B/C |
| A-3 | A-1 | A-3 | 1/19 | 1.52/1.46 | 1.47/1.41 | 1.55/1.48 | A/B | B/C | B/B | A/B | B/C | B/B | A/B | B/C | B/B |
| A-4 | A-1 | A-4 | 1/19 | 1.50/1.43 | 1.47/1.41 | 1.54/1.59 | A/B | B/C | B/C | A/C | B/C | B/C | A/C | B/C | B/C |
| A-5 | A-1 | A-5 | 1/19 | 1.52/1.50 | 1.47/1.48 | 1.56/1.58 | A/B | A/B | B/B | A/B | A/B | A/C | B/B | B/B | B/C |
| A-6 | A-1 | A-6 | 1/19 | 1.45/1.40 | 1.42/1.35 | 1.56/1.51 | B/B | B/C | B/C | B/C | B/C | B/C | B/C | B/C | B/C |

*In Comparative Example A-3, image formation was interrupted after the initial image evaluation. In Comparative Example A-5, image formation was interrupted after 500 sheets.

Production of Hydrophobic Iron Oxides:

(Hydrophobic Iron Oxide B-1)

Into 57 liter of ferrous sulfate aqueous solution containing 2.4 mol/l of $Fe^{2+}$, 2646 g of magnesium sulfate containing 9% of Mg (as element) and sodium carbonate were added to provide an aqueous solution adjusted at pH 9. Then, 65 liters of 4.4 mol/l-sodium hydroxide aqueous solution was mixed with the above-provided aqueous solution, and air was blown thereinto at a rate of 40 liter/min. at 80° C., to cause crystal growth for 30 min. Into the resultant sodium hydroxide aqueous solution thus containing seed crystal particles, 6.5 liter of ferrous sulfate aqueous having a concentration identical to the one used initially was added, and air was blown thereinto at a rate of 40 liter/min. to complete the oxidation in 6 hours while keeping pH 8–9 and 85° C. by adding sodium hydroxide aqueous solution. The resultant magnetite in the slurry after the reaction was washed, filtered out, dried and pulverized in ordinary manners. The thus-obtained magnetite particles (Magnetite B-1) contained 2.1 wt. % of Mg in total and 0.26 wt. % of Mg exposed at the surface.

Some representative production conditions and results of elementary analysis of the magnetite particles are shown in Tables 2 and 3 together with those of the magnetite particles prepared in the following examples (following the identification of Hydiophobic iron oxide prepared therefrom).

100 wt. parts of the magnetite particles were surface-treated with 0.5 wt. part of γ-glycidyltrimethoxysilane to obtain Hydrophobic iron oxide B-1, which exhibited an average particle size (D1), magnetic properties ($\sigma s$ and $\sigma_r$), a volume resistivity (Rv) and agglomeratability (Dagg) as shown in Table 3. The agglomeratability (Dagg) and volume resistivity (R1) were measured in the following manner.

(Volume Resistivity (Rv))

Figure 8:
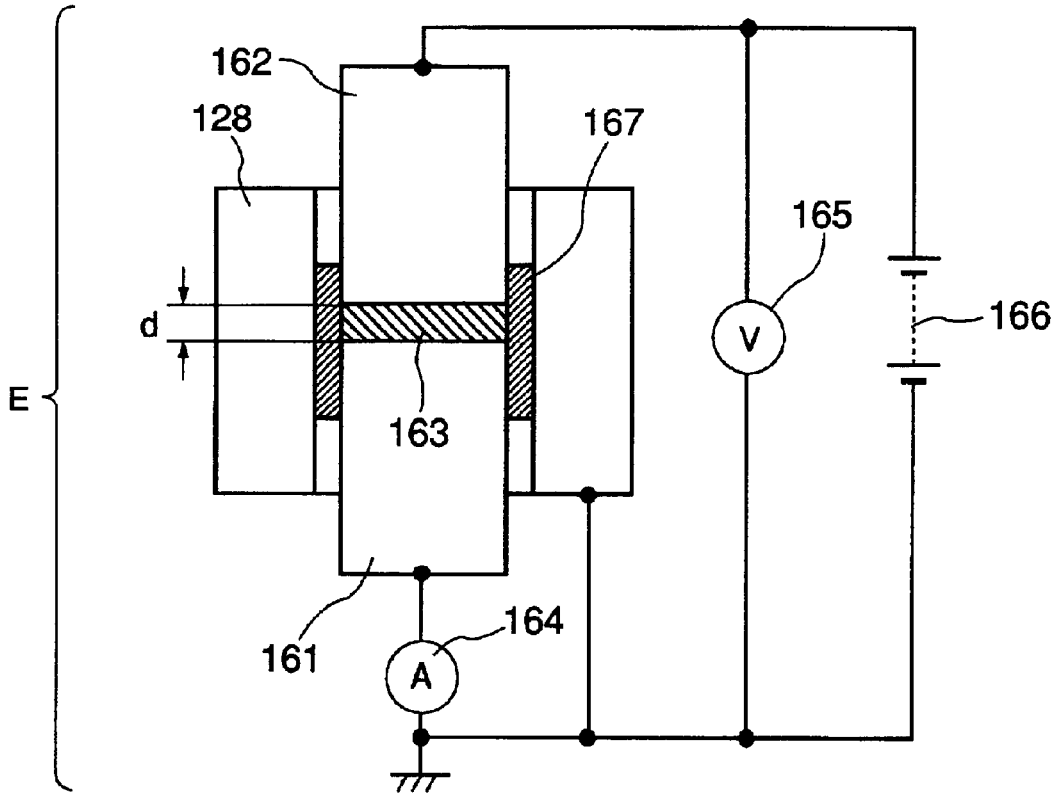
FIG. 8 is a schematic view for illustrating an apparatus for measuring a volume resistivity.

A measuring apparatus ("HI-RESISTANCE METTER 4329A", made by Yokogawa Hewlett Packard K.K.) having an organization as shown in FIG. 8 was used. Referring to FIG. 8, the apparatus include a lower electrode 161, an upper electrode 162, a measurement sample 163, a current meter 164, a voltage meter 165, a constant voltage supply 166 and an insulator 167. Thus, a sample carrier 163 was sandwiched in a thickness d of 2 mm under a load of 1.76 N (180 g) between the lower electrode 161 and the upper electrode 162 each having an electrode area S of 2.3 $cm^2$, and a DC voltage of 100 volts was applied between the electrodes to measure a current passing therethrough by the current meter 164.

The measured results are shown in Table 3 together with those of Hydrophobic iron oxides prepared below.

(Hydrophobic Iron Oxides B-2 to B-19)

Hydrophobic iron oxides B-2 to B-19 were produced respectively in the same manner as Hydrophobic iron oxide B-1 except for changing the amounts of additive elements (Mg, Si, Mn, P), and the amount of alkali for changing pH during the oxidation as shown in Table 2.

(Hydrophobic Iron Oxide B-20)

Into 57 liter of ferrous sulfate aqueous solution containing 2.4 mol/l of $Fe^{2+}$, 1323 g of magnesium sulfate containing 9.9% of Mg (as element) and sodium carbonate were added to provide an aqueous solution adjusted at pH 9. Then, 65 liters of 4.4 mol/l-sodium hydroxide aqueous solution was mixed with the above-provided aqueous solution, and air was blown thereinto at a rate of 40 liter/min. at 80° C., to cause crystal growth for 30 min. Into the resultant sodium hydroxide aqueous solution thus containing seed crystal particles, 6.5 liter of ferrous sulfate aqueous solution having a concentration identical to the one used initially was added, and air was blown thereinto at a rate of 40 liter/min. to proceed with the oxidation while keeping pH 8–9 and 85° C. by adding sodium hydroxide aqueous solution. During the oxidation, the conversion rate was checked by measuring the yet-unreacted ferrous hydroxide concentration, and at a conversion rate of 45%, 10 liter of 0.18 mol/l-nickel sulfate aqueous solution was added in ca. 100 min. to the ferrous hydroxide slurry containing magnetite and still under continuation of oxidation reaction to complete the oxidation in 6 hours. The magnetite in the resultant slurry was recovered, washed, dried and pulverized in ordinary manners. The thus-recovered magnetite particles contained total Mg of 1 wt. %, total Si of 1.1 wt. %, surface-exposed Mg of 0.13 wt.%, surface-exposed Si of 0.13 wt. %, total Si, Mg and Ni of 2.6 wt. %, and exposed Si, Mg and Ni in total of 0.46 wt. %.

100 wt. parts of the thus-obtained magnetite particles were treated with 0.5 wt. part of γ-glycidyltrimethoxysilane to obtain Hydrophobic iron oxide B-20.

(Hydrophobic Iron Oxides B-21 to B-31)

Hydrophobic iron oxides B-21 to B-31 were prepared respectively in the same manner as Hydrophobic iron oxide B-20 except for changing the species and amounts of metal elements (Ni, Zn, Cu, Co, A, Sn, Ti, Zr) and additive elements (Mg, Si, Mn, P).

TABLE 2

| Hydrophobic iron oxide | pH during oxidation | metal species | additive elements (wt. %) Mg total | Mg surface | Si total | Si surface | Mn total | Mn surface | P total | P surface | total |
|---|---|---|---|---|---|---|---|---|---|---|---|
| B-1 | 8–9 | — | 2.1 | 0.26 | 0 | 0 | 0 | 0 | 0 | 0 | 2.1 |
| B-2 | 8–9 | — | 0 | 0 | 2 | 0.25 | 0 | 0 | 0 | 0 | 2 |
| B-3 | 8–9 | — | 0 | 0 | 0 | 0 | 2.2 | 0.26 | 0 | 0 | 2.2 |
| B-4 | 8–9 | — | 0 | 0 | 0 | 0 | 0 | 0 | 2.1 | 0.24 | 2.1 |
| B-5 | 8–9 | — | 1 | 0.13 | 1.1 | 0.14 | 0 | 0 | 0 | 0 | 2.1 |
| B-6 | 8–9 | — | 0.9 | 0.12 | 1 | 0.13 | 1 | 0.12 | 0 | 0 | 2.9 |
| B-7 | 8–9 | — | 2.3 | 0.3 | 2.5 | 0.32 | 0 | 0 | 0 | 0 | 4.8 |
| B-8 | 8–9 | — | 2.8 | 0.36 | 3 | 0.38 | 0 | 0 | 0 | 0 | 5.8 |
| B-9 | 8–9 | — | 0.03 | 0.01 | 0 | 0 | 0 | 0 | 0 | 0 | 0.03 |
| B-10 | 6–7 | — | 1 | 0.24 | 1.1 | 0.23 | 0 | 0 | 0 | 0 | 2.1 |
| B-11 | 9–10 | — | 1 | 0.02 | 1.1 | 0.01 | 0 | 0 | 0 | 0 | 2.1 |
| B-12 | 5–5.8 | — | 1 | 0.29 | 1.1 | 0.31 | 0 | 0 | 0 | 0 | 2.1 |
| B-13 | 10.2–11 | — | 1 | 0 | 1.1 | 0 | 0 | 0 | 0 | 0 | 2.1 |
| B-14 | 8–9 | — | 0.21 | 0.03 | 1.8 | 0.23 | 0 | 0 | 0 | 0 | 2.01 |
| B-15 | 8–9 | — | 0.19 | 0.03 | 1.9 | 0.24 | 0 | 0 | 0 | 0 | 2.09 |
| B-16 | 8–9 | — | 1.8 | 0.23 | 0.21 | 0.02 | 0 | 0 | 0 | 0 | 2.01 |
| B-17 | 8–9 | — | 1.9 | 0.24 | 0.2 | 0.04 | 0 | 0 | 0 | 0 | 2.1 |
| B-18 | 8–9 | — | 0 | 0 | 0 | 0 | 0 | 0 | 0 | 0 | 0 |
| B-19 | 8–9 | — | 0.02 | 0 | 0 | 0 | 0 | 0 | 0 | 0 | 0.02 |
| B-20 | 8–9 | Ni | 1.1 | 0.13 | 1.1 | 0.13 | 0 | 0 | 0 | 0 | 2.2 |
| B-21 | 8–9 | Ni | 0 | 0 | 0 | 0 | 0 | 0 | 0 | 0 | 0 |
| B-22 | 8–9 | Ni | 1.5 | 0.19 | 1.4 | 0.18 | 0 | 0 | 0 | 0 | 2.9 |
| B-23 | 8–9 | Ni | 1.1 | 0.14 | 1.2 | 0.15 | 0 | 0 | 0 | 0 | 2.3 |
| B-24 | 8–9 | Ni, Zn | 1.1 | 0.14 | 1.1 | 0.14 | 0 | 0 | 0 | 0 | 2.2 |
| B-25 | 8–9 | Zn | 1.1 | 0.13 | 1.1 | 0.13 | 0 | 0 | 0 | 0 | 2.2 |
| B-26 | 8–9 | Cu | 1.2 | 0.12 | 1.1 | 0.13 | 0 | 0 | 0 | 0 | 2.3 |
| B-27 | 8–9 | Co | 1.1 | 0.12 | 1.2 | 0.14 | 0 | 0 | 0 | 0 | 2.3 |
| B-28 | 8–9 | Al | 1.2 | 0.12 | 1.1 | 0.13 | 0 | 0 | 0 | 0 | 2.3 |
| B-29 | 8–9 | Sn | 1.1 | 0.13 | 1.1 | 0.12 | 0 | 0 | 0 | 0 | 2.2 |
| B-30 | 8–9 | Ti | 1.1 | 0.14 | 1.2 | 0.12 | 0 | 0 | 0 | 0 | 2.3 |
| B-31 | 8–9 | Zr | 1.1 | 0.13 | 1.1 | 0.13 | 0 | 0 | 0 | 0 | 2.2 |

TABLE 3

| Hydrophobic iron oxide | metal elements (wt. %) total | metal elements (wt. %) surface | additive and metal elements (wt. %) total | additive and metal elements (wt. %) surface | Properties D1 (μm) | $\sigma_r$ $Am^2/kg$ | $D_{agg}$ | resistivity Rv ohm · cm |
|---|---|---|---|---|---|---|---|---|
| B-1 | 0 | 0 | 2.1 | 0.26 | 0.2 | 3.8 | L | $9 \times 10^5$ |
| B-2 | 0 | 0 | 2 | 0.25 | 0.2 | 4.2 | L | $4 \times 10^5$ |
| B-3 | 0 | 0 | 2.2 | 0.26 | 0.2 | 4.4 | L | $3 \times 10^5$ |
| B-4 | 0 | 0 | 2.1 | 0.24 | 0.2 | 4.2 | L | $2 \times 10^5$ |
| B-5 | 0 | 0 | 2.1 | 0.27 | 0.2 | 3.5 | L | $8 \times 10^5$ |
| B-6 | 0 | 0 | 2.9 | 0.37 | 0.2 | 3.5 | L | $9 \times 10^5$ |
| B-7 | 0 | 0 | 4.8 | 0.62 | 0.2 | 3.5 | L | $7 \times 10^5$ |
| B-8 | 0 | 0 | 5.8 | 0.74 | 0.2 | 3.5 | L | $8 \times 10^5$ |
| B-9 | 0 | 0 | 0.03 | 0.01 | 0.2 | 4.4 | L | $5 \times 10^4$ |
| B-10 | 0 | 0 | 2.1 | 0.47 | 0.2 | 3.8 | H | $6 \times 10^5$ |
| B-11 | 0 | 0 | 2.1 | 0.03 | 0.2 | 7 | L | $8 \times 10^5$ |

TABLE 3-continued

| Hydrophobic iron oxide | metal elements (wt. %) total | metal elements (wt. %) surface | additive and metal elements (wt. %) total | additive and metal elements (wt. %) surface | Properties D1 (μm) | Properties $\sigma_r$ Am²/kg | Properties $D_{agg}$ | Properties resistivity Rv ohm · cm |
|---|---|---|---|---|---|---|---|---|
| B-12 | 0 | 0 | 2.1 | 0.6 | 0.2 | 3.8 | H | $5 \times 10^5$ |
| B-13 | 0 | 0 | 2.1 | 0 | 0.2 | 7.8 | L | $9 \times 10^3$ |
| B-14 | 0 | 0 | 2.01 | 0.26 | 0.2 | 3.6 | L | $8 \times 10^5$ |
| B-15 | 0 | 0 | 2.09 | 0.27 | 0.2 | 3.8 | L | $6 \times 10^5$ |
| B-16 | 0 | 0 | 2.01 | 0.25 | 0.2 | 3.5 | L | $5 \times 10^5$ |
| B-17 | 0 | 0 | 2.1 | 0.28 | 0.2 | 3.8 | L | $3 \times 10^4$ |
| B-18 | 0 | 0 | 0 | 0 | 0.2 | 8.4 | H | $4 \times 10^3$ |
| B-19 | 0 | 0 | 0.02 | 0 | 0.2 | 7.8 | H | $5 \times 10^3$ |
| B-20 | 0.4 | 0.2 | 2.6 | 0.46 | 0.2 | 3.1 | L | $4 \times 10^6$ |
| B-21 | 0.5 | 0.2 | 0.5 | 0.2 | 0.2 | 7.7 | L | $7 \times 10^5$ |
| B-22 | 2.7 | 1.08 | 5.6 | 1.45 | 0.2 | 3.3 | L | $7 \times 10^5$ |
| B-23 | 3.2 | 1.28 | 5.5 | 1.57 | 0.2 | 3.3 | L | $6 \times 10^5$ |
| B-24 | 0.9 | 0.4 | 3.1 | 0.68 | 0.2 | 2.8 | L | $7 \times 10^5$ |
| B-25 | 0.4 | 0.2 | 2.6 | 0.46 | 0.2 | 3.1 | L | $8 \times 10^5$ |
| B-26 | 0.4 | 0.2 | 2.7 | 0.45 | 0.2 | 3.1 | L | $6 \times 10^5$ |
| B-27 | 0.2 | 0.1 | 2.5 | 0.36 | 0.2 | 3.1 | L | $9 \times 10^5$ |
| B-28 | 0.3 | 0.1 | 2.6 | 0.35 | 0.2 | 3 | L | $7 \times 10^5$ |
| B-29 | 0.5 | 0.2 | 2.7 | 0.45 | 0.2 | 3.2 | L | $8 \times 10^5$ |
| B-30 | 0.4 | 0.2 | 2.7 | 0.46 | 0.2 | 3.2 | L | $6 \times 10^5$ |
| B-31 | 0.5 | 0.2 | 2.7 | 0.46 | 0.2 | 3.2 | L | $7 \times 10^5$ |

Production of Carriers

[Carrier B-1]

| | |
|---|---|
| Phenol (= hydroxybenzene) | 50 wt. parts |
| 37 wt. %-Aqueous formalin solution | 80 wt. parts |
| Water | 50 wt. parts |
| Hydrophobic iron oxide B-1 | 600 wt. parts |
| 15 wt. %-Ammonia water | 15 " |

The above ingredients were placed in a four-necked flask and heated to 85° C. within 60 min. under stirring and reacted for curing for 120 min. at that temperature. Thereafter, the reaction product was cooled to 30° C., and 500 wt. parts of water was added thereto, and after removing the supernatant liquid, the precipitate was washed with water, dried in air and dried at 150–180° C. under a reduced pressure of 5 mmHg for 24 hours to obtain Magnetic carrier core comprising phenolic resin as the binder resin.

The magnetic carrier core was then surface-coated by application of a 5 wt. %-toluene solution of y-aminopropyltrimethoxysilane while vaporizing the toluene under continuous application of a shearing force to the carrier core. The treated magnetic carrier core was found to be surface-coated with 0.2 wt. %-γ-aminopropyltrimethoxysilane and the presence of

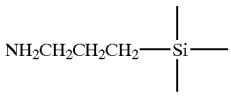

group at the surface was confirmed.

The magnetic carrier core surface-treated with the silane coupling agent still held in the treating machine was continually stirred at 70° C., and a 20 wt. % (solid matter)-conc. solution in toluene of a mixture of silicone resin ("KR-221", made by Shin-Etsu Kagaku Kogyo K.K.) and γ-aminopropyltri-methoxysilane in 3 wt. % of the silicone resin solid matter was applied thereto under a reduced pressure to form a resin coating of 0.8 wt. part per 100 wt. parts of the carrier core.

Thereafter, the treated powdery product was stirred for 2 hours in a nitrogen gas atmosphere to evaporate the toluene and subjected to 2 hours of heat treatment at 140° C. After disintegrating the agglomerates, coarse particles of 200 mesh-on (having an opening of 75 μm) was removed to recover Carrier B-1 having properties as shown in Table 4, wherein properties of Carriers prepared in the following production examples are also shown.

[Carriers B-2 to B-31]

Carriers B-2 to B-31 having properties shown in Table 4 were prepared in similar manners as Carrier B-1 except for using Hydrophobic iron oxides B-2 to B-31, respectively, instead of Hydrophobic iron oxide B-1.

[Carrier B-32]

Carrier B-32 having properties shown in Table 4 was prepared in a similar manner as Carrier B-1 except for using Magnetite B-1 instead of Hydrophobic iron oxide B-1.

[Carrier B-33]

Carrier B-33 having properties shown in Table 4 was prepared in a similar manner as Carrier B-1 except for using 540 wt. parts of Hydrophobic iron oxide B-1 and 60 wt. parts of hydrophobized hematite having an average particle size (D1) of 0.35 μm instead of the 600 wt. parts of Hydrophobic iron oxide B-1.

[Carrier B-34]

Carrier B-34 having properties shown in Table 4 was prepared in a similar manner as Carrier B-1 except for using 420 wt. parts of Hydrophobic iron oxide B-1 and 120 wt. parts of hydrophobized hematite (D1=0.35 μm) instead of the 600 wt. parts of Hydrophobic iron oxide B-1.

[Carrier B-35]

Carrier B-35 having properties shown in Table 4 was prepared in a similar manner as Carrier B-1 except for omitting the coating with the silicone resin.

[Carrier B-36]

Carrier B-36 having properties shown in Table 4 was prepared in a similar manner as Carrier B-1 except for omitting the coating with the γ-aminopropyltrimethoxysilane.

[Carriers B-37 to B-39]

Carriers B-37 to B-39 having properties shown in Table 4 were prepared in similar manners as Carrier B-1 except for using Hydrophobic iron oxide B-9 instead of Hydrophobic iron oxide B-1 and further changing the stirring speed for the carrier core formation.

[Carriers B-40 to B-42]

Carriers B-40 to B-42 having properties shown in Table 4 were prepared in similar manners as Carrier B-1 except for using Hydrophobic iron oxide B-28 instead of Hydrophobic iron oxide B-1, and further changing the stirring speed for the carrier core formation.

Incidentally, Table 4 lists two types of measured volume resistivity (Rv) values. That is, values outside the parentheses were measured by using an insulating resistance meter (made by Shinku Riko K.K.) in a manner as described in a former part of this specification, and values in the parentheses were measured by using a measuring apparatus ("HI-RESISTANCE METER 3229A"), made by Yokogawa Hewlett Packard K.K.) similarly as the values shown in Table 3.

TABLE 4

| | | Carrier properties | | | | | | | |
|---|---|---|---|---|---|---|---|---|---|
| Carrier | Hydrophobic iron oxide | Dv (=d) μm | $\sigma_{1000}$ $Am^2/kg$ | $\sigma_r$ $Am^2/kg$ | $d/\sigma_r$ | B/A | $SG_r$ | SF-1 | Resistivity $R_v$ Ω · cm |
| B-1 | B-1 | 35 | 64 | 3.7 | 9.5 | 1.07 | 3.7 | 109 | $7 \times 10^9$ ($3 \times 10^{10}$) |
| B-2 | B-2 | 36 | 65 | 4.1 | 8.8 | 1.09 | 3.6 | 110 | $1 \times 10^{10}$ ($4 \times 10^{10}$) |
| B-3 | B-3 | 34 | 63 | 4.3 | 7.9 | 1.1 | 3.7 | 111 | $9 \times 10^9$ ($4 \times 10^{10}$) |
| B-4 | B-4 | 36 | 64 | 4.0 | 9.0 | 1.09 | 3.7 | 111 | $2 \times 10^9$ ($6 \times 10^9$) |
| B-5 | B-5 | 35 | 65 | 3.4 | 10.3 | 1.04 | 3.7 | 107 | $1 \times 10^{10}$ ($4 \times 10^{10}$) |
| B-6 | B-6 | 37 | 66 | 3.4 | 10.9 | 1.04 | 3.6 | 109 | $8 \times 10^9$ ($4 \times 10^{10}$) |
| B-7 | B-7 | 36 | 66 | 3.4 | 10.6 | 1.07 | 3.6 | 109 | $2 \times 10^{10}$ ($6 \times 10^{10}$) |
| B-8 | B-8 | 37 | 64 | 3.4 | 10.9 | 1.1 | 3.6 | 111 | $3 \times 10^{10}$ ($7 \times 10^{10}$) |
| B-9 | B-9 | 36 | 64 | 4.3 | 8.4 | 1.45 | 3.7 | 112 | $7 \times 10^8$ ($3 \times 10^9$) |
| B-10 | B-10 | 36 | 60 | 3.7 | 9.7 | 1.1 | 3.6 | 116 | $1 \times 10^{10}$ ($5 \times 10^{10}$) |
| B-11 | B-11 | 35 | 55 | 6.9 | 5.1 | 1.1 | 3.6 | 110 | $2 \times 10^{10}$ ($6 \times 10^{10}$) |
| B-12 | B-12 | 34 | 65 | 3.7 | 9.2 | 1.15 | 3.8 | 125 | $9 \times 10^8$ ($4 \times 10^9$) |
| B-13 | B-13 | 36 | 50 | 7.7 | 4.7 | 1.51 | 3.6 | 109 | $3 \times 10^8$ ($7 \times 10^8$) |
| B-14 | B-14 | 37 | 65 | 3.5 | 10.6 | 1.5 | 3.8 | 107 | $2 \times 10^{10}$ ($6 \times 10^{10}$) |
| B-15 | B-15 | 36 | 64 | 3.7 | 9.7 | 1.1 | 3.7 | 109 | $3 \times 10^{10}$ ($7 \times 10^{10}$) |
| B-16 | B-16 | 36 | 63 | 3.4 | 10.6 | 1.09 | 3.6 | 109 | $8 \times 10^9$ ($4 \times 10^{10}$) |
| B-17 | B-17 | 34 | 66 | 3.7 | 9.2 | 1.1 | 3.6 | 111 | $8 \times 10^9$ ($3 \times 10^{10}$) |
| B-18 | B-18 | 35 | 66 | 8.2 | 4.3 | 2.3 | 3.7 | 128 | $7 \times 10^7$ ($2 \times 10^8$) |
| B-19 | B-19 | 34 | 60 | 7.7 | 4.4 | 1.8 | 3.8 | 125 | $1 \times 10^8$ ($5 \times 10^8$) |
| B-20 | B-20 | 36 | 65 | 3.0 | 12.0 | 1.03 | 3.7 | 106 | $6 \times 10^9$ ($1 \times 10^{10}$) |
| B-21 | B-21 | 35 | 60 | 7.6 | 4.6 | 1.8 | 3.8 | 123 | $2 \times 10^8$ ($6 \times 10^8$) |
| B-22 | B-22 | 36 | 63 | 3.2 | 11.3 | 1.05 | 3.7 | 107 | $1 \times 10^{10}$ ($5 \times 10^{10}$) |
| B-23 | B-23 | 35 | 50 | 3.2 | 10.9 | 1.2 | 3.7 | 120 | $1 \times 10^{10}$ ($4 \times 10^{10}$) |
| B-24 | B-24 | 34 | 66 | 2.9 | 11.7 | 1.05 | 3.7 | 105 | $8 \times 10^{10}$ ($2 \times 10^{11}$) |
| B-25 | B-25 | 37 | 65 | 3.0 | 12.3 | 1.04 | 3.7 | 106 | $1 \times 10^{10}$ ($5 \times 10^{10}$) |
| B-26 | B-26 | 36 | 64 | 3.0 | 12.0 | 1.05 | 3.8 | 107 | $9 \times 10^9$ ($4 \times 10^{10}$) |
| B-27 | B-27 | 37 | 64 | 3.0 | 12.3 | 1.05 | 3.7 | 106 | $2 \times 10^{10}$ ($6 \times 10^{10}$) |
| B-28 | B-28 | 35 | 65 | 2.9 | 12.1 | 1.04 | 3.6 | 106 | $3 \times 10^{10}$ ($7 \times 10^{10}$) |
| B-29 | B-29 | 35 | 66 | 3.1 | 11.3 | 1.04 | 3.8 | 106 | $3 \times 10^{10}$ ($8 \times 10^{10}$) |
| B-30 | B-30 | 34 | 64 | 3.1 | 11.0 | 1.05 | 3.6 | 105 | $8 \times 10^9$ ($3 \times 10^{10}$) |
| B-31 | B-31 | 35 | 64 | 3.1 | 11.3 | 1.04 | 3.8 | 107 | $9 \times 10^9$ ($4 \times 10^{10}$) |
| B-32 | magnetite B-1 | 34 | 65 | 4.2 | 8.1 | 1.45 | 3.8 | 118 | $7 \times 10^9$ ($2 \times 10^{10}$) |
| B-33 | B-1 + hematite | 35 | 57 | 3.7 | 9.5 | 1.06 | 3.6 | 110 | $4 \times 10^{12}$ ($8 \times 10^{12}$) |
| B-34 | B-1 + hematite | 36 | 46 | 3.0 | 12.0 | 1.11 | 3.6 | 111 | $5 \times 10^{13}$ ($9 \times 10^{13}$) |
| B-35 | B-1 | 36 | 66 | 4.1 | 8.8 | 1.11 | 3.6 | 112 | $7 \times 10^9$ ($1 \times 10^{10}$) |
| B-36 | B-1 | 35 | 64 | 4.3 | 8.1 | 1.09 | 3.6 | 109 | $7 \times 10^9$ ($2 \times 10^{10}$) |
| B-37 | B-9 | 8 | 64 | 7.2 | 1.1 | 1.05 | 3.6 | 114 | $1 \times 10^{10}$ ($5 \times 10^{10}$) |
| B-38 | B-9 | 11 | 65 | 7.1 | 1.5 | 1.06 | 3.6 | 115 | $2 \times 10^{10}$ ($6 \times 10^{10}$) |
| B-39 | B-9 | 6.5 | 64 | 7.1 | 0.9 | 1.03 | 3.7 | 109 | $3 \times 10^{10}$ ($7 \times 10^{10}$) |
| B-40 | B-28 | 75 | 65 | 2.9 | 25.9 | 1.45 | 3.8 | 110 | $1 \times 10^{10}$ ($4 \times 10^{10}$) |
| B-41 | B-28 | 50 | 65 | 2.8 | 17.9 | 1.2 | 3.6 | 108 | $1 \times 10^{10}$ ($5 \times 10^{10}$) |
| B-42 | B-28 | 90 | 64 | 2.9 | 31.0 | 1.57 | 3.7 | 109 | $8 \times 10^9$ ($3 \times 10^{10}$) |

(Toner B-1)

Into 710 wt. parts of deionized water, 450 wt. parts of 0.1 mol/l-$Na_3PO_4$ aqueous solution was added, and after being heated to 60° C., the system was stirred at 13000 rpm by a high-speed stirrer ("TK-Homomixer", made by Tokushu Kika Kogyo K.K.). Then, 68 wt. parts of 1.0 ml/l-$CaCl_2$ aqueous solution was gradually added thereto to form an aqueous medium of pH 6 containing $Ca_3(PO_4)_2$.

| | |
|---|---|
| Styrene | 160 wt. parts |
| n-Butyl acrylate | 34 wt. parts |
| Copper phthalocyanine pigment | 12 wt. parts |
| Di-t-butylsalicylic acid metal compound | 2 wt. parts |
| Saturated polyester (acid value = 10 mgKOH/g, peak molecular weight = 8500) | 10 wt. parts |
| Monoester wax | 20 wt. parts |

(Mw=500, Mn=400, Mw/Mn=1.25, melting point=69° C., vickers hardness=1.1, solubility parameter (SP) value=8.6)

The above ingredients were heated to 60° C. and stirred by means of a high-speed stirrer ("TK-Homomixer") at 12000 rpm for dissolution and dispersion, followed by addition and dissolution of 10 wt. parts of 2,2'-azobis(2,4-dimethylvaleronitrile) to obtain a polymerizable monomer composition.

The thus-prepared monomer composition was charged into the above-prepared aqueous medium under stirring at 10000 rpm by a high-speed stirrer ("CLEAR MIXER" made by Mtechnique K.K.) for 10 min. at 60° C. in an $N_2$-atmosphere to disperse droplets of the monomer composition in the aqueous medium. Thereafter, under stirring of the aqueous medium by a paddle stirrer, the system was heated to 80° C. to effect 10 hours of polymerization while maintaining the pH at 6.

After completion of the polymerization, the system was cooled, and hydrochloric acid was added thereto to lower the pH to 2, thereby dissolving the calcium phosphate. Thereafter, the polymerizate was filtered out, washed with water, dried and classified to recover polymerizate particles (Toner particles B-1).

The thus-obtained polymerizate particles were found to contain 8.4 wt. parts of the monoester wax per 100 wt. parts of the binder resin and have a core-shell structure wherein the wax was enclosed within an outer shell resin layer as a result of observation of a polymer particle section through a transmission electromicroscope (TEM).

The toner particles exhibited D4=7.3 μm, and the binder resin exhibited SP value=19 and Tg=60° C.

To 100 wt. parts of the toner particles, the following three types of additives were added, and the resultant mixture was sieved through a 330-mesh screen (opening: 43 μm) to remove coarse particles, thereby obtaining Toner B-1 (a negatively chargeable cyan toner) having D4=7.3 μm.

(1) First Hydrophobic Silica Fine Powder 0.3 wt. Part ($S_{BET}$=170 $m^2/g$, D1=12 nm, formed by hydrophobizing 100 wt. parts of silica fine powder in gaseous phase with 20 wt. parts of hexamethyl-disilazane).

(2) Second Hydrophobic Silica Fine Powder 0.7 wt. Part ($S_{BET}$=70 $m^2/g$, D1=30 nm, formed by hydrophobizing 100 wt. parts of silica fine powder in gaseous phase with 10 wt. parts of hexamethyl-disilazane).

(3) Hydrophobic Titanium Oxide Fine Powder 0.4 wt. Part ($S_{BET}$=100 $m^2/g$, D1=45 nm, formed by hydrophobizing 100 wt. parts of titanium oxide fine powder in aqueous medium with 10 wt. parts of isobutyltrimethoxysilane.

(Toner B-2)

Toner B-2 (magenta toner) was prepared in the same manner as Toner B-1 except for using 7 wt. parts of quinacridone pigment instead of the copper-phthalocyanine pigment. Toner B-2 exhibited D4=7.3 μm.

(Toner B-3)

Toner B-3 (yellow toner) was prepared in the same manner as Toner B-1 except for using 2 wt. parts of C.I. Pigment Yellow 180 and 3 wt. parts of Solvent Yellow 163 instead of the copper-phthalocyanine pigment. Toner B-2 exhibited D4=7.2 μm.

(Toner B-2)

Toner B-4 (black toner) was prepared in the same manner as Toner B-1 except for using 6 wt. parts of carbon black instead of the copper phthalocyanine pigment instead of the copper-phthalocyanine pigment. Toner B-2 exhibited D4=7.4 μm.

Example B-1

Toner B-1 in 7 wt. parts and Carrier B-1 in 93 wt. parts were blended in a V-shaped blender to prepare a starting developer, and Toner B-1 in 19 wt. parts and Carrier B-1 in 1 wt. part were blended in a V-shaped blender to prepare a replenishing developer.

A commercially available copying machine ("GP55", made by Canon K.K. was re-modeled as follows to provide a test copying machine. More specifically, the developing apparatus was re-modeled into a foam described with reference to FIGS. 3 and 4 including a developing sleeve having a surface roughness Rz=12.1 μm formed by sandblasting a 16 mm-dia. SUS sleeve.

The charging member was re-modeled into a magnetic brush charger (130) as illustrated in FIG. comprising Charger magnetic particles a (123) prepared above the magnetic brush charge was rotated at a speed of 100% relative to that of and in a direction opposite to the photosensitive member at an abutting position against the photosensitive member. The photosensitive member was charged by apply a superposed voltage of $V_{DC}$ of −700 volts and VAC of 1.5 kHz and 1.2 kVpp. Further, the cleaning unit was removed, and a developing bias voltage having an intermittent waveform as shown in FIG. 7 was applied to the developing sleeve so as to provide a developing contrast of 250 volts and a fog-removal voltage contrast of −180 volts. The fixing device was changed to one comprising a heating roller and a pressure roller respectively surfaced with a 1.2 μm-coating layer of PFA (tetrafluoroethylene-perfluoroalkyl vinyl ether copolymer), and the oil application mechanism was removed therefrom.

Image forming performances were evaluated in a continuous image formation on 20,000 sheets, wherein an original having an image areal percentage of 50% was reproduced on plain paper ("CLC80g", available from Canon Hambai K.K.) at an image-forming speed of 120 mm in environments of 23° C./60% RH (N/N), 23° C./5% RH (N/L) and 32.5° C./90% RH (H/H), respectively.

Performances were evaluated with respect to the following items and evaluation results are inclusively shown in Tables 5 and 6 appearing hereinafter together with those of Examples and Comparative Examples described hereinafter.

[Evaluation Methods and Standards]

Image Density (I.D.):

An original image a solid image having an image density of 1.5) was reproduced on plain paper and the reproduced image was subjected to measurement of image density by using a densitometer ("RD918", made by Macbeth Co.) equipped with an SPI filter.

Fog:

An average reflectance Dr (%) of fresh plain paper was measured by using a reflectometer ("REFLECTOMETER MODEL TC-6DS", made by Tokyo Denshoku K.K.), and an average reflectance Ds (%) of a solid white image formed on the plain paper was also measured. For the measurement of Ds and Dr, the papers were placed on 5 sheets of fresh paper so as to remove the influence of the ground. Fog was calculated according to the following formula:

$$\text{Fog}\ (\%)=Dr\ (\%)-Ds\ (\%).$$

Based on the measured Fog (%), the evaluation was performed according to the following standard.

A: below 0.4%

B: 0.4% to below 0.8%

C: 0.8% to below 1.2%

D: 1.2% to below 1.6%

E: 1.6% or higher

Highlight Image Quality (Highlight):

An original image (having an image density of 0.3) was reproduced, and the reproduced image density was measured in the following manner and evaluated according to the following standard.

A: 0.30–0.40

B: 0.25 to below 0.3, or above 0.40 to below 0.45

C: 0.20 to below 0.25, or 0.45 to below 0.50

D: 0.15 to below 0.20, or 0.50 to below 0.55

E: below 0.15, or 0.55 or above

Toner Scattering:

The degree of toner scattering from the developing device after image formation 20,000 sheets was observed with eyes and evaluated according to the following standard.

A: Substantially no toner scattering wax observed.

B: Slight toner scattering was observed.

C: Toner scattering was observed but did not affect the images, and cleaning of the developing device was not required.

D: Toner scattering was observed but did not affect the images in the image formation 20,000 sheets. However, cleaning of the developing device was necessary.

E: Toner scattering was observed, and image soiling occurred and cleaning of the developing device was required frequently during image formation on 20,000 sheets.

Image dropout due to scars on the photosensitive drum.

The photosensitive drum surface after image formation on 20,000 sheets was observed through a scanning electron microscope with respect to presence of scars due to the carrier, and the influences thereof on the image quality were evaluated with eyes according to the following standard.

A: No scars on the photosensitive drum surface, and no image dropout.

B: Slight scars were observed on the photosensitive drum surface, but no image dropout was observed.

C: Substantial scars were observed on the photosensitive drum surface, but no image dropout was observed.

D: Slight image dropout was observed at highlight image parts, but no defect was recognized at character image parts, thus being judged as practically of no problem.

E: Image dropouts were observed even at character image parts.

Examples B-2 to B-7

The preparation of developers and evaluation were performed in the same manner as in Example B-1 except for using Carriers B-2 to B-7 instead of Carrier B-1 whereby good results were obtained as shown in Tables 5 and 6.

Example B-8

The preparation of developers and evaluation were performed in the same manner as in Example B-1 except for using Carrier B-8 instead of Carrier B-1. As a result, fog and scattering in the H/H environment were somewhat inferior than Example B-1, presumably because the hygroscopicity of the carrier was increased due to increased Si and Mg contents in the magnetic material, thus resulting in somewhat lower environmental stability in a high humidity environment.

Examples B-9 to B-11

The preparation of developers and evaluation were performed in the same manner as in Example B-1 except for using Carriers B-9 to B-11 instead of Carrier B-1, whereby good results were obtained as shown in Tables 5 and 6.

Example B-12

The preparation of developers and evaluation were performed in the same manner as in Example B-1 except for using Carrier B-12 instead of carrier B-1. As a result, fog and toner scattering were somewhat inferior than Example B-1, presumably because the hydrophobic iron oxide lacked surface-exposed Mg or Si and the dispersion thereof in the carrier to provide a larger SF-1 value of the carrier leading to a somewhat lower toner charging ability.

Example B-13

The preparation of developers and evaluation were performed in the same manner as in Example B-1 except for using Carrier B-13 instead of Carrier B-1. As a result, fog and toner scattering were somewhat inferior than in Example B-1. Further, image dropout due to scars on the photosensitive drum were observed but character images were not affected. The results were presumably due to a lower saturation magnetization and larger residual magnetization causing a lower flowability of the carrier due to smaller contents of Mg and Si in the hydrophobic iron oxide.

Example B-14

The preparation of developers and evaluation were performed in the same manner as in Example B-1 except for using Carrier B-14 instead of Carrier B-1, whereby good results as shown in Tables 5 and 6 were obtained.

Example B-15

The preparation of developers and evaluation were performed in the same manner as in Example B-1 except for using Carrier B-15 instead of Carrier B-1. As a result, fog and toner scattering became somewhat inferior than Example B-1, presumably because of a larger residual magnetic flux density and a lower flowability of the carrier due to a smaller Mg content in the hydrophobic iron oxide.

Example B-16

The preparation of developers and evaluation were performed in the same manner as in Example B-1 except for using Carrier B-16 instead of Carrier B-1.

Example B-17

The preparation of developers and evaluation were performed in the same manner as in Example B-1 except for using Carriers B-2 to B-7 instead of Carrier B-1. As a result, fog and toner scattering became inferior than Example B-1, presumably because of a somewhat larger residual magnetic flux density and a lower flowability of the carrier due to a smaller Si content in the hydrophobic iron oxide.

Example B-18

The preparation of developers and evaluation were performed in the same manner as in Example B-1 except for using Carrier B-18 instead of Carrier B-1. As a result, inferior results were obtained in all the items than Example B-1, but at barely acceptable levels in the image formation on 20,000 sheets, presumably because of a larger B/A value, a larger residual magnetization and inferior flowability due to the lack of the additive element and the metal element in the hydrophobic iron oxide.

Example B-19

The preparation of developers and evaluation were performed in the same manner as in Example B-1 except for using Carrier B-19 instead of carrier B-1. As a result, fog and toner scattering were inferior than Example 1 but at a level of practically no problem, presumably because of a larger B/A value, a larger residual magnetization and inferior flowability due to a smaller Mg content in the hydrophobic iron oxide.

Example 20

The preparation of developers and evaluation were performed in the same manner as in Example B-1 except for using Carrier B-20 instead of Carrier B-1, whereby good results as shown in Tables 5 and 6 were obtained.

Example B-21

The preparation of developers and evaluation were performed in the same manner as in Example B-1 except for using Carrier B-21 instead of Carrier B-1. As a result, fog and toner scattering were inferior than Example B-1 but at a level of no problem at the point of image formation on 20,000 sheets, presumably because of a larger residual magnetization and an inferior flowability due to no addition of Si or Mg.

Example B-22

The preparation of developers and evaluation were performed in the same manner as in Example B-1 except for using Carrier B-22 instead of Carrier B-1, whereby good results as shown in Tables 5 and 6 were obtained.

Example B-23

The preparation of developers and evaluation were performed in the same manner as in Example B-1 except for using Carrier B-23 instead of Carrier B-1. As a result, fog and toner scattering were somewhat inferior than in Example B-1, presumably because of somewhat larger SF-1 value and lower flowability due to a larger content of the metal element obstructing the reaction in carrier particle formation.

Examples B-24 to B-35

The preparation of developers and evaluation were performed in the same manner as in Example B-1 except for using Carriers B-24 to B-35 instead of Carrier B-1, whereby good results were obtained as shown in Tables 5 and 6.

Example B-36

The preparation of developers and evaluation were performed in the same manner as in Example B-1 except for using Carrier B-36 instead of Carrier B-1. As a result, fog and toner scattering became somewhat inferior than in Example B-1, presumably because of a somewhat lower toner charging ability in a high humidity environment due to the omission of carrier surface treatment with aminopropyltrimethoxysilane.

Examples B-37 to B-39

The preparation of developers and evaluation were performed in the same manner as in Example B-1 except for using Toners B-2 to B-4 instead of Toner B-1, whereby good results were obtained as shown in Tables 5 and 6.

Example B-36

The preparation of developers and evaluation were performed in the same manner as in Example B-1 except for using Carrier B-36 instead of Carrier B-1. As a result, fog and toner scattering became somewhat inferior than in Example B-1, presumably because of a somewhat lower toner charging ability in a high humidity environment due to the omission of carrier surface treatment with aminopropyltrimethoxysilane.

Examples B-37 to B-39

The preparation of developers and evaluation were performed in the same manner as in Example B-1 except for using Toners B-2 to B-4 instead of Toner B-1, whereby good results were obtained as shown in Tables 5 and 6.

Examples B-40 to B-41

The preparation of developers and evaluation were performed in the same manner as in Example B-1 except for using Carriers B-37 to B-38 instead of Carrier B-1, whereby good results as shown in Tables 5 and 6 were obtained.

Example B-42

The preparation of developers and evaluation were performed in the same manner as in Example B-1 except for using Carrier B-39 instead of Carrier B-1. As a result, generally rough-touch images were obtained but the character images were at a barely acceptable level, presumably because of a smaller carrier particle size resulting in liability of carrier attachment onto and scars on the photosensitive drum.

Examples B-43 to B-44

The preparation of developers and evaluation were performed in the same manner as in Example B-1 except for using Carriers B-40 to B-41 instead of Carrier B-1, whereby good results as shown in Tables 5 and 6 were obtained.

Example B-45

The preparation of developers and evaluation were performed in the same manner as in Example B-1 except for using Carrier B-42 instead of carrier B-1. As a result, fog and toner scattering were inferior than Example 1 but at a barely acceptable level, presumably because of a larger carrier particle size, resulting in a lower toner charging ability.

TABLE 5

| | | Image density (DI.5) (initial/after 20000 sheets) | | | Highlight (initial/after 20000 sheets) | | | Fog (initial/after 20000 sheets) | | |
|---|---|---|---|---|---|---|---|---|---|---|
| Example | Carrier | N/N | N/L | H/H | N/N | N/L | H/H | N/N | N/L | H/H |
| B-1 | B-1 | 1.51/1.50 | 1.46/1.41 | 1.50/1.58 | A/A | A/A | A/A | A/A | A/A | A/B |
| B-2 | B-2 | 1.50/1.49 | 1.45/1.40 | 1.50/1.59 | A/A | A/A | A/A | A/A | A/A | A/B |
| B-3 | B-3 | 1.51/1.49 | 1.45/1.40 | 1.49/1.59 | A/A | A/A | A/A | A/A | A/A | A/B |
| B-4 | B-4 | 1.49/1.48 | 1.46/1.40 | 1.49/1.59 | A/A | A/A | A/A | A/A | A/A | A/B |

TABLE 5-continued

| | | Image density (DI.5) (initial/after 20000 sheets) | | | Highlight (initial/after 20000 sheets) | | | Fog (initial/after 20000 sheets) | | |
|---|---|---|---|---|---|---|---|---|---|---|
| Example | Carrier | N/N | N/L | H/H | N/N | N/L | H/H | N/N | N/L | H/H |
| B-5 | B-5 | 1.51/1.50 | 1.45/1.41 | 1.50/1.59 | A/A | A/A | A/A | A/A | A/A | A/B |
| B-6 | B-6 | 1.51/1.50 | 1.46/1.42 | 1.50/1.58 | A/A | A/A | A/A | A/A | A/A | A/B |
| B-7 | B-7 | 1.51/1.49 | 1.45/1.38 | 1.47/1.55 | A/A | A/B | A/B | A/A | A/A | B/B |
| B-8 | B-8 | 1.50/1.49 | 1.43/1.35 | 1.49/1.40 | A/A | A/B | B/B | A/B | A/B | B/C |
| B-9 | B-9 | 1.49/1.48 | 1.45/1.36 | 1.51/1.40 | A/B | A/B | A/B | A/B | A/B | B/B |
| B-10 | B-10 | 1.50/1.48 | 1.46/1.36 | 1.51/1.40 | A/A | A/B | A/B | A/B | A/B | B/B |
| B-11 | B-11 | 1.51/1.47 | 1.44/1.37 | 1.50/1.43 | A/B | A/B | A/B | A/B | A/B | B/B |
| B-12 | B-12 | 1.50/1.46 | 1.47/1.35 | 1.45/1.43 | A/B | A/B | B/B | B/B | B/B | B/C |
| B-13 | B-13 | 1.44/1.40 | 1.48/1.27 | 1.40/4.58 | B/C | B/C | B/D | B/C | C/D | C/D |
| B-14 | B-14 | 1.50/1.51 | 1.44/1.41 | 1.51/1.57 | A/A | A/A | A/A | A/A | A/A | A/B |
| B-15 | B-15 | 1.51/1.49 | 1.45/1.40 | 1.49/1.59 | A/A | A/A | A/A | A/A | A/A | A/B |
| B-16 | B-16 | 1.50/1.49 | 1.45/1.42 | 1.50/1.57 | A/A | A/A | A/A | A/A | A/A | A/B |
| B-17 | B-17 | 1.51/1.49 | 1.45/1.40 | 1.49/1.59 | A/A | A/A | A/A | A/A | A/A | A/B |
| B-18 | B-18 | 1.40/1.27 | 1.27/1.10 | 1.50/1.67 | B/D | B/D | B/D | C/C | C/D | C/D |
| B-19 | B-19 | 1.48/1.35 | 1.44/1.28 | 1.38/1.27 | B/C | B/C | B/D | B/C | C/D | C/D |
| B-20 | B-20 | 1.48/1.37 | 1.44/1.29 | 1.38/1.30 | A/A | A/A | A/A | A/A | A/A | A/A |
| B-21 | B-21 | 1.50/1.50 | 1.47/1.43 | 1.51/1.55 | B/C | B/C | B/D | B/C | C/D | C/D |
| B-22 | B-22 | 1.51/1.50 | 1.46/1.42 | 1.50/1.54 | A/A | A/A | A/A | A/A | A/A | A/A |
| B-23 | B-23 | 1.50/1.48 | 1.43/1.25 | 1.51/1.50 | A/A | B/B | B/C | A/A | A/B | B/C |
| B-24 | B-24 | 1.50/1.51 | 1.47/1.44 | 1.51/1.54 | A/A | A/A | A/A | A/A | A/A | A/A |
| B-25 | B-25 | 1.52/1.50 | 1.48/1.45 | 1.53/1.60 | A/A | A/A | A/A | A/A | A/A | A/A |
| B-26 | B-26 | 1.51/1.53 | 1.46/1.42 | 1.49/1.57 | A/A | A/A | A/A | A/A | A/A | A/B |
| B-27 | B-27 | 1.50/1.50 | 1.45/1.41 | 1.52/1.57 | A/A | A/A | A/A | A/A | A/A | A/A |
| B-28 | B-28 | 1.53/1.55 | 1.47/1.44 | 1.54/1.61 | A/A | A/A | A/A | A/A | A/A | A/A |
| B-29 | B-29 | 1.51/1.54 | 1.45/1.40 | 1.51/1.55 | A/A | A/A | A/A | A/A | A/A | A/B |
| B-30 | B-30 | 1.48/1.50 | 1.45/1.41 | 1.48/1.55 | A/A | A/A | A/A | A/A | A/A | A/A |
| B-31 | B-31 | 1.51/1.51 | 1.46/1.43 | 1.52/1.56 | A/A | A/A | A/A | A/A | A/A | A/A |
| B-32 | B-32 | 1.50/1.48 | 1.46/1.36 | 1.51/1.41 | A/A | A/B | A/B | A/B | A/B | B/B |
| B-33 | B-33 | 1.50/1.48 | 1.45/1.41 | 1.51/1.53 | A/A | A/A | A/A | A/A | A/A | A/A |
| B-34 | B-34 | 1.51/1.47 | 1.45/1.40 | 1.51/1.60 | A/A | A/B | A/B | A/A | A/B | A/B |
| B-35 | B-35 | 1.50/1.43 | 1.45/1.40 | 1.50/1.40 | A/A | A/A | B/B | A/B | A/A | A/B |
| B-36 | B-36 | 1.50/1.44 | 1.44/1.34 | 1.50/1.54 | A/A | A/A | B/B | A/B | A/A | B/B |
| B-37 | B-1 | 1.51/1.50 | 1.46/1.41 | 1.50/1.56 | A/A | A/A | A/A | A/A | A/A | A/B |
| B-38 | B-1 | 1.51/1.50 | 1.46/1.39 | 1.50/1.58 | A/A | A/A | A/A | A/A | A/A | A/B |
| B-39 | B-1 | 1.51/1.49 | 1.46/1.41 | 1.50/1.59 | A/A | A/A | A/A | A/A | A/A | A/B |
| B-40 | B-37 | 1.48/1.42 | 1.37/1.30 | 1.48/1.50 | B/B | B/B | B/B | B/B | B/B | B/B |
| B-41 | B-38 | 1.51/1.50 | 1.43/1.38 | 1.50/1.58 | A/B | A/B | A/B | A/B | A/B | A/B |
| B-42 | B-39 | 1.44/1.35 | 1.30/1.21 | 1.37/1.27 | C/D | C/D | C/D | C/D | C/D | C/D |
| B-43 | B-40 | 1.47/1.41 | 1.38/1.30 | 1.46/1.50 | B/B | B/B | B/B | B/B | B/B | B/B |
| B-44 | B-41 | 1.50/1.50 | 1.44/1.39 | 1.48/1.55 | A/B | A/B | A/B | A/B | A/B | A/B |
| B-45 | B-42 | 1.43/1.35 | 1.30/1.20 | 1.36/1.27 | C/D | C/D | C/D | C/D | C/D | C/D |

TABLE 6

| | | Image dropout | | | Toner scattering (after 20000 sheets) | | |
|---|---|---|---|---|---|---|---|
| Example | Carrier | N/N | N/L | H/H | N/N | N/L | H/H |
| B-1 | B-1 | A | B | A | A | A | B |
| B-2 | B-2 | A | B | A | A | A | B |
| B-3 | B-3 | A | B | A | A | A | B |
| B-4 | B-4 | A | B | A | A | A | B |
| B-5 | B-5 | A | A | A | A | A | B |
| B-6 | B-6 | A | A | A | A | A | B |
| B-7 | B-7 | A | B | B | A | A | B |
| B-8 | B-8 | A | B | C | A | B | C |
| B-9 | B-9 | A | B | B | A | B | B |
| B-10 | B-10 | A | B | B | B | B | B |
| B-11 | B-11 | B | B | B | B | B | B |
| B-12 | B-12 | A | A | A | B | B | C |
| B-13 | B-13 | D | D | D | C | C | D |
| B-14 | B-14 | A | A | A | A | A | B |
| B-15 | B-15 | A | A | A | A | A | B |
| B-16 | B-16 | A | A | A | A | A | B |
| B-17 | B-17 | A | A | A | A | A | B |
| B-18 | B-18 | C | C | D | D | D | D |
| B-19 | B-19 | C | C | D | C | C | D |
| B-20 | B-20 | A | A | A | A | A | A |

TABLE 6-continued

| | | Image dropout | | | Toner scattering (after 20000 sheets) | | |
|---|---|---|---|---|---|---|---|
| Example | Carrier | N/N | N/L | H/H | N/N | N/L | H/H |
| B-21 | B-21 | B | C | D | C | C | D |
| B-22 | B-22 | A | B | A | A | A | A |
| B-23 | B-23 | A | B | A | A | B | C |
| B-24 | B-24 | A | A | A | A | A | A |
| B-25 | B-25 | A | A | A | A | A | A |
| B-26 | B-26 | A | A | A | A | A | A |
| B-27 | B-27 | A | A | A | A | A | A |
| B-28 | B-28 | A | B | A | A | A | A |
| B-29 | B-29 | A | A | A | A | A | A |
| B-30 | B-30 | A | A | A | A | A | A |
| B-31 | B-31 | A | A | A | A | A | A |
| B-32 | B-32 | A | B | A | B | B | B |
| B-33 | B-33 | A | A | A | A | A | A |
| B-34 | B-34 | A | B | A | A | A | A |
| B-35 | B-35 | B | A | B | A | A | B |
| B-36 | B-36 | A | A | B | A | A | B |
| B-37 | B-1 | A | B | A | A | A | B |
| B-38 | B-1 | A | B | A | A | A | B |
| B-39 | B-1 | A | B | A | A | A | B |
| B-40 | B-37 | B | B | B | B | B | B |

TABLE 6-continued

| | | Image dropout | | | Toner scattering (after 20000 sheets) | | |
|---|---|---|---|---|---|---|---|
| Example | Carrier | N/N | N/L | H/H | N/N | N/L | H/H |
| B-41 | B-38 | B | B | A | A | A | B |
| B-42 | B-39 | D | D | C | D | D | D |
| B-43 | B-40 | A | A | A | B | B | B |
| B-44 | B-41 | A | A | A | A | A | B |
| B-45 | B-42 | A | A | A | D | D | D |

What is claimed is:

1. A replenishing developer, comprising:

1 wt. part of a carrier and 2–50 wt. parts of a toner, wherein the carrier is a magnetic fine particle-dispersed resin carrier comprising at least inorganic compound particles and a carrier binder resin, the toner has a weight-average particle size of 3 to 10 $\mu$m and contains 1 to 40 wt. % of solid wax, wherein the carrier binder resin comprises a thermosetting resin, wherein the inorganic compound particles comprise magnetite particles containing at least one additive element selected from the group consisting of magnesium, silicon, manganese and phosphorous, and wherein the magnetite particles contain said at least one additive element in a total amount of 0.03–5.0 wt. % based on Fe.

2. A replenishing developer according to claim 1, wherein the carrier binder resin comprises at least a phenolic resin.

3. A replenishing developer according to claim 1, wherein the carrier comprises a carrier core and a resin coating the carrier core.

4. A replenishing developer according to claim 3, wherein the coating resin comprises a silicone resin.

5. A replenishing developer according to claim 3, wherein the carrier core comprise particles produced by polymerization of a polymerizable composition comprising the inorganic compound particles and a monomer providing the binder resin through the polymerization.

6. A replenishing developer according to claim 1, wherein the carrier has a volume-average particle size of 15 to 60 $\mu$m.

7. A replenishing developer according to claim 1, wherein the carrier has a true specific gravity of 2.5 to 4.5.

8. A replenishing developer according to claim 1, wherein the carrier has a magnetization ($\delta_{1000}$) as measured at a magnetic field of 1000/4$\pi$ kA/m of 15–65 $Am^2/kg$ (emu/g), and a residual magnetization ($\delta_r$) of 0.1–20 $Am^2/kg$.

9. A replenishing developer according to claim 8, wherein the carrier has a residual magnetization ($\delta_r$) of 2.9–6.9 $Am^2/kg$.

10. A replenishing developer according to claim 1, wherein the carrier exhibits a flowability A in a magnetized stated and flowability B in a de-magnetized state, satisfying $B/A \leqq 1.5$.

11. A replenishing developer according to claim 10, wherein the carrier exhibits A and B satisfying $B/A \leqq 1.2$.

12. A replenishing developer according to claim 1, wherein the carrier has a residual magnetization $\delta_r$ ($Am^2/kg$) and a volume-average particle size d ($\mu$m) satisfying:

$$1.0 \leqq d/\delta_r < 30.0.$$

13. A replenishing developer according to claim 1, wherein the carrier has a residual magnetization $\delta_r$ ($Am^2/kg$) and a volume-average particle size d ($\mu$m) satisfying:

$$5.1 \leqq d/\delta_r \leqq 12.3.$$

14. A replenishing developer according to claim 1, wherein the magnetite particles contain at least one metal element selected from the group consisting of zinc, copper, nickel, cobalt, aluminum, tin, titanium and zirconium in a total amount of 0.01–3.0 wt. % based on Fe, and both the additive element and the metal element being surface-exposed on the magnetite particles in a total amount of surface-exposed additive element and metal element of 0.01–1.5 wt. % based on Fe.

15. A replenishing developer according to claim 14, wherein the magnetite particles contain the additive element being surface-exposed on the magnetite particles in a total amount of 0.01–0.5 wt. % based on Fe.

16. A replenishing developer according to claim 1, wherein said at least one additive element is divided into a first additive element of magnesium and at least one second additive element selected from the group consisting of silicon, manganese and phosphorous, and said first additive element and said at least one second additive element are contained in the magnetite particles in a weight ratio of 1:9 to 9:1.

17. A replenishing developer according to claim 1, wherein the inorganic compound particles have been surface-treated with a lipophilizing agent.

18. A replenishing developer according to claim 17, wherein the lipophilizing agent is a silane coupling agent.

19. A replenishing developer according to claim 1, wherein the toner comprises toner particles produced by polymerization.

20. A developing method comprising:

developing an electrostatic latent image on an image-bearing member with a two-component developer comprising a toner and carrier stored in a developer vessel, while periodically supplying a replenishing developer to the developer vessel using as the replenishing developer a replenishing developer according to any one of claims 2–13 or 14–19.

21. A developing method, comprising:

developing an electrostatic latent image on an image-bearing member with a two-component developer comprising a toner and a carrier stored in a developer vessel, while periodically supplying a replenishing developer to the developer vessel, wherein the replenishing developer comprises 1 wt. part of a carrier and 2–50 wt parts of a toner, wherein the carrier is a magnetic fine particle-dispersed resin carrier comprising at least inorganic compound particles and a carrier binder resin, the toner has a weight-average particle size of 3 to 10 $\mu$m and contains 1 to 40 wt. % of solid wax, wherein the carrier binder resin comprises a thermosetting resin, wherein the inorganic compound particles comprise magnetite particles containing at least one additive element selected from the group consisting of magnesium, silicon, manganese and phosphorous, and wherein the magnetite particles contain said at least one additive element in a total amount of 0.03–5.0 wt. % based on Fe.

22. A developing method according to claim 21, wherein the replenishing developer is supplied to the developer vessel in response to a toner consumption detected by detecting a toner concentration in the developer vessel.

23. A replenishing developer, comprising:

1 wt. part of a carrier and 2–50 wt. parts of a toner, wherein the carrier is a magnetic fine particle-dispersed resin carrier comprising at least inorganic compound particles and a carrier binder resin, the toner has a weight-average particle size of 3 to 10 $\mu$m and contains 1 to 40 wt. % of solid wax, wherein the carrier has a magnetization ($\delta_{1000}$) as measured at a magnetic field of 1000/4$\pi$ kA/m of 15–65 $Am^2/kg$ (emu/g), and a residual magnetization ($\delta_r$) of 0.1–20 $Am^2/kg$, wherein the inorganic compound particles comprise magnetite particles containing at least one additive element selected from the group consisting of magnesium, silicon, manganese and phosphorous, and wherein the magnetite particles contain said at least one additive element in a total amount of 0.03–5.0 wt. % based on Fe.

24. A replenishing developer according to claim 23, wherein the carrier binder resin comprises at least a phenolic resin.

25. A replenishing developer according to claim 23, wherein the carrier comprises a carrier core and a resin coating the carrier core.

26. A replenishing developer according to claim 25, wherein the coating resin comprises a silicone resin.

27. A replenishing developer according to claim 25, wherein the carrier core comprise particles produced by polymerization of a polymerizable composition comprising the inorganic compound particles and a monomer providing the binder resin through the polymerization.

28. A replenishing developer according to claim 23, wherein the carrier has a volume-average particle size of 15 to 60 $\mu$m.

29. A replenishing developer according to claim 23, wherein the carrier has a true specific gravity of 2.5 to 4.5.

30. A replenishing developer according to claim 23, wherein the carrier has a residual magnetization ($\delta_r$) of 2.9–6.9 $Am^2/kg$.

31. A replenishing developer according to claim 23, wherein the carrier exhibits a flowability A in a magnetized stated and flowability B in a de-magnetized state, satisfying $B/A \leqq 1.5$.

32. A replenishing developer according to claim 31, wherein the carrier exhibits A and B satisfying $B/A \leqq 1.2$.

33. A replenishing developer according to claim 23, wherein the carrier has a residual magnetization $\delta_r$ ($Am^2/kg$) and a volume-average particle size d ($\mu$m) satisfying:

$$1.0 \leqq d/\delta_r < 30.0.$$

34. A replenishing developer according to claim 23, wherein the carrier has a residual magnetization $\delta_r$ ($Am^2/kg$) and a volume-average particle size d ($\mu$m) satisfying:

$$5.1 \leqq d/\delta_r \leqq 12.3.$$

35. A replenishing developer according to claim 23, wherein the magnetite particles contain at least one metal element selected from the group consisting of zinc, copper, nickel, cobalt, aluminum, tin, titanium and zirconium in a total amount of 0.01–3.0 wt. % based on Fe, and both the additive element and the metal element being surface-exposed on the magnetite particles in a total amount of surface-exposed additive element and metal element of 0.01–1.5 wt. % based on Fe.

36. A replenishing developer according to claim 35, wherein the magnetite particles contain the additive element being surface-exposed on the magnetite particles in a total amount of 0.01–0.5 wt. % based on Fe.

37. A replenishing developer according to claim 23, wherein said at least one additive element is divided into a first additive element of magnesium and at least one second additive element selected from the group consisting of silicon, manganese and phosphorous, and said first additive element and said at least one second additive element are contained in the magnetite particles in a weight ratio of 1:9 to 9:1.

38. A replenishing developer according to claim 23, wherein the inorganic compound particles have been surface-treated with a lipophilizing agent.

39. A replenishing developer according to claim 38, wherein the lipophilizing agent is a silane coupling agent.

40. A replenishing developer according to claim 23, wherein the toner comprises toner particles produced by polymerization.

41. A developing method comprising:

developing an electrostatic latent image on an image-bearing member with a two-component developer comprising a toner and carrier stored in a developer vessel, while periodically supplying a replenishing developer to the developer vessel using as the replenishing developer a replenishing developer according to any one of claims 24–40.

42. A developing method, comprising:

developing an electrostatic latent image on an image-bearing member with a two-component developer comprising a toner and a carrier stored in a developer vessel, while periodically supplying a replenishing developer to the developer vessel, wherein the replenishing developer comprises 1 wt. part of a carrier and 2–50 wt parts of a toner, wherein the carrier is a magnetic fine particle-dispersed resin carrier comprising at least inorganic compound particles and a carrier binder resin, the toner has a weight-average particle size of 3 to 10 $\mu$m and contains 1 to 40 wt. % of solid wax, wherein the carrier has a magnetization ($\delta_{1000}$) as measured at a magnetic field of 1000/4$\pi$ kA/m of 15–65 $Am^2/kg$ (emu/g), and a residual magnetization ($\delta_r$) of 0.1–20 $Am^2/kg$, wherein the inorganic compound particles comprise magnetite particles containing at least one additive element selected from the group consisting of magnesium, silicon, manganese and phosphorous, and wherein the magnetite particles contain said at least one additive element in a total amount of 0.03–5.0 wt. % based on Fe.

43. A developing method according to claim 42, wherein the replenishing developer is supplied to the developer vessel in response to a toner consumption detected by detecting a toner concentration in the developer vessel.

* * * * *

UNITED STATES PATENT AND TRADEMARK OFFICE

CERTIFICATE OF CORRECTION

PATENT NO. : 6,936,394 B2
DATED : August 30, 2005
INVENTOR(S) : Kenji Okado et al.

It is certified that error appears in the above-identified patent and that said Letters Patent is hereby corrected as shown below:

Title page,
Item [56], References Cited, FOREIGN PATENT DOCUMENTS,
"3610231 A" should read -- 36-10231 A -- and
"56159654 A" should read -- 56-159654 A --.

Column 1,
Line 38, "JP=A" should read -- JP-A --.

Column 2,
Line 34, "an" should read -- and --; and
Line 50, "having," should read -- having --.

Column 4,
Line 14, "15-6 $\mu$m," should read -- 15-60 $\mu$m, --; and
Line 42, "images" should read -- image --.

Column 5,
Line 34, "particolarly" should read -- particularly --.
Line 59, "$MO.Fe_2O_3$" should read -- $MO \cdot Fe_2O_3$ --; and
Line 60, "$M.Fe_2O_4$" should read -- $M \cdot Fe_2O_4$ --.

Column 8,
Line 50, "an" should read -- a --.

Column 9,
Line 2, "as." should read -- as --; and
Line 39, "at 6 10," should read -- at 6-10, --.

Column 12,
Line 24, "γ-aminopropyltriethoxyslane," should read
-- γ-aminopropyltriethoxysilane, --.

Column 13,
Line 62, "3-8 $\mu$m.," should read -- 3-8 $\mu$m. --.

Column 14,
Line 48, "3 $\mu$m)" should read -- 3.0 $\mu$m) --.

Column 16,
Line 16, "83," should read -- 803, --;
Line 49, "meta-containing" should read -- metal-containing --; and
Line 51, "salts:" should read -- salts; --.

UNITED STATES PATENT AND TRADEMARK OFFICE

CERTIFICATE OF CORRECTION

PATENT NO. : 6,936,394 B2
DATED : August 30, 2005
INVENTOR(S) : Kenji Okado et al.

It is certified that error appears in the above-identified patent and that said Letters Patent is hereby corrected as shown below:

Column 17,
Line 28, “an” should read -- and --.

Column 18,
Line 52, “3-30 mPa.sec.” should read -- 3-30 mPa·sec. --; and
Line 54, “damage” should read -- damaged --.

Column 19,
Line 12, “blended” should read -- blended and --;
Line 35, “use a” should read -- use --; and
Line 64, “inframmability” should read -- inflammability --.

Column 23,
Line 18, “rage” should read -- range --; and
Line 41, “($_{SBET}$)” should read -- ($S_{BET}$) --.

Column 24,
Line 1, “as” should read -- as to --;
Line 4, “represented” should read -- represented in --; and
Line 16, “divinylclorosilane,” should read -- divinylchlorosilane, --.

Column 25,
Line 62, “FIG.” should read -- FIG. 1 --; and
Line 65, “enclose” should read -- encloses --.

Column 28,
Line 2, “of repetition” (first occurrence) should be deleted.

Column 29,
Line 15, “appropriate” should read -- appropriately --;
Line 21, “ordinary” should read -- ordinarily --; and
Line 47, “drum 10” should read -- drum 101. --.

Column 32,
Line 62, “roller 8” should read -- roller 81. --.

Column 33,
Line 26, “1 ml/l-$CaCl_2$” should read -- 1.0 ml/1-$CaCl_2$ --;
Line 28, “pH 6” should read -- pH 6.2 --; and
Line 56, “6.2” should read -- 6.2. --.

UNITED STATES PATENT AND TRADEMARK OFFICE

CERTIFICATE OF CORRECTION

PATENT NO. : 6,936,394 B2
DATED : August 30, 2005
INVENTOR(S) : Kenji Okado et al.

It is certified that error appears in the above-identified patent and that said Letters Patent is hereby corrected as shown below:

Column 34,
Line 11, “95 m/g” should read -- 95 $m^2/g$ --; and
Line 13, “100 wt. part” should read -- 100 wt. parts --.

Column 37,
Line 49, “isoropoxytriisostearoyl” should read -- isopropoxytriisostearoyl --.

Column 38,
Line 24, “32° C./90%” should read -- 32.5° C./90% --.

Column 39,
Line 15, “20” should be deleted.

Column 40,
Line 22, “attributable” should read -- attributable to --.

Column 41,
Line 37, “57 liter” should read -- 57 liters --;
Line 39, “9%” should read -- 9.9% --;
Line 46, “6.5 liter” should read -- 6.5 liters -- and “aqueous” should read -- aqueous solution --; and
Line 60, “Hydiophobic” should read -- Hydrophobic --.

Column 42,
Line 2, “was” should read -- were --;
Line 3, “1 liter-plastic” should read -- 1 liter plastic --;
Line 36, “METTER” should read -- METER --;
Line 39, “include” should read -- includes --;
Line 57, “57 liter” should read -- 57 liters --; and
Line 66, “6.5 liter” should read -- 6.5 liters --.

Column 43,
Line 6, “10 liter” should read -- 10 liters --.

Column 45,
Line 41, “was” should read -- were --;
Line 48, “y-aminopropyltrimethoxysilane” should read -- γ-aminopropyltrimethoxysilane --; and
Line 64, “γ-aminopropyltri-methoxysilane” should read -- γ-aminopropyltrimethoxysilane --.

UNITED STATES PATENT AND TRADEMARK OFFICE

CERTIFICATE OF CORRECTION

PATENT NO. : 6,936,394 B2
DATED : August 30, 2005
INVENTOR(S) : Kenji Okado et al.

It is certified that error appears in the above-identified patent and that said Letters Patent is hereby corrected as shown below:

Column 47,
Table 4, "$SG_r$" should read -- $SG_t$ --.

Column 49,
Lines 29 and 33, "hexamethyl-disilazane)." should read -- hexamethyldisilazane). --;
Lines 40 and 46, "copper-phthalocyanine" should read -- copper phthalocyanine --;
Line 51, "pigment instead of the" should read -- pigment --;
Line 52, "copper-phthalocyanine pigment." should be deleted; and
Line 64, "foam" should read -- form --.

Column 50,
Line 2, "FIG." should read -- FIG. 5 --;
Line 8, "apply" should read -- applying --;
Line 9, "VAC" should read -- $V_{AC}$ --; and
Line 32, "image a" should read -- image (a --.

Column 51,
Lines 3 and 11, "formation" should read -- formation on --;
Line 5, "wax" should read -- was --; and
Lines 49 and 66, "than" should read -- than in --.

Column 52,
Lines 28, 42, 51 and 63, "than" should read -- than in --.

Column 53,
Line 12, "than" should read -- than in --.

Column 54,
Line 52, "than" should read -- than in --; and
Table 5, "Image density (DI. 5)" should read -- Image density (I.D. 1.5) --.

Column 55,
Table 5, "Image density (DI. 5)" should read -- Image density (I.D. 1.5) --.

Column 57,
Line 38, "comprise" should read -- comprises --;
Line 47, "($\delta_{1000}$)" should read -- ($\sigma_{1000}$) --;
Lines 49 and 50, "($\delta_r$)" should read -- ($\sigma_r$) --;
Line 54, "stated" should read -- state --;
Lines 59 and 64, "$\delta_r$" should read -- $\sigma_r$ --;
Line 62, "$1.0 \leq d/\delta_r < 30.0$." should read -- $1.0 \leq d/\sigma_r < 30.0$ --; and

UNITED STATES PATENT AND TRADEMARK OFFICE

CERTIFICATE OF CORRECTION

PATENT NO. : 6,936,394 B2
DATED : August 30, 2005
INVENTOR(S) : Kenji Okado et al.

It is certified that error appears in the above-identified patent and that said Letters Patent is hereby corrected as shown below:

Column 57 (cont'd),
Line 67, "$5.1 \leq d/\delta_r \leq 12.3$." should read -- $5.0 \leq d/\sigma_r \leq 12.3$. --.

Column 58,
Line 44, "2-50 wt" should read -- 2-50 wt. --.

Column 59,
Line 4, "($\delta_{1000}$)" should read -- ($\sigma_{1000}$) --;
Lines 6 and 34, "($\delta_r$)" should read -- ($\sigma_r$) --;
Line 24, "comprise" should read -- comprises --;
Line 38, "stated" should read -- state --;
Lines 43 and 49, "$\delta_r$" should read -- $\sigma_r$ --;
Line 52, "$5.1 \leq d/\delta_r \leq 12.3$." should read -- $5.1 \leq d/\sigma_r \leq 12.3$. --; and
Line 59, "$1.0 \leq d/\delta_r < 30.0$." should read -- $1.0 \leq d/\sigma_r < 30.0$. --.

Column 60,
Line 37, "2-50 wt" should read -- 2-50 wt. --;
Line 43, "($\delta_{1000}$)" should read -- ($\sigma_{1000}$) --; and
Line 45, "($\delta_r$)" should read -- ($\sigma_r$) --.

Signed and Sealed this

Seventh Day of February, 2006

JON W. DUDAS
*Director of the United States Patent and Trademark Office*